US010983451B2

(12) United States Patent
Hashimoto et al.

(10) Patent No.: US 10,983,451 B2
(45) Date of Patent: Apr. 20, 2021

(54) TONER

(71) Applicant: CANON KABUSHIKI KAISHA, Tokyo (JP)

(72) Inventors: Yasuhiro Hashimoto, Mishima (JP); Yojiro Hotta, Mishima (JP); Koji Nishikawa, Susono (JP); Takaaki Furui, Tokyo (JP); Shotaro Nomura, Suntou-gun (JP); Yuujirou Nagashima, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/728,082

(22) Filed: Dec. 27, 2019

(65) Prior Publication Data

US 2020/0209771 A1 Jul. 2, 2020

(30) Foreign Application Priority Data

Dec. 28, 2018 (JP) ..... JP2018-247032

(51) Int. Cl.
*G03G 9/08* (2006.01)
*G03G 9/087* (2006.01)
*G03G 9/097* (2006.01)

(52) U.S. Cl.
CPC ..... *G03G 9/08755* (2013.01); *G03G 9/0819* (2013.01); *G03G 9/0823* (2013.01); *G03G 9/0827* (2013.01); *G03G 9/08711* (2013.01); *G03G 9/08773* (2013.01); *G03G 9/08782* (2013.01); *G03G 9/09725* (2013.01); *G03G 9/09775* (2013.01)

(58) Field of Classification Search
CPC ..... G03G 9/09775; G03G 9/09725
USPC ..... 430/108.3, 108.6
See application file for complete search history.

(56) References Cited

U.S. PATENT DOCUMENTS 5,601,913 A 2/1997 Ohtani et al.
6,528,222 B2 3/2003 Kohtaki et al.
(Continued)

FOREIGN PATENT DOCUMENTS

EP 0 430 076 6/1991
EP 2 669 740 12/2013
(Continued)

OTHER PUBLICATIONS

U.S. Appl. No. 16/728,050, Tsuneyoshi Tominaga, filed Dec. 27, 2019.
(Continued)

*Primary Examiner* — Mark A Chapman
(74) *Attorney, Agent, or Firm* — Venable LLP

(57) ABSTRACT

A toner comprising an organosilicon polymer particle and a toner particle containing a binder resin and a wax, wherein the organosilicon polymer particle contains an organosilicon polymer, a part of silicon atoms in the organosilicon polymer has a T3 unit structure, a ratio of an area of peaks derived from silicon having the T3 unit structure relative to a total area of peaks derived from all silicon element contained in the organosilicon polymer particle is from 0.70 to 1.00 in $^{29}$Si-NMR measurement of the organosilicon polymer particle, a plurality of domains of the wax are present in a cross-section of the toner particle, the wax is an ester wax, the average long diameter of the domains of the ester wax is from 0.03 μm to 2.00 μm, and the SP value SPw of the wax is from 8.59 to 9.01.

15 Claims, 1 Drawing Sheet

(56) References Cited

U.S. PATENT DOCUMENTS

| | | | |
|---|---|---|---|
| 6,586,147 | B2 | 7/2003 | Iida et al. |
| 6,751,424 | B2 | 6/2004 | Komatsu et al. |
| 6,808,852 | B2 | 10/2004 | Hotta et al. |
| 6,929,894 | B2 | 8/2005 | Sugahara et al. |
| 7,112,393 | B2 | 9/2006 | Komoto et al. |
| 7,115,349 | B2 | 10/2006 | Iida et al. |
| 7,147,980 | B2 | 12/2006 | Itakura et al. |
| 7,273,686 | B2 | 9/2007 | Onuma et al. |
| 7,288,354 | B2 | 10/2007 | Moribe et al. |
| 7,306,889 | B2 | 12/2007 | Okubo et al. |
| 7,351,509 | B2 | 4/2008 | Moribe et al. |
| 7,422,832 | B2 | 9/2008 | Ogawa et al. |
| 7,455,947 | B2 | 11/2008 | Ida et al. |
| 7,459,253 | B2 | 12/2008 | Abe et al. |
| 7,544,457 | B2 | 6/2009 | Hashimoto et al. |
| 7,582,401 | B2 | 9/2009 | Ogawa et al. |
| 7,629,100 | B2 | 12/2009 | Okamoto et al. |
| 7,745,089 | B2 | 6/2010 | Okubo et al. |
| 7,816,063 | B2 | 10/2010 | Hashimoto et al. |
| 8,053,156 | B2 | 11/2011 | Abe et al. |
| 8,114,562 | B2 | 2/2012 | Ishigami et al. |
| 8,227,162 | B2 | 7/2012 | Sane et al. |
| 8,247,147 | B2 | 8/2012 | Abe et al. |
| 8,367,289 | B2 | 2/2013 | Isono et al. |
| 8,426,094 | B2 | 4/2013 | Magome et al. |
| 8,440,382 | B2 | 5/2013 | Osono et al. |
| 8,497,054 | B2 | 7/2013 | Sugiyama et al. |
| 8,614,044 | B2 | 12/2013 | Matsui et al. |
| 8,652,737 | B2 | 2/2014 | Handa et al. |
| 8,778,581 | B2 | 7/2014 | Nonaka et al. |
| 8,778,585 | B2 | 7/2014 | Matsui et al. |
| 8,883,389 | B2 | 11/2014 | Matsui et al. |
| 8,916,319 | B2 | 12/2014 | Ikeda et al. |
| 8,927,188 | B2 | 1/2015 | Naka et al. |
| 8,940,467 | B2 | 1/2015 | Hashimoto et al. |
| 9,040,216 | B2 | 5/2015 | Fukudome et al. |
| 9,046,800 | B2 | 6/2015 | Hotta et al. |
| 9,097,997 | B2 | 8/2015 | Nomura et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |
| 9,201,323 | B2 | 12/2015 | Nishikawa et al. |
| 9,213,250 | B2 | 12/2015 | Nomura et al. |
| 9,217,943 | B2 | 12/2015 | Matsui et al. |
| 9,229,345 | B2 | 1/2016 | Ikeda et al. |
| 9,250,548 | B2 | 2/2016 | Nomura et al. |
| 9,261,804 | B2 | 2/2016 | Yamazaki et al. |
| 9,341,970 | B2 | 5/2016 | Yoshiba et al. |
| 9,423,714 | B2 | 8/2016 | Kenmoku et al. |
| 9,470,993 | B2 | 10/2016 | Nishikawa et al. |
| 9,575,425 | B2 | 2/2017 | Naka et al. |
| 9,588,450 | B2 | 3/2017 | Tsuda et al. |
| 9,606,462 | B2 | 3/2017 | Nomura et al. |
| 9,715,188 | B2 | 7/2017 | Terauchi et al. |
| 9,772,570 | B2 | 9/2017 | Tsuda et al. |
| 9,778,583 | B2 | 10/2017 | Terauchi et al. |
| 9,804,514 | B2 | 10/2017 | Suzumura et al. |
| 9,829,818 | B2 | 11/2017 | Yoshiba et al. |
| 9,841,692 | B2 | 12/2017 | Hasegawa et al. |
| 9,897,932 | B2 | 2/2018 | Hotta et al. |
| 9,964,874 | B2 | 5/2018 | Suzumura et al. |
| 9,971,263 | B2 | 5/2018 | Fukudome et al. |
| 10,012,919 | B2 | 7/2018 | Matsui et al. |
| 10,101,683 | B2 | 10/2018 | Nishikawa et al. |
| 10,156,800 | B2 | 12/2018 | Tsuda et al. |
| 10,197,934 | B2 | 2/2019 | Matsui et al. |
| 10,228,627 | B2 | 3/2019 | Nagashima et al. |
| 10,228,630 | B2 | 3/2019 | Mizuguchi et al. |
| 10,241,430 | B2 | 3/2019 | Kumura et al. |
| 10,289,016 | B2 | 5/2019 | Fukudome et al. |
| 10,295,920 | B2 | 5/2019 | Nishikawa et al. |
| 10,295,921 | B2 | 5/2019 | Ohmori et al. |
| 10,303,075 | B2 | 5/2019 | Tanaka et al. |
| 10,310,397 | B2 | 6/2019 | Sano et al. |
| 2004/0058258 | A1 | 3/2004 | Yoshino et al. |
| 2004/0137356 | A1 | 7/2004 | Tomita et al. |
| 2008/0226998 | A1 | 9/2008 | Ishii et al. |
| 2009/0117477 | A1 | 5/2009 | Magome et al. |
| 2009/0155706 | A1 | 6/2009 | Shu et al. |
| 2010/0248110 | A1 | 9/2010 | Taguchi et al. |
| 2014/0220488 | A1 | 8/2014 | Hosoya et al. |
| 2015/0125790 | A1 | 5/2015 | Hotta et al. |
| 2015/0220013 | A1 | 8/2015 | Nishikawa et al. |
| 2016/0139522 | A1 | 5/2016 | Yoshiba et al. |
| 2016/0161874 | A1 | 6/2016 | Yamazaki et al. |
| 2016/0187799 | A1 | 6/2016 | Hiroshi et al. |
| 2016/0299446 | A1 | 10/2016 | Kuroki et al. |
| 2016/0378003 | A1 | 12/2016 | Arimura et al. |
| 2017/0219947 | A1 | 8/2017 | Omori et al. |
| 2017/0329246 | A1 | 11/2017 | Yamawaki et al. |
| 2018/0329323 | A1 | 11/2018 | Kimura et al. |
| 2018/0329324 | A1 | 11/2018 | Kamikura et al. |
| 2018/0329327 | A1 | 11/2018 | Yamawaki et al. |
| 2018/0329329 | A1 | 11/2018 | Nakamura et al. |
| 2019/0235402 | A1 | 8/2019 | Inoue et al. |

FOREIGN PATENT DOCUMENTS

| | | |
|---|---|---|
| EP | 2 818 932 | 12/2014 |
| EP | 2 853 945 | 4/2015 |
| EP | 2 860 585 | 4/2015 |
| EP | 3 095 805 | 11/2016 |
| EP | 3 480 661 | 5/2019 |
| JP | 2007-171272 | 7/2007 |
| JP | 2013-140235 | 7/2013 |
| JP | 2017-021262 | 1/2017 |
| JP | 2017-062316 | 3/2017 |
| JP | 2018-054961 | 4/2018 |
| WO | 2018/003749 | 1/2018 |

OTHER PUBLICATIONS

U.S. Appl. No. 16/728,060, Kentaro Yamawaki, filed Dec. 27, 2019.
U.S. Appl. No. 16/728,101, Taiji Katsura, filed Dec. 27, 2019.
U.S. Appl. No. 16/728,115, Shotaru Nomura, filed Dec. 27, 2019.
U.S. Appl. No. 16/728,122, Masamichi Sato, filed Dec. 27, 2019.
U.S. Appl. No. 16/728,151, Masatake Tanaka, filed Dec. 27, 2019.
U.S. Appl. No. 16/728,157, Shohei Kototani, filed Dec. 27, 2019.
U.S. Appl. No. 16/728,171, Takaaki Furui, filed Dec. 27, 2019.
U.S. Appl. No. 16/728,179, Koji Nishikawa, filed Dec. 27, 2019.
U.S. Appl. No. 16/701,260, Koji Nishikawa, filed Dec. 3, 2019.
U.S. Appl. No. 16/701,292, Tetsuya Kinumatsu, filed Dec. 3, 2019.
U.S. Appl. No. 16/701,412, Kosuke Fukudome, filed Dec. 3, 2019.

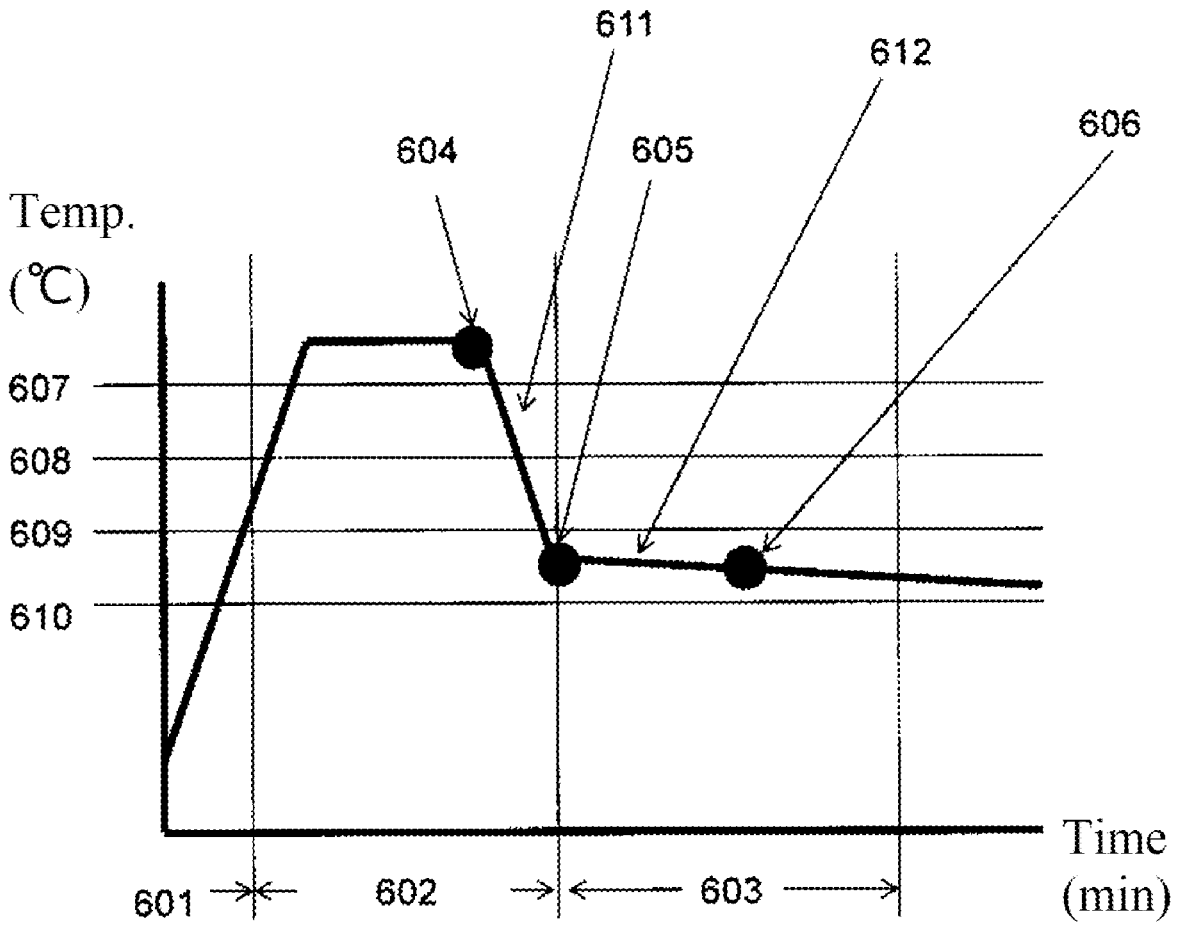
611
612
606
604
605
Temp.
(℃)
607
608
609
610
Time
(min)
601
602
603

TONER

BACKGROUND OF THE INVENTION

Field of the Invention

The present invention relates to a toner for electrostatic image development, for use in image formation by electrophotographic methods.

Description of the Related Art

The quality requirements for image-forming devices such as copiers and printers have become more stringent in recent years, and toners are also required to have more advanced performance. In the case of full-color copiers, full-color printers and the like in particular, there is strong demand for smaller sizes, lighter weights, energy savings, high image quality and environmental features, and also for further improvements in durability and low-temperature fixability. In the case of toners, better durability and low-temperature fixability are also in demand, as are reduced particle diameters and smaller environmental differences in charging performance.

To meet these demands in a method of manufacturing a toner by polymerization, Japanese Patent Application Publication No. 2007-171272 describes obtaining a toner with good storability and fixability, high image quality and excellent durability by keeping the particle diameter, average circularity and hardness of a toner with a core-shell structure within a specific range.

Japanese Patent Application Publication No. 2018-54961 describes a method for obtaining a toner exhibiting excellent developing performance during long-term use by adding an external additive containing a specific resin.

Japanese Patent Application Publication No. 2017-62316 describes a method for obtaining a toner whereby fogging and image density decrease after standing are suppressed by externally adding an elastomer particle containing a silicone oil and a titanium oxide containing a specific element.

Japanese Patent Application Publication No. 2013-140235 describes a method for obtaining a toner with excellent charging performance, environmental stability and print durability by externally adding a specific number of parts of a silicone resin particle with a specific particle diameter and particle size distribution and a positively charging inorganic fine particle with a specific particle diameter.

Japanese Patent Application Publication No. 2017-21262 describes a method for obtaining a toner whereby both cleaning performance and reduced contamination of the member are achieved by controlling the uneven distribution of release agent domains dispersed in the binder resin of the toner particle, and externally adding a resin particle to the toner particle.

SUMMARY OF THE INVENTION

However, in the case of Japanese Patent Application Publication No. 2007-171272 there are still some problems of durability in high-temperature, high-humidity environments and low-temperature, low-humidity environments.

Moreover, in Japanese Patent Application Publication No. 2018-54961 there are still some problems with durability in high-temperature, high-humidity environments and low-temperature, low-humidity environments, and problems of fixing performance have also been found.

In Japanese Patent Application Publication No. 2017-62316 and Japanese Patent Application Publication No. 2013-140235, there are still some problems of durability in low-temperature, low-humidity environments, and problems of fixing performance have also been found.

In Japanese Patent Application Publication No. 2017-21262, there are still some problems of fixing performance, as well as problems of reduced durability due to embedding of the resin particle.

It is an object of the present invention to provide a toner with excellent durability and fixing performance.

The inventors discovered the following methods as a result of exhaustive research aimed at solving the above problems.

That is, the present invention relates to a toner comprising:

a toner particle containing a binder resin and a wax; and an organosilicon polymer particle, wherein the organosilicon polymer particle contains an organosilicon polymer having a structure of silicon atoms and oxygen atoms alternately bound to one another, a part of silicon atoms in the organosilicon polymer has a T3 unit structure represented by $R^{a}SiO_{3/2}$, where $R^{a}$ denotes a $C_{1-6}$ alkyl group or phenyl group, a ratio of an area of peaks derived from silicon having the T3 unit structure relative to a total area of peaks derived from all silicon element contained in the organosilicon polymer particle is from 0.70 to 1.00 in $^{29}$Si-NMR measurement of the organosilicon polymer particle, a plurality of domains of the wax are present in a cross-section of the toner particle observed under a scanning transmission electron microscope, the wax is an ester wax, the average long diameter of the domains of the ester wax is from 0.03 μm to 2.00 μm, and the SP value SPw of the wax is from 8.59 to 9.01.

According to the present invention, a toner with excellent durability and fixing performance can be provided.

Further features of the present invention will become apparent from the following description of exemplary embodiments with reference to the attached drawings.

BRIEF DESCRIPTION OF THE DRAWINGS

The FIGURE shows one example of a temperature transition in a cooling process.

DESCRIPTION OF THE EMBODIMENTS

Unless specifically indicated otherwise, the expressions "from XX to YY" and "XX to YY" that show numerical value ranges refer in the present invention to numerical value ranges that include the lower limit and upper limit that are the end points.

Details of the present invention are described below.

A toner comprising:

a toner particle containing a binder resin and a wax; and an organosilicon polymer particle, wherein the organosilicon polymer particle contains an organosilicon polymer having a structure of silicon atoms and oxygen atoms alternately bound to one another, a part of silicon atoms in the organosilicon polymer has a T3 unit structure represented by $R^{a}SiO_{3/2}$, where $R^{a}$ denotes a $C_{1-6}$ alkyl group or phenyl group, a ratio of an area of peaks derived from silicon having the T3 unit structure relative to a total area of peaks derived from all silicon element contained in the organosilicon polymer particle is from 0.70 to 1.00 in $^{29}$Si-NMR measurement of the organosilicon polymer particle, a plurality of domains of the wax are present in a cross-section of the toner particle observed under a scanning transmission electron microscope, the wax is an ester wax, the average long diameter of the domains of the ester wax is from 0.03 μm to 2.00 μm, and the SP value SPw of the wax is from 8.59 to 9.01.

The inventors believe that the effects of the present invention are obtained for reasons such as the following.

The average long diameter of wax domains in a toner particle is normally less than 0.03 pin, and when the wax is an ester wax, the wax is melted by friction and stirring heat in the electrophotographic image-forming process, by heat from heat sources and by heat caused by the use environment, and blends with the binder resin while being exuded onto the toner particle surface. Therefore, image quality is likely to decline during long-term use in high-temperature, high-humidity environments in particular. If the average long diameter of the wax domains exceeds 2.00 μm, on the other hand, heat resistance is excellent, but fixing performance declines due to insufficient wax exudation during the fixing process The average long diameter of the wax domains is preferably from 0.03 μm to 1.80 μm, or more preferably from 0.05 μm to 1.50 μm. The average long diameter of the wax domains can be controlled by changing the type of wax and the cooling conditions such as the cooling speed, cooling initiation temperature and cooling achieved temperature in the cooling step described below.

The organosilicon polymer particle contains an organosilicon polymer having a structure of alternately binding silicon atoms and oxygen atoms. The organosilicon polymer particles preferably contain an organosilicon polymer of 90 mass % to 100 mass % based on the organosilicon polymer particles.

Moreover, a part of silicon atoms in the organosilicon polymer has a T3 unit structure represented by $R^{a}SiO_{3/2}$, in which $R^{a}$ represents a $C_{1-6}$ alkyl group or phenyl group, and in $^{29}$Si-NMR measurement of the organosilicon polymer particle, the ratio of the area of peaks derived from silicon having the T3 unit structure relative to the total area of peaks derived from all silicon element contained in the organosilicon polymer particle must be from 0.70 to 1.00. If these conditions are fulfilled, the organosilicon polymer particle is suitably hydrophobic and has a suitable crosslinking density, with little irregularity in the distance between crosslinking points. It therefore has a suitable elasticity, and although it is as durable as inorganic matter such as ordinary silica, compatibility with the ester wax is greater the closer the SP value of the ester wax is to the SP value of the organosilicon polymer particle.

The ratio of the area of peaks derived from the silicon having a T3 unit structure is preferably from 0.80 to 1.00, or more preferably from 0.90 to 1.00, or still more preferably from 0.97 to 1.00.

To obtain excellent fixing performance, it is desirable that the organosilicon polymer particle be present on the surface of a toner particle having multiple domains of an ester wax with an SP value close to that of the organosilicon polymer particle, since exudation of the ester wax is promoted during toner fixing because the particle is highly compatible with the ester wax.

If the SP value SPw of the ester wax is from 8.59 to 9.01, not only is exudation of the ester wax good during fixing, but the ester wax is unlikely to be exposed on the toner particle surface because it is suitable hydrophobic. Because the ester wax blends easily with the organosilicon polymer particle, moreover, exudation of the ester wax onto the toner particle surface is not promoted during steps other than the fixing step. This is desirable because it results in excellent image quality during long-term use.

The SPw is preferably from 8.59 to 8.98, or more preferably from 8.59 to 8.93.

For the above effects to be achieved, it is necessary that a specific organosilicon polymer particle be present on the surface of a toner particle having multiple ester wax domains in which the SPw is from 8.59 to 9.01 and the average long diameter of the domains is from 0.03 μm to 2.00 μm. If the number of ester wax domains is 1 wax exudation is insufficient, which is undesirable from the standpoint of fixing performance.

It is thought that exudation of the ester wax onto the toner particle surface can be controlled appropriately because the properties of the silicon atoms in the organosilicon polymer particle are similar to those of carbon atoms, the ratio of oxygen atoms in the organosilicon polymer particle is optimal for obtaining a suitable affinity with the ester wax, and the organosilicon polymer particle also has a suitable distribution of distances between crosslinking points.

If the wax is not an ester wax but another wax such as a hydrocarbon wax in particular, effects such as those of the invention are not obtained during fixing because the structures and properties of the wax and the organosilicon polymer particle are dissimilar, and they have poor affinity for one another.

The difference between the SP value SPsi of the organosilicon polymer and the SP value SPw of the ester wax is preferably not more than 0.40, or more preferably from 0.04 to 0.40.

If the wax is an ester wax it has ester bonds, and common binder resins in toners such as polyester resins and styrene-acrylic resins also have ester bonds. Since the affinity between the two is relatively high, therefore, the exudation speed of the ester wax during fixing is not too great.

A difference of not more than 0.40 between SPsi and SPw is desirable from the standpoint of fixing performance because it means that the exudation speed of the ester wax onto the toner particle surface is more rapid during fixing due to the strong affinity between the ester wax and the organosilicon polymer on the toner particle surface. Moreover, a difference of from 0.04 to 0.40 between SPsi and SPw is desirable not only from the standpoint of fixing performance, but also from the standpoint of storability during long-term use and for suppressing contamination of the member due to wax exudation.

The SP value SPsi of the organosilicon polymer is preferably from 7.80 to 11.50, or more preferably from 8.40 to 10.30, or still more preferably from 8.70 to 10.30. Because the SP value is higher if the structure contains more siloxane bonds, the ratio of formula (B) ($R^{1}SiO_{3/2}$) and formula (A) ($SiO_{4/2}$) below is preferably relatively high in the organosilicon polymer, and the ratio of formula (C) ($R^{2}R^{3}SiO_{2/2}$) and formula (D) ($R^{4}R^{5}R^{6}SiO_{1/2}$) below is preferably relatively low.

Thus, if SPsi is from 7.80 to 11.50, this means that not only is there a suitable ratio of T3 unit structures, but also that the ratios of the structures represented by formulae (A), (C) and (D) are appropriate. Consequently, the crosslinking density of the organosilicon polymer is within a suitable range, which gives it excellent durability as well as hardness and elasticity, and is also desirable for achieving both durability and fixing performance because the wax molecules can easily penetrate the interior of the organosilicon polymer when the wax is exuded during fixing.

(A)

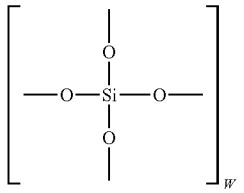

(B)

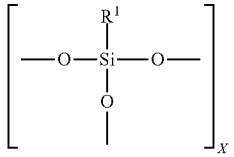

(C)

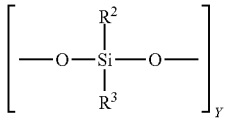

(D)

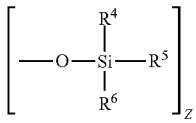

Given W, X, Y and Z as the molar ratios of the respective structures in the organosilicon polymer (W+X+Y+Z=1.00), X is preferably 0.70 to 1.00, or more preferably 0.90 to 1.00. Each of $R^2$, $R^3$, $R^4$, $R^5$ and $R^6$ in the formulae independently represents a $C_{1-6}$ (preferably $C_{1-3}$, more preferably $C_{1-2}$) alkyl group, a phenyl group, a halogen atom, a hydroxyl group, an acetoxy group, or a $C_{1-6}$ (preferably $C_{1-3}$, more preferably $C_{1-2}$) alkoxy group. $R^1$ represents a $C_{1-6}$ (preferably $C_{1-3}$, more preferably $C_{1-2}$) alkyl group or phenyl group. In each structure, at least one of $R^2$, $R^3$, $R^4$, $R^5$ and $R^6$ is such an alkyl group or phenyl group.

The organosilicon polymer is preferably composed of at least one structure selected from the group consisting of the structures represented by formulae (A), (B), (C) and (D), and more preferably has a structure represented by formula (B).

Method for Calculating Solubility Parameter (SP Value)

The solubility parameter (SP value) is calculated using Fedors' equation below.

The values of Δei and Δvi below are with reference to "the energies of vaporization and molar volumes (25° C.) of the atoms and atomic groups according to Table 3-9 of Basic Coating Science, pages 54-57, 1986 (published by Maki Shoten)".

The SP values are given in units of $(cal/cm^3)^{1/2}$, but may also be converted to units of $(J/m^3)^{1/2}$ using the formula 1 $(cal/cm^3)^{1/2}=2.046\times10^3$ $(J/m^3)$.

$$\delta i=(Ev/V)^{1/2}=(\Delta ei/\Delta vi)^{1/2}$$

Ev: Evaporation energy

V: Molar volume

Δei: Evaporation energy of atoms or atomic groups of i component

Δvi: Molar volume of atoms or atomic groups of i component

Identifying Structures of Wax and Crystalline Polyester

The wax has a low molecular weight, while that of the crystalline polyester is higher. Using this fact, the wax and crystalline polyester are separated from the toner.

Specifically, 100 mg of toner is dissolved in 3 mL of chloroform. Insoluble matter is then removed by suction filtration with a syringe having an attached sample treatment filter (pore size from 0.2 μm to 0.5 μm, such as Maishori Disk H-25-2 (Tosoh Corporation). The soluble matter is introduced into preparatory HPLC (equipment: two connected Japan Analytical Industry LC-9130 NEXT preparatory columns (60 cm) with exclusion limits of 20,000 and 70,000), and chloroform eluent is supplied. If peaks can be confirmed from the resulting chromatograph display, the solution is separated before and after the retention time at which the molecular weight is 5,000 with a monodispersed polystyrene standard sample.

An evaporator is used to remove the solvent from the separated solutions, which are then vacuum dried for 24 hours to obtain samples with molecular weights of less than 5,000 (X component) and at least 5,000 (Y component), respectively.

The X component is then pyrolyzed with methylation by heating it to 590° C. with a JPS-700 pyrolysis unit (Japan Analytical Industry) in the presence of tetramethyl ammonium hydroxide (TMAH).

Using GC-MASS (ThermoFisher Scientific ISQ Focus GC, HP-5MS (30 m)), respective peaks are then obtained for the carboxylic acid component and alcohol component derived from the ester compound. Methylates are normally obtained from pyrolysis of crystalline polyester or wax. The resulting peaks can then be analyzed to estimate and identify the structures of the wax and crystalline polyester.

Method for Measuring Peak Molecular Weight (Mp) of Wax

The peak molecular weight (Mp) of the wax is measured as follows by gel permeation chromatography (GPC).

First, the wax A is dissolved in tetrahydrofuran (THF) at room temperature. The resulting solution is then filtered with a "Maishori Disk" solvent-resistant membrane filter with a pore diameter of 0.2 μm (Tosoh Corporation) to obtain a sample solution. The concentration of THF-soluble components in the sample solution is adjusted to 0.8 mass %. Measurement is performed under the following conditions using this sample solution.

System: HLC-8220 GPC high-speed GPC unit (Tosoh Corporation)

Columns: LF-604×2 (Showa Denko K.K.)

Eluent: THF

Flow rate: 0.6 mL/min

Oven temperature: 40° C.

Sample injection volume: 0.020 mL

A molecular weight calibration curve prepared using standard polystyrene resin (product name: TSK standard polystyrene F-850, F-450, F-288, F-128, F-80, F-40, F-20, F-10, F-4, F-2, F-1, A-5000, A-2500, A-1000, A-500, Tosoh Corporation) is used for calculating the molecular weights of the samples.

Observing Cross-Section of Toner Particle with Scanning Transmission Electron Microscope The condition of the wax in the toner is confirmed by observing a cross-section of a toner particle with a scanning transmission electron microscope.

In a cross-sectional image of a toner particle taken with a scanning transmission electron microscope, the wax appears as domains. The state of the wax can be specified by counting the numbers and shapes of these wax domains.

The procedures for observing the toner particle cross-section are as follows.

The toner is embedded in visible light-curable embedding resin (D-800, Nisshin EM Co.), and cut to a thickness of 70 nm with an ultrasound Ultramicrotome (UC7, Leica).

Of the resulting thin sample sections, 10 are randomly selected out of those in which the diameter of the toner particle cross-section is within +2.0 μm of the weight-average particle diameter (D4) of the toner particle.

The selected sample sections are stained for 15 minutes in a 500 Pa $RuO_4$ gas atmosphere with a vacuum staining apparatus (VSC4R1H, Filgen), and STEM images are prepared using a scanning transmission electron microscope (JEM 2800, JEOL) in scanning image mode.

Images are obtained with a STEM probe size of 1 nm and an image size of 1024×1024 pixels. In the bright field image Detector Control panel the contrast is adjusted to 1425 and the brightness to 3750, while in the Image Control panel the contrast is adjusted to 0.0, the brightness to 0.5 and the gamma to 1.00, and STEM images are obtained.

The resulting STEM images are binarized (threshold 120/255 levels) with Image-Pro Plus image processing software (Media Cybernetics) to clarify the distinction between the wax domains and the binder resin regions.

When the binarization threshold is set to 210, the parts that appear white are wax domains.

Methods for Calculating Average Number and Average Long Diameter of Wax Domains

In the STEM images of the 10 selected toner particle cross-sections, the number of wax domains in each is counted, and the average is given as the average number of domains per one toner particle.

Moreover, in the STEM images of the 10 selected toner particle cross-sections, 2 μm×2 μm regions are selected randomly in each image, the long diameters (maximum diameters) of all the domains contained in each region are counted, and the average value is given as the average long diameter (r1) of the domains.

Method for Calculating Ratio of Toner Particles Having Wax Domains in Region within 0.05 μm of Toner Particle Surface The ratio of toner particles having wax domains in a region within 0.05 μm (or 0.10 μm and 1.00 μm) of the toner particle surface is calculated by the following methods using the above STEM images and Image-Pro Plus image processing software (Media Cybernetics).

The toner particle surface (outline of toner particle cross-section) and the center of gravity of each toner particle cross-section are specified in the resulting STEM images. A line is drawn from the resulting center of gravity to a point on the outline of the toner particle cross-section. A position 0.05 μm from the outline (toner particle surface) is specified on this line.

This operation is repeated once around the outline of each toner particle cross-section to delineate a region within 0.05 μm of the toner particle surface. The number of toner particles with domains in this region is then counted. Domains straddling the border 0.05 μm from the toner particle surface are not considered to belong to the region. 100 cross-sections are observed, and the ratio is calculated.

The domains are also specified and the ratio calculated in the regions within 0.10 μm and 1.00 μm of the toner particle surface.

The SP value SPs of the resin on the surface of the toner particle is preferably from 9.94 to 10.90, or more preferably from 10.00 to 10.80. Within this range, the wax has suitable exudation properties because there is a suitable difference between the SPs and the SP value SPw of the wax, resulting in good fixing performance and good image quality during-long-term use.

Method for Calculating SP Value (Sps) of Resin on Toner Particle Surface by Time-of-Flight Secondary Ion Mass Spectrometry (TOF-SIMS)

With time-of-flight secondary ion mass spectrometry (TOF-SIMS), the constituent materials near the outermost surface of the toner particle can be specified because it is possible to obtain data about the few nm from the toner particle surface.

An Ulvac-Phi Inc. TRIFT-IV is used to identify the resins present on the surface of the toner particle by TOF-SIMS.

The analysis conditions are as follows.

Sample preparation: Toner attached to indium sheet
Sample pre-treatment: None
Primary ions: Au ions
Acceleration voltage: 30 kV
Charge neutralization mode: On
Measurement mode: Negative
Raster: 100 μm The composition of the resins present on the surface of the toner particle is identified from each peak, and the abundance ratios are calculated.

Based on the composition of resins on the surface of the toner particle, the SP value (SPs) of the resin on the toner particle surface is calculated by the above methods for calculating the solubility parameter (SP value).

For example, S211 is a peak derived from the Bisphenol A. Similarly, S85 is a peak derived from the butyl acrylate.

When calculating the peak intensity (S85) derived from the vinyl resin, the total count of mass numbers 84.5 to 85.5 according to the Ulvac-Phi standard software (Win Cadense) is the peak intensity (S85).

When calculating the peak intensity (S211) derived from the amorphous polyester, the total count of mass numbers 210.5 to 211.5 according to the Ulvac-Phi standard software (Win Cadense) is the peak intensity (S211).

To calculate the abundance ratio of these substances (S211/S85), the intensity ratio (S211/S85) is calculated using the calculated S85 and S211 values.

The SP value SPw of the wax and the SP value SPs of the resin on the toner particle surface are preferably in the relationship shown by formula (1) below, and more preferably in the relationship shown by formula (1') below.

$$1.10 \leq SPs - SPw \leq 2.60 \quad (1)$$

$$1.15 \leq SPs - SPw \leq 2.25 \quad (1')$$

A wax that satisfies the above formulae has optimal exudation properties, resulting in good fixing performance and image quality during long-term use.

In a cross-section of the toner particle observed under a scanning transmission electron microscope, it is desirable that the ratio of toner particles having wax domains in the region within 0.05 μm of the toner particle surface be not more than 20% by number, or more preferably not more than 18% by number. There is no particular lower limit, but preferably it is at least 2 number % or more preferably at least 5 number %. The ratio of these toner particles can be controlled by controlling the types and contents of the materials of the shell layer forming the toner surface layer, the type and content of the wax, and the cooling conditions in the cooling step described below.

The ratio of toner particles having wax domains in the region within 0.10 μm of the toner particle surface is preferably not more than 50 number %, or more preferably not more than 45 number %. There is no particular lower limit, but preferably it is at least 5 number %, or more preferably at least 10 number %. The ratio of these toner particles can be controlled by controlling the types and contents of the materials of the shell layer forming the toner surface layer, the type and content of the wax, and the cooling conditions in the cooling step described below.

The ratio of toner particles having wax domains in the region within 1.00 μm of the toner particle surface is preferably at least 50 number %, or more preferably at least 55 number %. There is no particular upper limit, but preferably it is not more than 95 number %, or more preferably not more than 90 number %. The ratio of these toner particles can be controlled by controlling the types and contents of the materials of the shell layer forming the toner surface layer, the type and content of the wax, and the cooling conditions in the cooling step described below.

Within this range, fixing performance and durability can both be obtained because exudation of the wax onto the toner particle surface is suitable in high-temperature environments.

The wax is an aliphatic ester wax with a melting point of from 63° C. to 95° C. and a peak molecular weight Mp of from 400 to 2,500 (more preferably from 500 to 2,000). More preferably the wax is an aliphatic ester wax with a melting point of from 65° C. to 95° C. and a peak molecular weight Mp of from 400 to 2,500.

Using such a wax, fixing performance and image quality during long-term use are both good because the exudation properties of the wax are optimized.

Given Mp as the peak molecular weight of the wax and SPb as the SP value of the binder resin, Mp, SPw and SPb preferably satisfy formula (2) below, and more preferably satisfy formula (2') below.

$$500 \leq (SPb-SPw)^2 \times Mp \leq 3{,}000 \quad (2)$$

$$500 \leq (SPb-SPw)^2 \times Mp \leq 2{,}600 \quad (2')$$

The $\chi$ parameter can be considered as an indicator of the compatibility of two substances (the binder resin and wax for example), and this $\chi$ parameter is proportional to the product of the peak molecular weight Mp of the wax times the square of the difference between the SP values of the two substances $(SPb-SPw)^2$.

Consequently, formula (2) indicates whether the wax is easily exuded through the binder resin onto the toner particle surface. If formula (2) is satisfied, the wax is easily exuded onto the toner particle surface during fixing because it is appropriately compatible with the binder resin. Exudation is thus suppressed at times other than fixing, resulting in excellent toner charging performance.

The ratio (Dw/Dt) of the average long diameter Dw of the wax domains to the number-average particle diameter Dt of the toner is preferably from 0.05 to 0.45, or more preferably from 0.10 to 0.45, or still more preferably from 0.10 to 0.40.

Within this range, melt adhesion of the toner to the toner layer thickness control member is suppressed because not only the wax exudation but also the sharp melt property of the wax and the balance of wax hardness and toner hardness are optimized. It is also possible to achieve wax exudation during fixing while suppressing wax exudation at times other than fixing.

The toner particle preferably contains a crystalline polyester. If the toner particle contains a crystalline polyester, it sharp melts during fixing, and the wax is exuded more rapidly from the toner particle.

The content of the crystalline polyester in the toner particle is preferably from 1.00 mass % to 30.00 mass %, or more preferably from 2.00 mass % to 20.00 mass %.

The number-average particle diameter Dsi of the organosilicon polymer particle is preferably from 80 nm to 300 nm, or more preferably from 100 nm to 300 nm. Within this range, it is easier to achieve both fixing performance and durability because the organosilicon polymer particle is unlikely to become embedded in the toner particle surface even during long-term use, and is also unlikely to become detached.

Calculating Number-Average Particle Diameter of Organosilicon Polymer Particle

The number-average particle diameter Dsi of the organosilicon polymer particle is calculated based on an image of the toner surface taken with a Hitachi S-4800 ultra-high resolution field emission scanning electron microscope (Hitachi High Technologies). The S-4800 imaging conditions are as follows.

Operations (1) and (2) are performed as when calculating the coverage ratio below, the focus is adjusted with the toner surface magnified 50,000× as in (3) to focus the image, and brightness is adjusted in ABC mode. The magnification is then set at 100,000×, the focus is adjusted as in (3) using the focus knob and Stigma/Alignment knob, and the image is focused in autofocus. The focus adjustment operations are repeated again to focus the image at a magnification of 100,000×.

The particle diameters of at least 500 organosilicon polymer particles on the toner surface are then measured, and the number-average particle diameter is calculated.

If the original organosilicon polymer particle before external addition is available, it can also be used to calculate the number-average particle diameter by the above methods.

The organosilicon polymer particle contained in the toner can be distinguished as follows from other external additives such as silica.

Method for Confirming Organosilicon Polymer Particle in Toner

The organosilicon polymer particle contained in the toner is identified by a combination of shape observation by SEM and elemental analysis by EDS.

The toner is observed in a field enlarged to a maximum magnification of 50,000 with an S-4800 scanning electron microscope (Hitachi Ltd.). The microscope is focused on the toner particle surface, and the external additive is observed. Each particle of the external additive is subjected to EDS analysis, and each analyzed particle is judged to be an organosilicon polymer particle or not based on the presence or absence of an Si element peak.

When the toner contains both organosilicon polymer particles and silica fine particles, the organosilicon polymer particles are identified by comparing the ratio (Si/O ratio) for the Si and O element contents (atomic %) with a standard. EDS analysis is carried out under the same conditions on standards for both the organosilicon polymer particles and silica fine particles to obtain the element content (atomic %) for both the Si and O. Using A for the Si/O ratio for the organosilicon polymer particles and B for the Si/O ratio for the silica fine particles, measurement conditions are selected whereby A is significantly larger than B. Specifically, the measurement is run ten times under the same conditions on the standards and the arithmetic mean value is obtained for both A and B. Measurement conditions are selected whereby the obtained average values satisfy A/B>1.1.

When the Si/O ratio for a fine particle to be classified is on the A side from [(A+B)/2], the fine particle is then scored as an organosilicon polymer particle.

Tospearl 120A (Momentive Performance Materials Japan LLC) is used as the standard for the organosilicon polymer particles, and HDK V15 (Asahi Kasei Corporation) is used as the standard for the silica fine particles.

The organosilicon polymer particle is preferably a polyalkyl silsesquioxane particle. Fixing performance is thereby improved because the alkyl groups have suitable affinity with the wax. Affinity with the wax is particularly good if the carbon number of the alkyl groups is from 1 to 4, so that the wax is exuded appropriately and both fixing performance and durability can be easily obtained.

Identifying Organosilicon Polymer Particle

The compositions and ratios of the constituent compounds of the organosilicon polymer particle contained in the toner are identified by solid pyrolysis gas chromatography mass spectrometry (hereunder called pyrolysis GC/MS) and NMR.

When the toner contains a silica fine particle in addition to the organosilicon polymer particle, 1 g of toner is dissolved and dispersed in 31 g of chloroform in a vial. Dispersion is performed for 30 minutes using an ultrasound homogenizer to prepare a liquid dispersion.

Ultrasonic processing unit: VP-050 ultrasound homogenizer (Tietech Co.).

Microchip: Step microchip, tip diameter φ 2 mm

Microchip tip position: Center of glass vial and 5 mm above bottom of vial

Ultrasound conditions: Intensity 30%, 30 minutes; ultrasound is applied while cooling the vial with ice water so that the temperature of the dispersion does not rise The dispersion is transferred to a glass tube of a swing rotor (50 mL), and centrifuged for 30 minutes at 58.33 $S^{-1}$ with a centrifuge (Kokusan Co. H-9R). After centrifugation, silica fine particles with a high specific gravity are contained in the lower layer in the glass tube. The chloroform solution of the upper layer containing the organic silica polymer particles is collected, and the chloroform is removed by vacuum drying (40° C./24 hr) to prepare a sample.

Using this sample or the original organosilicon polymer particle, the abundance ratios of the constituent compounds of the organosilicon polymer particle and the ratio of T3 unit structures in the organosilicon polymer particle are measured and calculated by solid $^{29}$Si-NMR.

Solid pyrolysis GC/MS is used for analysis of the species of constituent compounds of the organosilicon polymer particles.

The species of constituent compounds of the organosilicon polymer particles can be identified by measurement of the mass spectrum of the pyrolyzate components derived from the organosilicon polymer particles and produced by pyrolysis of the toner at 550° C. to 700° C., and analysis of pyrolysis peak thereof.

Measurement Conditions for Pyrolysis GC/MS pyrolysis instrument: JPS-700 (Japan Analytical Industry Co., Ltd.)

pyrolysis temperature: 590° C.

GC/MS instrument: Focus GC/ISQ (Thermo Fisher)

column: HP-5MS, 60 m length, 0.25 mm inner diameter, 0.25 μm film thickness injection port temperature: 200° C.

flow pressure: 100 kPa split: 50 mL/min

MS ionization: EI ion source temperature: 200° C., 45 to 650 mass range

The abundance of the identified constituent compounds of the organosilicon polymer particles is then measured and calculated using solid-state $^{29}$Si-NMR.

In solid-state $^{29}$Si-NMR, peaks are detected in different shift regions depending on the structure of the functional groups bonded to the Si in the constituent compounds of the organosilicon polymer particles.

Each peak position identifies a structure bonded to Si through identification using a reference sample. The abundance of each constituent compound is calculated from the obtained peak areas. The determination is carried out by calculating the proportion for the peak area for the T3 unit structure.

The measurement conditions for the solid-state $^{29}$Si-NMR are as follows.

instrument: JNM-ECX5002 (JEOL RESONANCE)

temperature: room temperature measurement method: DDMAS method, $^{29}$Si, 45° sample tube: zirconia 3.2 mmφ sample: powder filled into test tube sample rotation rate: 10 kHz relaxation delay: 180 s scans: 2,000 After this measurement, the peaks of the multiple silane components having different substituents and linking groups in the organosilicon polymer particle are separated by curve fitting into the following X1 structure, X2 structure, X3 structure and X4 structure, and the respective peak areas are calculated.

The X3 structure below is the T3 unit structure in the present invention.

X1 structure: $(Ri)(Rj)(Rk)SiO_{1/2}$ (A1)

X2 structure: $(Rg)(Rh)Si(O_{1/2})_2$ (A2)

X3 structure: $RmSi(O_{1/2})_3$ (A3)

X4 structure: $Si(O_{1/2})_4$ (A4)

X1:

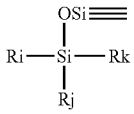

(A1)

X2:

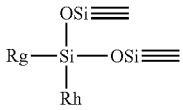

(A2)

X3:

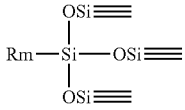

(A3)

X4:

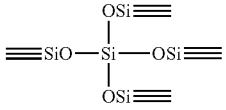

(A4)

The organic group represented by Re above is also confirmed by $^{13}$C-NMR.

$^{13}$C-NMR (solid) Measurement Conditions

Unit: JNM-ECX500II (JEOL RESONANCE)

Sample tube: 3.2 mm φ

Sample: Packed in sample tube in powder form

Sample temperature: Room temperature

Pulse mode: CP/MAS

Measurement nuclear frequency: 123.25 MHz ($^{13}$C)

Standard substance: Adamantane (external standard: 29.5 ppm)

Sample rotation: 20 kHz

Contact time: 2 ms

Delay time: 2 s

Number of integrations: 1024

In this method, the hydrocarbon group represented by $R^a$ above is confirmed based on the presence or absence of signals attributable to methyl groups (Si—$CH_3$), ethyl groups (Si—$C_2H_5$), propyl groups (Si—$C_3H_7$), butyl groups (Si—$C_4H_9$), pentyl groups (Si—$C_5H_{11}$), hexyl groups (Si—$C_6H_{13}$) or phenyl groups (Si—$C_6H_5$—) and the like bound to silicon atoms.

The organosilicon polymer particle contains an organosilicon polymer having a structure of alternately binding silicon atoms and oxygen atoms, and a part of silicon atoms in the organosilicon polymer preferably has a T3 unit structure represented by $R^aSiO_{3/2}$ (in which $R^a$ represents a $C_{1-6}$ (preferably $C_{1-3}$, more preferably $C_{1-2}$) alkyl group or phenyl group).

Furthermore, in $^{29}$Si-NMR measurement of the organosilicon polymer particle, the ratio S(T3) of the area of peaks derived from silicon having the T3 unit structure relative to the total area of peaks derived from all silicon element contained in the organosilicon polymer particle is preferably from 0.70 to 1.00, or more preferably from 0.90 to 1.00, or still more preferably from 0.95 to 1.00.

If S(T3) is within this range, the organosilicon polymer particle can have a suitable elasticity, as well as good affinity for an ester wax having a specific SPw, resulting in proper exudation of the ester wax and good fixing performance, so that the effects of the invention can be easily obtained.

The organosilicon polymer particle is preferably a polycondensate of an organosilicon compound having a structure represented by formula (2) below:

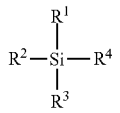

(2)

Where, each of $R^1$, $R^2$, $R^3$ and $R^4$ independently represents a $C_{1-6}$ (preferably $C_{1-3}$, or more preferably $C_{1-2}$) alkyl group or phenyl group, or a reactive group (such as a halogen atom, hydroxyl group, acetoxy group or alkoxy group.

An organosilicon compound having four reactive groups in each formula (2) molecule (tetrafunctional silane), an organosilicon compound having in formula (2) an alkyl group or phenyl group for $R^1$ and three reactive groups ($R^2$, $R^3$, $R^4$) (trifunctional silane), an organosilicon compound having in formula (2) an alkyl group or phenyl group for $R^1$ and $R^2$ and two reactive groups ($R^3$, $R^4$) (difunctional silane), and an organosilicon compound having in formula (2) an alkyl group or phenyl group for $R^1$, $R^2$, and $R^3$ and one reactive group ($R^4$) (monofunctional silane) can be used to obtain the organosilicon polymer particles. The use of at least 70 mol % trifunctional silane for the organosilicon compound is preferred in order to obtain S(T3) of 0.70 to 1.00.

In formula (2), $R^1$ is preferably a $C_{1-6}$ (preferably $C_{1-3}$, or more preferably $C_{1-2}$) alkyl group or phenyl group. Preferably each of $R^2$, $R^3$ and $R^4$ independently represents a halogen atom, hydroxyl group, acetoxy group or $C_{1-6}$ (preferably $C_{1-3}$, or more preferably $C_{1-2}$) alkoxy group.

These reactive groups can be subjected to hydrolysis, addition polymerization and condensation polymerization to form crosslinked structures and obtain the organosilicon polymer particle. Hydrolysis, addition polymerization and condensation polymerization of $R^2$, $R^3$ and $R^4$ can be controlled by controlling the reaction temperature, reaction time, reaction solvent and pH.

The tetrafunctional silane can be exemplified by tetramethoxysilane, tetraethoxysilane, and tetraisocyanatosilane.

The trifunctional silane can be exemplified by methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, methyldiethoxyhydroxysilane, ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, hexyltrihydroxysilane, phenyltrimethoxysilane, phenyltriethoxysilane, phenyltrichlorosilane, phenyltriacetoxysilane, and phenyltrihydroxysilane.

The difunctional silane can be exemplified by di-tert-butyldichlorosilane, di-tert-butyldimethoxysilane, di-tert-butyldiethoxysilane, dibutyldichlorosilane, dibutyldimethoxysilane, dibutyldiethoxysilane, dichlorodecylmethylsilane, dimethoxydecylmethylsilane, diethoxydecylmethylsilane, dichlorodimethylsilane, dimethyldimethoxysilane, diethoxydimethylsilane, and diethyldimethoxysilane.

The monofunctional silane can be exemplified by t-butyldimethylchlorosilane, t-butyldimethylmethoxysilane, t-butyldimethylethoxysilane, t-butyldiphenylchlorosilane, t-butyldiphenylmethoxysilane, t-butyldiphenylethoxysilane, chlorodimethylphenylsilane, methoxydimethylphenylsilane, ethoxydimethylphenylsilane, chlorotrimethylsilane, trimethylmethoxysilane, ethoxytrimethylsilane, triethylmethoxysilane, triethylethoxysilane, tripropylmethoxysilane, tributylmethoxysilane, tripentylmethoxysilane, triphenylchlorosilane, triphenylmethoxysilane, and triphenylethoxysilane.

Assaying Organosilicon Polymer Particle Contained in Toner

The content of the organosilicon polymer particle in the toner can be determined by the following methods.

When the toner contains silicon-containing material in addition to the organosilicon polymer fine particle, 1 g of the toner is dissolved and dispersed in 31 g of chloroform in a vial, and the silicon-containing material is dispersed away from the toner particle. Dispersion is performed for 30 minutes with an ultrasound homogenizer to prepare a liquid dispersion.

Ultrasonic processing unit: VP-050 ultrasound homogenizer (TIETECH Co., Ltd.).

Microchip: Step microchip, tip diameter φ 2 mm

Microchip tip position: Center of glass vial and 5 mm above bottom of vial

Ultrasound conditions: Intensity 30%, 30 minutes; ultrasound is applied while cooling the vial with ice water so that the temperature of the dispersion does not rise The dispersion is transferred to a glass tube of a swing rotor (50 mL), and centrifuged for 30 minutes at 58.33 $S^{-1}$ with a centrifuge (Kokusan Co. H-9R). After centrifugation, silicon-containing material other than the organosilicon polymer particle is contained in the lower layer in the glass tube. The chloroform solution of the upper layer is collected, and the chloroform is removed by vacuum drying (40° C./24 hr) to prepare a sample.

This process is repeated, and the product is dried to obtain 4 g of sample. This is pelletized, and the silicon content is determined by fluorescence X-ray.

Fluorescence X-ray measurement is performed in accordance with JIS K 0119-1969, specifically as follows.

An Axios wavelength disperser fluorescence X-ray spectrometer (PANalytical Co.) is used as the measurement unit with the accessory "SuperQ ver. 5.0 L" dedicated software (PANalytical Co.) for setting the measurement conditions and analyzing the measurement data. An Rh anode is used for the X-ray tube and vacuum as the measurement atmosphere, and the measurement diameter (collimator mask diameter) is 27 mm.

Measurement is performed by the Omnian method in the range of elements F to U, and detection is performed with a proportional counter (PC) for light elements and a scintillation counter (SC) for heavy elements. The acceleration voltage and current value of the X-ray generator are set so as to obtain an output of 2.4 kW. For the measurement sample, 4 g of sample is placed in a dedicated aluminum pressing ring and smoothed flat, and then pressed for 60 seconds at 20 MPa with a BRE-32 tablet molding machine (Maekawa Testing Machine Mfg.) to mold a pellet 2 mm thick and 39 mm in diameter.

Measurement is performed under the above conditions to identify each element based on its peak position in the resulting X-ray, and the mass ratio of each element is calculated from the count rate (unit: cps), which is the number of X-ray photons per unit time.

For the analysis, the mass ratios of all elements contained in the sample are calculated by the FP assay method, and the silicon content of the toner is determined. In the FP assay method, the balance is set according to the binder resin of the toner.

The content of the organosilicon polymer particle in the toner can be calculated from the silicon content of the toner as determined by fluorescence X-ray and the content ratio of silicon in the constituent compounds.

The shape factor SF-1 of the organosilicon polymer particle is preferably not more than 120, or more preferably not more than 115. There is no particular lower limit, but preferably it is at least 103, or more preferably at least 107. The SF-1 can be controlled by controlling the manufacturing conditions of the organosilicon polymer particle.

If the SF-1 is not more than 120, even if the organosilicon polymer particles attached to the toner particle are impacted by external force the force is applied uniformly, with a uniform distribution of contact surfaces on the toner particle surface. This means that the effects on durability and wax exudation are further improved. This is also desirable from the standpoint of charging performance.

Method for Measuring Shape Factor SF-1 of Organosilicon Polymer Particle

The shape factor SF-1 of the organosilicon polymer particle is measured by observing toner surface by using an "S-4800" scanning electron microscope (SEM; Hitachi, Ltd.). In a visual field enlarged by from 100,000× to 200,000×, the largest length and peripheral length of 100 particles of the primary particle are measured using "Image-Pro Plus 5.1J" (Media Cybernetics, Inc.) image processing software.

SF-1 is calculated using the following formula, and its average value of 100 particles is taken to be SF-1.

$$SF\text{-}1=(\text{largest length of the primary particle})^2/\text{area of the primary particle}\times\pi/4\times100$$

When the silsesquioxane particles prior to external addition can be acquired as such, the SF-1 may also be measured using on these silsesquioxane particles as such.

The coverage ratio of the surface of the toner particle surface by the organosilicon polymer particle is preferably from 30 area % to 70 area %, or more preferably from 35 area % to 65 area %. If the coverage ratio is within this range, it is easier to achieve both fixing performance and durability because the wax is exuded appropriately onto the toner particle surface. The coverage ratio can be controlled by controlling the number of parts and the particle diameter of the organosilicon polymer particle, and the external addition conditions.

Method for Measuring Coverage Ratio

The coverage ratio is determined by using Image-Pro Plus ver. 5.0 (Nippon Roper) to analyze toner surface images taken with a taken with a Hitachi S-4800 ultra-high resolution field emission scanning electron microscope (Hitachi High Technologies). The S-4800 imaging conditions are as follows.

(1) Specimen Preparation

An electroconductive paste is spread in a thin layer on the specimen stub (15 mm×6 mm aluminum specimen stub) and the toner is sprayed onto this. Blowing with air is additionally performed to remove excess toner from the specimen stub and carry out thorough drying. The specimen stub is set in the specimen holder and the specimen stub height is adjusted to 36 mm with the specimen height gauge.

(2) Setting S-4800 Observation Conditions

The coverage ratio is calculated using images obtained by backscattered electron observation with the S-4800. When measuring the coverage ratio, elemental analysis is performed in advance with an energy dispersive x-ray analyzer (EDAX), and measurement is performed after excluding particles other than the organosilicon polymer particles on the toner surface. The organosilicon polymer particle and silica can be distinguished by a combination of shape observation by SEM and elemental analysis by EDS as discussed above.

Liquid nitrogen is introduced to the brim of the anti-contamination trap attached to the S-4800 case body and standing for 30 minutes is carried out. The "PC-SEM" of the S-4800 is started and flashing is performed (the FE tip, which is the electron source, is cleaned). The acceleration voltage display area in the control panel on the screen is clicked and the [Flashing] button is pressed to open the flashing execution dialog. A flashing intensity of 2 is confirmed and execution is carried out. The emission current due to flashing is confirmed to be 20 μA to 40 μA. The specimen holder is inserted in the specimen chamber of the S-4800 case body. [Home] is pressed on the control panel to transfer the specimen holder to the observation position.

The acceleration voltage display area is clicked to open the HV setting dialog and the acceleration voltage is set to [1.1 kV] and the emission current is set to [20 μA]. In the [Base] tab of the operation panel, signal selection is set to [SE], [Upper (U)] and [+BSE] are selected for the SE detector, and the instrument is placed in backscattered electron image observation mode by selecting [L. A. 100] in the selection box to the right of [+BSE]. Similarly, in the [Base] tab of the operation panel, the probe current of the electron optical system condition block is set to [Normal]; the focus mode is set to [UHR]; and WD is set to [4.5 mm]. The [ON] button in the acceleration voltage display area of the control panel is pressed to apply the acceleration voltage.

(3) Focus Adjustment

Adjustment of the aperture alignment is carried out when some degree of focus has been obtained in the visual field as a whole by turning the [COARSE] focus knob on the operation panel. [Align] in the control panel is clicked and the alignment dialog is displayed and [Beam] is selected. The displayed beam is migrated to the center of the concentric circles by turning the STIGMA/ALIGNMENT knobs (X, Y) on the operation panel. [Aperture] is then selected and the STIGMA/ALIGNMENT knobs (X, Y) are turned one at a time and adjustment is performed so as to stop the motion of the image or minimize the motion. The aperture dialog is closed and focus is performed with the autofocus. The magnification is then set to 50,000× (50 k) and the focus adjustment in the same manner as above using focus knob and STIGMA/ALIGNMENT knobs, thereby performing focus again with the autofocus. This operation is repeated an additional one time to achieve focus.

Then, with the center point of the largest diameter for the target toner brought to the center of the measurement screen, the magnification is set to 10,000× (10 k) by dragging within the magnification indicator area of the control panel. Adjustment of the aperture alignment is carried out when some degree of focus has been obtained by turning the [COARSE] focus knob on the operation panel. [Align] in the control panel is clicked and the alignment dialog is displayed and [Beam] is selected. The displayed beam is migrated to the center of the concentric circles by turning the STIGMA/ALIGNMENT knobs (X, Y) on the operation panel. Here, the accuracy of measurement of the coverage ratio readily declines when the plane of observation has a large angle of inclination, and for this reason simultaneous focus of the plane of observation as a whole is selected during focus adjustment and the analysis is carried out with selection of the smallest possible surface inclination.

(4) Image Storage

Brightness adjustment is performed using the ABC mode, and a photograph with a size of 640×480 pixels is taken and saved. Analysis is carried out as follows using this image file. One photograph is taken per one toner, and images are obtained for 25 or more particles of toner.

(5) Image Analysis

Images obtained by the methods described above are binarized with the following analysis software to calculate the coverage ratio in the present invention. Each screen is divided into 12 square, and each is analyzed separately. The analysis conditions for the Image-Pro Plus ver. 5.0 image analysis software are as follows.

"Measurement", "Count/size" and "Option" are selected in that order on the tool bar of the Image-ProPlus 5.1J software to set the binarization conditions. "8 connections" is selected from the object extraction options, and smoothing is set to 0. "Pre-selection", "hole filling" and "envelope" are not selected, and "exclude borders" is set to "no". "Measurement item" is selected under "measurement" in the tool bar, and 2 to 10' is entered as the area selection range.

To calculate the coverage ratio, a square region is delineated. The region area (C) is set to 24,000 to 26,000 pixels. Binarization is performed automatically with "Processing"-binarization, and the sum (D) of the areas of regions without organosilicon polymer particles is calculated.

The coverage ratio is calculated by the following formula from the area C of the square region and the sum D of the areas of regions without organosilicon polymer particles.

$$\text{Coverage ratio (\%)}=100-(D/C\times 100)$$

The calculated average of all data is given as the coverage ratio in the present invention.

The coverage ratio by an inorganic fine particle other than the organosilicon polymer particle can be measured in the same way after distinguishing the organosilicon polymer particle from the inorganic fine particle.

The ratio (Dsi/Dt) of the number-average particle diameter Dsi of the organosilicon polymer particle to the number-average particle diameter Dt of the toner is preferably from 0.0125 to 0.0750, or more preferably from 0.0150 to 0.0650.

If Dsi/Dt is within this range, the wax can be exuded appropriately during long-term use because the organosilicon polymer particle is unlikely to detach from the toner particle surface, and is also unlikely to become embedded.

The toner also preferably has an inorganic fine particle as an external additive. The inorganic fine particle is not particularly limited, and a known particle such as silica, titania or alumina may be used.

The coverage ratio of the surface of the toner particle by this inorganic fine particle is preferably at least 30 area %, or more preferably at least 35 area %. There is no particular upper limit, but preferably it is not more than 70 area %, or more preferably not more than 65 area %. The coverage ratio can be controlled by controlling the number of parts and particle diameter of the inorganic fine particle, and the external addition conditions.

With this coverage ratio, the resistance of the toner particle surface, the toner flowability and the like are appropriate, and charging performance is good.

The wax is not particularly limited as long as the SP value (SPw) is within the above specified range, and a known ester wax may be used. Examples include natural waxes such as carnauba wax and their derivatives, and ester waxes and their derivatives such as graft compounds and block compounds. These may be used individually or combined.

At least one ester wax preferably has a melting point (temperature corresponding to maximum endothermic peak in a DSC endothermic curve in the temperature range of 20° C. to 200° C.) of from 63° C. to 95° C., or more preferably from 65° C. to 90° C. Preferably it is also solid at room temperature, and a solid wax with a melting point of from 65° C. to 90° C. is particularly desirable from the standpoint of the blocking resistance of the toner, the multi-sheet durability, and low-temperature fixability and offset resistance.

The ester wax can be exemplified by waxes in which the main component is a fatty acid ester, e.g., carnauba wax and montanic acid ester wax; ester waxes provided by the partial or complete deacidification of the acid component from a fatty acid ester, e.g., deacidified carnauba wax; hydroxyl group-bearing methyl ester compounds as obtained, for example, by the hydrogenation of plant oils and fats; saturated fatty acid monoesters, e.g., stearyl stearate and behenyl behenate; diesters between a saturated aliphatic dicarboxylic acid and a saturated aliphatic alcohol, e.g., dibehenyl sebacate, distearyl dodecanedioate, and distearyl octadecanedioate; and diesters between a saturated aliphatic diol and a saturated aliphatic monocarboxylic acid, e.g., nonanediol dibehenate and dodecanediol distearate. Among them, aliphatic ester waxes are preferable.

A monoester compound having one ester bond in the molecule or a polyfunctional ester compound such as a diester compound having two ester bonds in the molecule, a tetrafunctional ester compound having four ester bonds in the molecule, or a hexafunctional ester compound having six ester bonds in the molecule may be used as the ester wax.

Among these waxes, a content of a difunctional ester wax (diester), which has two ester bonds in the molecular structure, is preferred.

A difunctional ester wax is an ester compound between a dihydric alcohol and an aliphatic monocarboxylic acid or an ester compound between a dibasic carboxylic acid and an aliphatic monoalcohol.

The aliphatic monocarboxylic acid can be exemplified by myristic acid, palmitic acid, stearic acid, arachidic acid, behenic acid, lignoceric acid, cerotic acid, montanic acid, melissic acid, oleic acid, vaccenic acid, linoleic acid, and linolenic acid.

The aliphatic monoalcohol can be specifically exemplified by myristyl alcohol, cetanol, stearyl alcohol, arachidyl alcohol, behenyl alcohol, tetracosanol, hexacosanol, octacosanol, and triacontanol.

The dibasic carboxylic acid can be specifically exemplified by butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecanedioic acid, tetradecanedioic acid, hexadecanedioic acid, octadecanedioic acid, eicosanedioic acid, phthalic acid, isophthalic acid, and terephthalic acid.

The dihydric alcohol can be specifically exemplified by ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexanedimethanol, spiroglycol, 1,4-phenylene glycol, bisphenol A, and hydrogenated bisphenol A.

The content of the ester wax in the toner is preferably from 3 mass parts to 30 mass parts per 100 mass parts of the binder resin. If the added amount of the ester wax is at or above the lower limit, offset is easily prevented. If it is not more than the upper limit, a good blocking resistance effect is obtained, offset resistance is good, and it is also possible to suppress melt adhesion of the toner to the drum and melt adhesion of the toner to the developing sleeve.

When the wax needs to be extracted from the toner in order to measure these physical properties, the extraction method is not particularly limited, and any method may be used. For example, a predetermined amount of the toner can be subjected to Soxhlet extraction with toluene, and the solvent can be removed from the toluene-soluble component, after which a chloroform-soluble component is obtained. Identification analysis is then performed by the IR method or the like.

For the assay, quantitative analysis is performed with a differential scanning calorimeter (DSC) or the like. In the present invention, measurement is performed using a TA Instruments Japan DSC-2920. The glass transition temperature Tg is the point of intersection between the differential thermal curve and a line drawn between the midpoints of the baselines before and after the appearance of a specific heat change during measurement. A maximum endothermic peak temperature of the wax component is obtained from the obtained DSC curve during temperature rise.

The method for preparing the organosilicon polymer particle is not particularly limited, and for example it can be obtained by dripping a trifunctional silane compound into water, hydrolyzing it with a catalyst and then performing a condensation reaction, after which the resulting suspension is filtered and dried. The particle diameter can be controlled by controlling the type and compounded ratio of the catalyst, and the reaction initiation temperature, dripping time and the like.

The catalyst may be an acidic catalyst such as hydrochloric acid, hydrofluoric acid, sulfuric acid or nitric acid or a basic catalyst such as ammonia water, sodium hydroxide or potassium hydroxide, but these examples are not limiting.

To stably obtain a small-diameter particle such as an organosilicon polymer particle, the organosilicon polymer particle is preferably manufactured by the following method.

Specifically, the manufacturing method preferably includes a (i) first step of obtaining a hydrolysate of an organotrialkoxysilane (organosilicon compound), and (ii) a second step of mixing the hydrolysate with an alkaline aqueous medium and subjecting it to a polycondensation reaction to obtain a spherical organosilicon polymer particle dispersion comprising dispersed spherical organosilicon polymer particles.

In some cases, a hydrophobic agent may also be compounded with the spherical organosilicon polymer particle dispersion to obtain a hydrophobic spherical organosilicon polymer particle.

In the first step, an organotrialkoxysilane (organosilicon compound) and a catalyst are brought into contact by a method such as stirring or mixing in an aqueous solution of an acidic or alkaline substance dissolved in water as a catalyst.

A known catalyst may be used favorably as the catalyst. Specific examples of acidic catalysts include hydrochloric acid, hydrofluoric acid, sulfuric acid and nitric acid, while specific examples of basic catalysts include ammonia water, sodium hydroxide and potassium hydroxide.

The amount of the catalyst used may be adjusted appropriately according to the types of organotrialkoxysilane (organosilicon compound) and catalyst, and is selected from the range of from $1\times10^{-3}$ mass parts to 1 mass part per 100 mass parts of water used when hydrolyzing the organotrialkoxysilane (organosilicon compound).

If the amount of the catalyst is at least $1\times10^{-3}$ mass parts, the reaction progresses satisfactorily. If it is not more than 1 mass part, on the other hand, the concentration of residual impurities in the fine particle is reduced, and a hydrolysate is more easily obtained. The amount of water used is preferably 2 moles to 15 moles per 1 mole of the organotrialkoxysilane (organosilicon compound). If the amount of water is at least 2 moles, the hydrolysis reaction progresses satisfactorily, while productivity is better if the amount is not more than 15 moles.

There are no particular limitations on the temperature of the reaction, which may be performed at normal temperature or with heating, but preferably the reaction is performed with the temperature maintained at 10° C. to 60° C. so as to yield a hydrolysate in a short amount of time where suppressing partial condensation reactions of the resulting hydrolysate. The reaction time is not particularly limited, and may be selected appropriately after considering the reactivity of the organotrialkoxysilane (organosilicon compound), the composition of the reaction solution prepared from the organotrialkoxysilane (organosilicon compound), acid and water, and the productivity.

In the second step of the organosilicon polymer particle manufacturing method, the raw material solution obtained in the first step is mixed with an alkaline aqueous medium, and the particle precursor is polycondensed to obtain a polycondensation reaction solution. The alkaline aqueous solution here is a solution obtained by mixing an alkaline component with water and an organic solvent or the like as necessary.

The alkaline component used in the alkaline aqueous solution is one that exhibits basic properties in an aqueous solution, and acts as a catalyst in the polycondensation reaction of the second step by neutralizing the catalyst used in the first step. Examples of this alkaline component include alkali metal hydroxides such as lithium hydroxide, sodium hydroxide and potassium hydroxide; ammonia; and organic amines such as monomethylamine and dimethylamine.

The amount of the alkaline component used is an amount that acts effectively as a catalyst to neutralize the acid in the polycondensation reaction, and when ammonia is used as the alkaline component for example the amount is normally selected in the range of from 0.01 mass % to 12.5 mass % per 100 mass parts of a mixture of the water and organic solvent.

In the second step, an organic solvent may also be used in addition to the alkaline component and water to prepare an alkaline aqueous medium. The organic solvent is not particularly limited as long as it is compatible with water, but an organic solvent that dissolves at least 10 g of water per 100 g at normal temperature and normal pressure is preferred.

Specific examples include alcohols such as methanol, ethanol, n-propanol, 2-propanol and butanol; polyhydric alcohols such as ethylene glycol, diethylene glycol, propylene glycol, glycerin, trimethylol propane and hexanetriol; ethers such as ethylene glycol monoethyl ether, acetone, diethyl ether, tetrahydrofuran and diacetone alcohol; and amide compounds such as dimethyl formamide, dimethyl acetamide, N-methylpyrrolidone and the like.

Of the organic solvents listed above, an alcohol solvent such as methanol, ethanol, 2-propanol or butanol is preferred. From the standpoint of the hydrolysis and dehydration condensation reactions, an alcohol identical to the desorbed alcohol is preferably selected as the organic solvent.

A known method may be used as the method for collecting the organosilicon polymer particle from the resulting polycondensation reaction solution, without any particular limitations. The floating powder may be skimmed off for the example, or a filtration method may be adopted, but a filtration method is preferred because the operation is simple.

The method of filtration is not particularly limited, but may be vacuum filtration, centrifugal filtration, pressure filtration or the like using a known apparatus. The filter paper, filter cloth or the like used in filtration is not particularly limited as long as it is industrially available, and may be selected according to the apparatus.

The collected powder of the organosilicon polymer particle may be used as is, but is preferably dried to obtain a particle with few impurities. The method of drying the powder is not particularly limited, and a known method such as air drying or vacuum drying may be selected. Vacuum drying is particularly desirable because it yields a dried powder that is easily broken up.

The drying temperature is not particularly limited as long as it is a temperature that does not decompose the functional groups such as alkyl groups contained in the hydrophobic spherical organosilicon polymer particle, and a suitable temperature may be set appropriately in the range of preferably 65° C. to 350° C., or more preferably 80° C. to 250° C. The drying time is also not particularly limited, and a thoroughly dried organosilicon polymer particle can be obtained with a drying time of 2 hours to 48 hours.

The hydrophobicity of the organosilicon polymer particle may also be adjusted by surface treating it by a known method with a silane coupling agent, silicone oil or the like.

In the present invention, the hydrophobicity of the organosilicon polymer particle is preferably 45% to 80% or more preferably 55% to 80% from the standpoint of obtaining a stable triboelectric charge quantity.

Method for Calculating Hydrophobicity of Organosilicon Polymer Particle and Inorganic Fine Particle The degree of hydrophobicity is specified by a "methanol titration test".

Specifically, 0.2 g of a sample particle is added to 50 mL of water in a 250 mL triangular flask. Methanol is titrated from a burette until all of the inorganic fine particles are wetted. The solution in the flask is stirred constantly with a magnetic stirrer during this process. The endpoint is observed when all of the sample particles are suspended in the liquid, and the degree of hydrophobicity is represented as the percentage of methanol in the liquid mixture of methanol and water when the endpoint is reached.

Binder Resin

The binder resin used in the toner is not particularly limited, and the following polymers or resins may be used.

Examples include monopolymers of styrene and substituted styrene, such as polystyrene, poly-p-chlorostyrene and polyvinyl toluene; styrene copolymers such as styrene-p-chlorostyrene copolymer, styrene-vinyl toluene copolymer, styrene-vinyl naphthalene copolymer, styrene-acrylic acid copolymer, styrene-methacrylic acid copolymer, styrene-acrylic acid ester copolymer, styrene-methacrylic acid ester copolymer, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenol resin, natural resin-modified phenol resin, natural resin-modified maleic acid resin, acrylic resin, methacrylic resin, polyvinyl acetate, silicone resin, polyester resin, polyurethane resin, polyamide resin, furan resin, epoxy resin xylene resin, polyvinyl butyral, terpene resin, coumarone-indene resin, petroleum resin and the like.

Of these, a resin having ester bonds is preferred. A vinyl resin such as a styrene-acrylic acid copolymer, styrene-methacrylic acid copolymer, styrene-acrylic acid ester copolymer or styrene-methacrylic acid ester copolymer or a polyester resin is especially desirable.

Polymerizable Monomers

Examples of polymerizable monomers used in preparing the vinyl resin include vinyl polymerizable monomers capable of radical polymerization. A monofunctional polymerizable monomer or polyfunctional polymerizable monomer may be used as a vinyl polymerizable monomer.

Examples of monofunctional polymerizable monomers include styrene; styrene derivatives such as α-methylstyrene, β-methylstyrene, o-methylstyrene, m-methylstyrene, p-methylstyrehne, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxyethyl acrylate; methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylic acid esters; vinyl esters such as vinyl acetate, vinyl propionate, vinyl butyrate, vinyl benzoate and vinyl formate; vinyl ethers such as vinyl methyl ether, vinyl ethyl ether and vinyl isobutyl ether; and vinyl ketones such as vinyl methyl ketone, vinyl hexyl ketone and vinyl isopropyl ketone.

Examples of polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxy-diethoxy)phenyl)propane, trimethylol propane triacrylate, tetramethylol methane tetraacrylate, ethylene glycol dimethacrylate, diethylene glycol dimethacrylate, triethylene glycol dimethacrylate, tetraethylene glycol dimethacrylate, polyethylene glycol dimethacryalte, 1,3-butylene glycol dimethacrylate, 1,6-hexanediol dimethacrylate, neopentyl glycol dimethacrylate, polypropylene glycol dimethacrylate, 2,2'-bis(4-(methacryloxy-diethoxy)phenyl)propane, 2,2'-bis(4-methacryloxy-polyethoxy)phenyl)propane, trimethylol propane trimethacrylate, tetramethylol methane tetramethacrylate, divinyl benzene, divinyl naphthalene, divinyl ether and the like.

The above monofunctional polymerizable monomers may be used individually, or two or more may be combined, or the above monofunctional polymerizable monomers and polyfunctional polymerizable monomers may be combined.

A styrene derivative, an acrylic acid ester polymerizable monomer such as n-butyl acrylate or 2-ethylhexyl acrylate, or a methacrylic acid ester polymerizable monomer such as n-butyl methacrylate or 2-ethylhexyl methacrylate is preferred as a polymerizable monomer other than styrene. These are excellent from the standpoint of the strength and flexibility of the binder resin obtained by polymerizing the polymerizable monomers.

When the polyester resin is an amorphous polyester resin, its weight-average molecular weight (Mw) is preferably 6,000 to 100,000, or more preferably 6,500 to 85,000, or still more preferably 6,500 to 45,000.

If the weight-average molecular weight of the amorphous polyester resin is at least 6,000, the external additive on the toner surface is unlikely to become embedded over time during continuous image output, and a loss of transferability is suppressed. If the weight-average molecular weight is not more than 100,000, less time is required to dissolve the amorphous polyester resin in the polymerizable monomers, and because a rise in the viscosity of the polymerizable monomer composition is also suppressed, it is easy to obtain a toner with a small particle diameter and a uniform particle size distribution.

The amorphous polyester resin can be manufactured for example by a method using a dehydration condensation reaction of a carboxylic acid component and an alcohol component, or by an ester exchange reaction. The catalyst may be an ordinary acidic or alkaline catalyst used in ester-exchange reactions, such as zinc acetate or a titanium compound. A high-purity product can then be obtained by a re-crystallization method, distillation method or the like.

From the standpoint of diversity of raw materials and ease of the reaction, a dehydration condensation reaction of a carboxylic acid component and an alcohol component is especially desirable.

The composition of the polyester resin when using polyester as a condensed resin is explained below.

The amorphous polyester resin preferably comprises an alcohol component in the amount of 43 mol % to 57 mol % and an acid component in the amount of 57 mol % to 43 mol % of the total components.

A known alcohol component may be used for manufacturing the polyester resin. Examples of alcohol components include ethylene glycol, neopentyl glycol, 2-ethyl-1,3-hexanediol, hydrogenated bisphenol A, a bisphenol derivative represented by formula (I) below, or a diol such as a diol represented by formula (II) below.

(I)

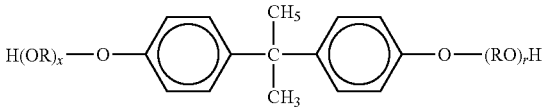

Where, R represents an ethylene or propylene group, x and y are both 1 or integers greater than 1, and the average value of x+y is from 2 to 10.

(II)

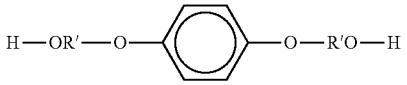

Where, R' represents:

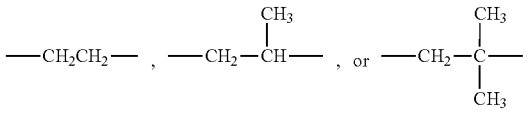

Examples of divalent carboxylic acids include benzenedicarboxylic acids such as phthalic acid, terephthalic acid, isophthalic acid, phthalic anhydride, diphenyl-P.P'-dicarboxylic acid, naphthalene-2,7-dicarboxylic acid, naphthalene-2, 6-dicarboxylic acid, diphenylmethane-P.P'-dicarboxylic acid, benzophenone-4,4'-dicarboxylic acid and 1,2-diphenoxyethane-P.P'-dicarboxylic acid, or their anhydrides; alkyldicarboxylic acids such as succinic acid, adipic acid, sebacic acid, azelaic acid, glutaric acid, cyclohexanedicarboxylic acid, triethylenedicarboxylic acid, malonic acid, and succinic acid substituted with $C_{6-18}$ alkyl or alkenyl groups, or their anhydrides; and unsaturated dicarboxylic acids such as fumaric acid, maleic acid, citraconic acid and itaconic acid, or their anhydrides.

Ethylene glycol and bisphenol derivatives represented by formula (I) above are especially desirable as alcohol components, while desirable acid components include terephthalic acid or its anhydride, succinic acid and n-dodecenylsuccinic acid, or their anhydrides, and dicarboxylic acids such as fumaric acid, maleic acid and maleic anhydride. Terephthalic acid is especially desirable.

The polyester resin can be obtained by synthesis from a divalent dicarboxylic acid and a dihydric diol, but in some cases a small amount of a trivalent or higher polycarboxylic acid or polyol may be used as long as the present invention is not adversely affected.

Examples of trivalent or higher polycarboxylic acids include trimellitic acid, pyromellitic acid, cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methylenecarboxylpropane, 1,3-dicarboxyl-2-methyl-methylenecarboxylpropane, tetra(methylenecarboxyl)methane, 1,2,7,8-octanetetracarboxylic acid and anhydrides of these.

Examples of trivalent or higher polyols include sorbitol, 1,2,3,6-hexanetetrol, 1,4-sorbitan, pentaerythritol, dipentaerythritol, tripentaerythritol, sucrose, 1,2,4-methanetriol, glycerin, 2-methylpropane triol, 2-methyl-1,2,4-butanetriol, trimethylol ethane, trimethylol propane and 1,3,5-trihydroxymethyl benzene.

The amount of the trivalent or higher polycarboxylic acid is preferably not more than 10.00 mol % of the total acid monomers. Similarly, the amount of the trivalent or higher polyol is preferably not more than 10.00 mol % of the total alcohol monomers.

An amount within this range is desirable from the standpoint of pigment dispersibility because there is less insoluble matter due to crosslinking. Even if the manufacturing method is designed to not produce insoluble matter, this amount is still desirable from the standpoint of durability because the ratio of branched polyester resin is reduced, resulting in excellent strength.

The amorphous polyester resin is preferably an aromatic saturated polyester. This gives the toner excellent charging performance, durability and fixing performance, and makes it easier to control the physical properties of the toner and the polyester. Charging performance is particularly good due to interactions between the aromatic pi electrons.

The crystalline polyester resin can be obtained by reacting a divalent or higher polyvalent carboxylic acid with a diol. A polyester having an aliphatic diol and an aliphatic dicarboxylic acid as principal components is particularly desirable because it has high crystallinity. One kind of crystalline polyester or a combination of multiple kinds may be used. An amorphous polyester may also be included in the toner in addition to the crystalline polyester.

A crystalline polyester is a polyester having an endothermic peak during temperature rise and an exothermic peak during temperature decrease in differential scanning calorimetry (DSC), as measured in accordance with "ASTM D 3417-99".

Examples of alcohol monomers for obtaining such a crystalline polyester include ethylene glycol, diethylene glycol, triethylene glycol, 1,2-propylene glycol, 1,3-propylene glycol, dipropylene glycol, trimethylene glycol, tetramethylene glycol, pentamethylene glycol, hexamethylene glycol, octamethylene glycol, nonamethylene glycol, decamethylene glycol, neopentyl glycol, 1,4-butadiene glycol and the like.

Although alcohol monomers such as the above are used as principal components in the present invention, dihydric alcohols such as polyoxyethylenated bisphenol A, polyoxypropylenated bisphenol A and 1,4-cyclohexane dimethanol, aromatic alcohols such as 1,3,5-trihydroxymethyl benzene, and trihydric alcohols such as pentaerythritol, dipentaerythritol, tripentaerythritol, 1,2,4-butanetriol, 1,2,5-pentanetriol, glycerin, 2-methylpropane triol, 2-methyl-1,2,4-butanetriol, trimethylol ethane and trimethylol propane may also be used in addition to the above components.

Examples of carboxylic acid monomers for obtaining the crystalline polyester include oxalic acid, malonic acid, succinic acid, glutaric acid, adipic acid, pimelic acid, suberic acid, glutaconic acid azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, itaconic acid, isophthalic acid, terephthalic acid, n-dodecylsuccinic acid, n-dodecenylsuccinic acid, cyclohexanedicarboxylic acid and anhydrides or lower alkyl esters of these acids and the like.

Moreover, although carboxylic acid monomers such as the above are used as principal components in the present invention, a trivalent or higher polyvalent carboxylic acid may also be used in addition to the above components.

Examples of trivalent and higher polyvalent carboxylic acid components include trimellitic acid, 2,5,7-naphthalenetricarboxylic acid, 1,2,4-naphthalenetricarboxylic acid, pyromellitic acid, 1,2,4-butanetricarboxylic acid, 1,2,5-hexanbetricarboxylic acid, 1,3-dicarboxyl-2-methyl-2-methylenecarboxypropane, and derivatives of these such as acid anhydrides and lower alkyl esters and the like.

Examples of especially desirable crystalline polyesters include a polyester obtained by reacting 1,4-cyclohexanedimethanol with adipic acid, a polyester obtained by reacting tetramethylene glycol and ethylene glycol with adipic acid, a polyester obtained by reacting hexamethylene glycol with sebacic acid, a polyester obtained by reacting ethylene glycol with succinic acid, a polyester obtained by reacting ethylene glycol with sebacic acid, a polyester obtained by reacting tetramethylene glycol with succinic acid, and a polyester obtained by reacting diethylene glycol with decanedicarboxylic acid.

A saturated polyester is more preferred as the crystalline polyester. Compared with a crystalline polyester having unsaturated parts, this is advantageous from the standpoint of the solubility of the crystalline polyester because no crosslinking reactions occur in reactions with peroxide polymerization initiators.

The crystalline polyester resin can be manufactured by an ordinary polyester synthesis method. For example, following an esterification reaction or ester exchange reaction of a dicarboxylic acid component and a dialcohol component, a polycondensation reaction can performed by ordinary methods in vacuum or with introduced nitrogen gas to obtain the crystalline polyester resin.

The melting point (DSC endothermic peak) of the crystalline polyester resin is preferably from 50.0° C. to 90.0° C. If the melting point (DSC endothermic peak) of the crystalline polyester resin is from 50.0° C. to 90.0° C., the toner particle is less likely to aggregate, the storability and fixing performance of the toner particle can be maintained, and solubility with the polymerizable monomers is higher when manufacturing the toner particle by a polymerization method.

The melting point (DSC endothermic peak) of the crystalline polyester resin can be measured by differential scanning calorimetry (DSC). The melting point of the crystalline polyester resin can be adjusted by adjusting the types of the alcohol monomer and carboxylic acid monomer, the degree of polymerization and the like.

The weight-average molecular weight (Mw) of the crystalline polyester is preferably from 5,000 to 35,000. This is desirable because within this range the crystalline polyester is more dispersible in the resulting toner particle, and durability stability is greater.

If the weight-average molecular weight (Mw) of the crystalline polyester is at least 5,000, the density of the crystalline polyester is higher, and durability stability is greater. If the weight-average molecular weight (Mw) of the crystalline polyester is not more than 35,000, on the other hand, the crystalline polyester dissolves more rapidly, producing a uniform dispersed state that improves developing stability. The weight-average molecular weight (Mw) of the crystalline polyester can be adjusted by adjusting the types of the alcohol monomer and carboxylic acid monomer used and the polymerization time, polymerization temperature and the like.

The acid value (AV) of the crystalline polyester is preferably from 0.0 mgKOH/g to 20.0 mgKOH/g, or more preferably from 0.0 mgKOH/g to 10.0 mgKOH/g, or still more preferably from 0.0 mgKOH/g to 5.0 mgKOH/g. The adhesiveness between the toner and the paper during image formation is improved by reducing the acid value.

When the toner particle is manufactured by a polymerization method, the toner particles are less likely to aggregate together if the acid value (AV) of the crystalline polyester is not more than 20.0 mgKOH/g, and charging stability and durable stability are also improved because the crystalline polyester is less likely to acquire an uneven distribution in the toner.

Molecular Weights and Molecular Weight Distributions of Crystalline Polyester Resin, Amorphous Polyester Resin and Styrene-Acrylic Resin The molecular weights and molecular weight distributions of the samples are calculated by gel permeation chromatography (GPC) based on polystyrene conversion. When measuring the molecular weight of a resin having acid groups, a sample in which the acid groups are capped must be prepared in advance because the column elution speed depends on the amount of acid groups. Capping is preferably by methyl esterification, and a commercial methyl esterifying agent may be used. A specific example is a method of treatment with trimethylsilyl diazomethane.

Molecular weight measurement by GPC is performed as follows. The measurement sample is first dissolved in tetrahydrofuran (THF) at room temperature over the course of 24 hours. The resulting solution is then filtered with a Maishori Disk (Tosoh Corporation) solvent-resistant membrane filter with a pore diameter of 0.2 μm to obtain a sample solution. The concentration of THF-soluble components in the sample solution is adjusted to 0.8 mass %.

Measurement is performed under the following conditions using this sample solution.

System: HLC8120 GPC (detector: RI) (Tosoh Corporation)
Columns: Shodex KF-801, 802, 803, 804, 805, 806, 807 (total 7) (Showa Denko K.K.)
Eluent: Tetrahydrofuran (THF)
Flow rate: 1.0 mL/min
Oven temperature: 40.0° C.
Sample injection volume: 0.10 mL A molecular weight calibration curve prepared using standard polystyrene resin (product name: TSK standard polystyrene F-850, F-450, F-288, F-128, F-80, F-40, F-20, F-10, F-4, F-2, F-1, A-5000, A-2500, A-1000, A-500, Tosoh Corporation) is used for calculating the molecular weights of the measurement samples.

Glass Transition Temperatures of Amorphous Polyester Resin, Styrene-Acrylic Resin and Toner Particle The glass transition temperatures of the samples are measured with a differential scanning calorimeter (DSC measurement apparatus).

Using a Q1000 differential scanning calorimeter (TA Instruments), measurement is performed as follows in accordance with ASTM D3418-82. 2 mg to 5 mg, or preferably 3 mg of the measurement sample is weighed exactly. This is placed in an aluminum plan, and an empty aluminum pan is used for reference. Equilibrium is maintained for 5 minutes at 20° C., and measurement is performed at a ramp rate of 10° C./min within a measurement range of 20° C. to 180° C. In the present invention, the glass transition temperature may be determined by the midpoint method.

Structural Analysis of Polyester Resin, Crystalline Polyester Resin, Styrene-Acrylic Resin and Toner Binder Resin The structures of the polyester resin, crystalline polyester resin, charge control resin, styrene-acrylic resin and toner binder resin can be determined using a nuclear magnetic resonance apparatus ($^{1}$H-NMR, $^{13}$C-NMR) together with an FT-IR spectrometer. The equipment is described below.

Each resin sample may also be collected by fractionation from the toner, and analyzed.

(i) $^{1}$H-NMR, $^{13}$C-NMR
FT-NMR JNM-EX400 manufactured by JEOL (solvent: deuterated chloroform)
(ii) FT-IR Spectrometer
AVATAR 360 FT-IR manufactured by Thermo-Fisher Scientific Inc.

Measuring Acid Values of Crystalline Polyester Resin, Amorphous Polyester Resin and Styrene-Acrylic Resin The acid value is the number of mg of potassium hydroxide needed to neutralize the acid contained in 1 g of sample. The acid value in the present invention is measured in accordance with JIS K 0070-1992, and the specific measurement procedures are as follows.

Titration is performed with a 0.1 mol/L potassium hydroxide ethyl alcohol solution (Kishida Chemical Co.). The factor of the potassium hydroxide ethyl alcohol solution can be determined with a potentiometric titrator (AT-510 automatic potentiometric titrator, Kyoto Electronics Manufacturing Co., Ltd.). 100 mL of 0.100 mol/L hydrochloric acid is taken in a 250 mL tall beaker and titrated with the potassium hydroxide ethyl alcohol solution to determine the amount of the potassium hydroxide ethyl alcohol solution required for neutralization. The 0.100 mol/L hydrochloric acid has been prepared in accordance with JIS K 8001-1998.

The measurement conditions for acid value measurement are shown below.

Titration unit: AT-510 potentiometric titrator (Kyoto Electronics Manufacturing Co., Ltd.)
Electrode: Double-junction type composite glass electrode (Kyoto Electronics Manufacturing Co., Ltd.)
Titration unit control software: AT-WIN
Titration analysis software: Tview The titration parameters and control parameters during titration are set as follows.

Titration Parameters

Titration mode: Blank titration

Titration format: Total titration

Maximum titration amount: 20 mL

Waiting time before titration: 30 seconds

Titration direction: Automatic

Control Parameters

End point judgment potential: 30 dE

End point judgment potential value: 50 dE/dmL

End point detection judgment: Not set

Control speed mode: Standard

Gain: 1

Data collection potential: 4 mV

Data collection titration amount: 0.1 mL

Main Test 0.100 g of the measurement sample is weighed exactly into a 250 mL tall beaker, 150 mL of a toluene/ethanol (3:1) mixed solution is added, and the sample is dissolved over the course of 1 hour. This is then titrated with the above potentiometric titrator using the above potassium hydroxide ethyl alcohol solution.

Blank Test

Titration is performed by the above operations except that no sample is used (that is, using only a toluene/ethanol (3:1) mixed solution).

The results are then entered into the following formula to calculate the acid value:

$$A=[(C-B)\times f\times 5.61]/S$$

(in which A is the acid value (mgKOH/g), B is the added amount (mL) of the potassium hydroxide solution in the blank test, C is the added amount (mL) of the potassium hydroxide solution in the main test, f is the factor of the potassium hydroxide solution, and S is the mass (g) of the sample).

Measuring Hydroxyl Values of Crystalline Polyester Resin, Amorphous Polyester Resin and Styrene-Acrylic Resin The hydroxyl value is the number of mg of potassium hydroxide needed to neutralize the acetic acid bound to hydroxyl groups when acetylating 1 g of sample. The hydroxyl value in the present invention is measured in accordance with JIS K 0070-1992, specifically by the following procedures.

25.0 g of special-grade anhydrous acetic acid is placed in a 100 mL measuring flask, and pyridine is added to a total of 100 mL and thoroughly shaken to obtain an acetylation reagent. The resulting acetylation reagent is stored in a brown bottle so as to avoid contact with humidity, carbon dioxide gas and the like.

Titration is performed with a 1.0 mol/L potassium hydroxide ethyl alcohol solution (Kishida Chemical Co.). The factor of the potassium hydroxide ethyl alcohol solution can be determined with a potentiometric titrator (AT-510 automatic potentiometric titrator, Kyoto Electronics Manufacturing Co., Ltd.). Specifically, 100 mL of 1.00 mol/L hydrochloric acid is taken in a 250 mL tall beaker and titrated with the potassium hydroxide ethyl alcohol solution, and the amount of the potassium hydroxide ethyl alcohol solution required for neutralization is determined. The 1.00 mol/L hydrochloric acid has been prepared in accordance with JIS K 8001-1998.

The measurement conditions for hydroxyl value measurement are shown below.

Titration unit: AT-510 potentiometric titrator (Kyoto Electronics Manufacturing Co., Ltd.)

Electrode: Double-junction type composite glass electrode (Kyoto Electronics Manufacturing Co., Ltd.)

Titration unit control software: AT-WIN

Titration analysis software: Tview

The titration parameters and control parameters during titration are set as follows.

Titration Parameters

Titration mode: Blank titration

Titration format: Total titration

Maximum titration amount: 80 mL

Waiting time before titration: 30 seconds

Titration direction: Automatic

Control Parameters

End point judgment potential: 30 dE

End point judgment potential value: 50 dE/dmL

End point detection judgment: Not set

Control speed mode: Standard

Gain: 1

Data collection potential: 4 mV

Data collection titration amount: 0.5 mL

Main Test 2.00 g of the measurement sample is weighed exactly into a 200 mL round-bottomed flask, and 5.00 mL of the previous acetylation reagent is added precisely with a volumetric pipette. When the sample does not dissolve easily in the acetylation reagent, it is dissolved by addition of a small amount of special-grade toluene.

A small funnel is set on the mouth of the flask, and 1 cm of the flask bottom is heated by immersing it in a 97° C. glycerin bath. To prevent the temperature of the neck of the flask from rising due to heat from the bath, the base of the neck of the flask is covered with a thick paper having a round hole.

After one hour, the flask is removed from the glycerin bath and cooled. After cooling, 1.00 mL of water is added through the funnel and shaken to hydrolyze the anhydrous acetic acid. To achieve complete hydrolysis, the flask is then heated again for 10 minutes in the glycerin bath. After cooling, the walls of the funnel and flask are washed with 5.00 mL of ethyl alcohol.

The resulting sample is transferred to a 250 mL tall beaker, 100 mL of a mixed solution of toluene and ethanol (3:1) is added, and the mixture is dissolved over the course of 1 hour. Using a potentiometric titrator, this is then titrated with the potassium hydroxide ethyl alcohol solution.

Blank Test

Titration is performed by the above operations except that no sample is used (that is, using only a toluene/ethanol (3:1) mixed solution).

The results are then entered into the following formula to calculate the hydroxyl value:

$$A=[\{(B-C)\times 28.05\times f\}/S]+D$$

In the formula, A is the hydroxyl value (mgKOH/g), B is the added amount (mL) of the potassium hydroxide ethyl alcohol solution in the blank test, C is the added amount (mL) of the potassium hydroxide ethyl alcohol solution in the main test, f is the factor of the potassium hydroxide ethyl alcohol solution, S is the mass (g) of the sample, and D is the acid value (mgKOH/g) of the resin.

Charge Control Agent

A known charge control agent may be used in the toner. The content of the charge control agent is preferably from 0.01 mass parts to 20 mass parts, or more preferably from 0.5 mass parts to 10 mass parts per 100 mass parts of the binder resin.

Pigment

The toner may also contain a colorant. Examples of the colorant include the following.

Copper phthalocyanine compounds and their derivatives, anthraquinone compounds, and basic dye lake compounds may be used as pigments in cyan colorants. Specific examples include C.I. pigment blue 15, 15:1, 15:2, 15:3 and 15:4.

Condensed azo compounds, diketopyrrolopyrrole compounds, anthraquinone compounds, quinacridone compounds, basic dye lake compounds, naphthol compounds, benzimidazolone compounds, thioindigo compounds and perylene compounds may be used as pigments in magenta colorants. Specific examples include C.I. pigment violet 19 and C.I. pigment red 31, 32, 122, 150, 254, 264 and 269.

Condensed azo compounds, isoindolinone compounds, anthraquinone compounds, azo metal complexes, methine compounds and allylamide compounds may be used as pigments in yellow colorants. Specific examples include C.I. pigment yellow 74, 93, 120, 139, 151, 155, 180 and 185.

Examples of black colorants include carbon black, magnetic materials, and blacks prepared by mixing the above yellow, magenta and cyan colorants.

To increase the effects of the invention, the pigment is preferably carbon black, C.I. pigment blue 15:3, C.I. pigment red 122, 150, 32 or 269 or C.I. pigment yellow 155, 93, 74, 180 or 185. Carbon black, C.I. pigment blue 15:3, and C.I. pigment red 122 are particularly desirable. In the case of carbon black, the pH is preferably at least 6, and the oil absorption (DBP) is preferably from 30 (mL/100 g) to 120 (mL/100 g). This is also desirable because it is unlikely to inhibit the reaction of the polymerization initiator used in the present invention.

The content of the colorant is preferably from 1 mass part to 20 mass parts with respect to 100 mass parts of the binder resin.

Other Additives

Various known inorganic and organic additives may also be used in the toner to confer various properties as long as the effects of the invention are not adversely affected. Considering durability when added to the toner, the particle diameter of the additive used is preferably not more than 3/10 the weight-average particle diameter of the toner. The particle diameter of this additive is the average particle diameter as determined by surface observation of the toner particle under a scanning electron microscope.

The content of these additives is preferably from 0.01 mass parts to 10 mass parts, or more preferably from 0.02 mass parts to 3 mass parts with respect to 100 mass parts of the toner. These additives may be used individually, or multiple kinds may be combined.

These additives may also be hydrophobically treated. The method of hydrophobic treatment may be a method various coupling agents such as a silane coupling agent or a titanium coupling agent, but preferably the hydrophobicity is increased with silicone oil. It is thus possible to inhibit moisture adsorption by the inorganic fine particle under high-humidity conditions and suppress contamination of the regulating members and charging members, resulting in high-quality images.

The toner manufacturing method may be a conventional known toner manufacturing method such as a suspension polymerization method, emulsion aggregation method, dissolution kneading method or dissolution suspension method, without any particular limitations, but an emulsion aggregation method or suspension polymerization method is preferred.

An emulsion aggregation method is explained as a manufacturing method.

Emulsion aggregation is a manufacturing method in which resin particles that are sufficiently small for the desired particle size are prepared in advance, and these resin fine particles are aggregated in an aqueous medium to manufacture core particles. In emulsion aggregation methods, the toner particle is manufactured by way of a resin fine particle emulsification step, aggregation step, fusing step, cooling step and washing step. A shell-forming step may also be included after the cooling step to obtain a core-shell toner.

Resin Fine Particle Emulsification Step

Resin fine particles composed primarily of a binder resin such as a polyester resin may be prepared by known methods. For example, the resin can be dissolved in an organic solvent and added to an aqueous medium, and particle dispersed in the aqueous medium together with a surfactant or polymer electrolyte with a dispersion apparatus such as a homogenizer, after which the solvent can be removed by heating or pressure reduction to prepare a resin particle dispersion.

Any organic solvent capable of dissolving the resin may be used, but tetrahydrofuran, ethyl acetate, chloroform and the like are preferred for their high solvent ability.

From an environmental standpoint, it is desirable to add the resin to the aqueous medium together with a surfactant, a base and the like, and then emulsify and disperse in an aqueous medium containing effectively no organic solvent with a disperser such as a Clearmix, Homo Mixer or homogenizer that applies high-speed shearing force. In particular, the content of organic solvents with a boiling point of not more than 100° C. is preferably not more than 100 μg/g. Within this range, a step of removing and collecting the organic solvent is unnecessary when manufacturing the toner, and wastewater treatment measures are less burdensome. The organic solvent content in the aqueous medium can be measured by gas chromatography (GC).

The surfactant used in emulsification is not particularly limited, but examples include anionic surfactants such as sulfate ester salts, sulfonate salts, carboxylate salts, phosphoric acid esters, soaps and the like; cationic surfactants such as amine salts and quaternary ammonium salts; and non-ionic surfactants such as polyethylene glycols, alkyl phenol ethylene oxide adducts and polyhydric alcohols. One kind of surfactant or a combination of two or more may be used.

The median diameter of the resin fine particle based on volume distribution is preferably 0.05 μm to 1.0 μm, or more preferably 0.05 μm to 0.4 μm. If it is not more than 1.0 μm, it is easy to obtain a toner particle with a volume-based median diameter of 4.0 μm to 7.0 μm, which is a suitable size for the toner particle. The volume-based median diameter can be measured using a Nanotrac UPA-EX150 dynamic light scattering particle size distribution meter (Nikkiso).

Aggregation Step

The aggregation step is a step of preparing a liquid mixture by mixing the above resin fine particle together with the necessary amounts of a colorant fine particle, release agent particle and the like as necessary, and then aggregating the particles contained in the prepared liquid mixture to form aggregates. The method of forming the aggregates may preferably be a method of adding and mixing a flocculant in the liquid mixture, and suitably applying temperature, mechanical force and the like.

Examples of the flocculant include metal salts of monovalent metals such as sodium and potassium; metal salts of bivalent metals such as calcium and magnesium; and metal salts of trivalent metals such as iron and aluminum.

The flocculant is preferably added and mixed at a temperature at or below the glass transition temperature (Tg) of the resin particle contained in the mixture. If mixing is performed under these temperature conditions, aggregation can progress in a stable state. Mixing can be performed using a known mixing apparatus, homogenizer, mixer or the like.

The weight-average particle diameter of the aggregates formed here is not particularly limited, but is normally controlled at 4.0 μm to 7.0 μm to so as to be roughly the same as the weight-average particle diameter of the intended toner particle. This can be easily controlled for example by suitable setting and changing the temperature and the stirring and mixing conditions when adding and mixing the flocculant and the like. The particle size distributions of the toner particle and aggregates can be measured with a particle size distribution analyzer (Coulter Multisizer III: Beckman Coulter, Inc.) based on the Coulter method.

Fusing Step

The fusing step is a step of heating and fusing the above aggregates at a temperature at or above the glass transition temperature (Tg) of the resin to manufacture particles with smoothed aggregate surfaces. Prior to the primary fusing step, a chelating agent, pH adjuster, surfactant or the like may be added as necessary to prevent melt adhesion between toner particles.

Examples of chelating agents include ethylenediamine tetraacetic acid (EDTA) and its alkali metal salts such as Na salts, sodium gluconate, sodium tartrate, potassium citrate, sodium citrate, nitrotriacetate (NTA) salts, and many water-soluble polymers containing both COOH and OH functional groups (polymer electrolytes).

The temperature of the heating may be any between the glass transition temperature (Tg) of the resin contained in the aggregates and the temperature at which the resin is thermally decomposed. The heating and fusing time may be short if the heating temperature is high, but must be long if the heating temperature is low. That is, the heating and fusing time cannot be specified in general because it depends on the heating temperature, but is generally 10 minutes to 10 hours.

Cooling Step

The cooling step is a step of lowering the temperature of the aqueous medium containing the particles to a temperature lower than the glass transition temperature (Tg) of the binder resin. If the temperature is not cooled to below the Tg, coarse particles are produced. The specific cooling speed is 0.003° C./sec to 15° C./sec. A cooling speed of at least 0.1° C./sec in particular results in a uniform dispersal of the ester wax domains, and is especially effective for achieving both fixing performance and durability.

A holding step in which the toner particle dispersion is maintained for at least 30 minutes at a temperature of not less than Tg−10° C. of the binder resin and not more than Tg+10° C. is preferably included after the cooling step. The preferred holding time is at least 90 minutes, or more preferably at least 120 minutes. The upper limit of the holding time is about 1440 minutes, at which time the effects become saturated.

The holding step can improve the impact resistance of the toner particle and suppress adhesion in the machine because the crystal nucleii of crystalline substances such as the ester wax produced in the toner particle undergo sufficient crystal growth and the ratio of crystalline substances compatible with the binder resin is reduced in the holding step, resulting in good developing performance.

In this step, the glass transition temperature (° C.) of the toner particle may be used as the glass transition temperature Tg (° C.) of the binder resin.

Shell-Forming Step

A shell-forming step may also be included as necessary before the washing and drying steps below. The shell-forming step is a step of newly adding and attaching a resin fine particle to form a shell on the particle prepared in the previous steps.

The binder resin fine particle added here may have the same structure as the binder resin fine particle used in the core, or may be a binder resin fine particle with a different structure.

The resin constituting such a shell layer is not particularly limited, and known resins used in toners may be used without any particular limitations, such as polyester resins, vinyl polymers such as styrene-acrylic copolymers, epoxy resins, polycarbonate resins, polyurethane resins or the like. Of these, a polyester resin or styrene-acrylic copolymer is preferred, and a polyester resin is more preferred from the perspective of obtaining high fixing performance and durability.

One binder resin alone or a combination of two or more may be used for constituting the shell layer.

Washing and Drying Step

The particle prepared by the above steps can then be washed and filtered with ion-exchange water the pH of which has been adjusted with sodium hydroxide or potassium hydroxide, and then washed with ion-exchange water and filtered multiple times. This can then be dried to obtain an emulsion aggregated toner particle.

When obtaining a toner by suspension polymerization, the toner can be prepared directly by a manufacturing method such as the following.

A polar resin such as a polyester resin, a release agent, a colorant, a crosslinking agent and other additives are mixed as necessary with polymerizable monomers for producing the binder resins, and the mixture is uniformly dissolved or dispersed with a homogenizer, ultrasound disperser or the like to obtain a polymerizable monomer composition.

The resulting polymerizable monomer composition is dispersed with an ordinary agitator, Homo Mixer, homogenizer or the like in an aqueous medium containing a dispersion stabilizer. The stirring speed and time are adjusted so that the droplets of the polymerizable monomer composition have the desired toner size, and the mixture is granulated to form particles of the polymerizable monomer composition. Stirring may be performed sufficiently to maintain the particle state by the action of the dispersion stabilizer, and to prevent the particles from settling.

A polymerization initiator is added to promote a polymerization reaction, and polymerization is performed with the polymerization temperature set to normally at least 40° C., or preferably 50° C. to 120° C. If the polymerization temperature is at least 95° C., the container in which the polymerization reaction is performed may be pressurized to control evaporation of the aqueous medium. The temperature may also be raised or the pH may be changed as necessary during the second half of the polymerization reaction.

Furthermore, the reaction temperature may also be raised during the second half of the reaction to remove unreacted polymerizable monomers, by-products and the like than may cause odors during fixing, and part of the aqueous medium may also be distilled off either during the second half of the reaction or after completion of the reaction. A dispersion of the resulting toner particle precursor is obtained after completion of the reaction. This toner particle precursor dispersion is then concentrated, cooled, washed, collected by filtration, and dried.

The pH of the aqueous medium during granulation is not particularly limited, but is preferably pH 3.0 to 13.0, or more preferably 3.0 to 7.0, or still more preferably 3.0 to 6.0. If the pH is at least 3.0, dispersion stabilization is easier, facilitating granulation.

Toner particle washing is preferably accomplished using an acid with a pH of not more than 2.5, or preferably not more than 1.5. By washing the toner particle with an acid, it is possible to reduce the dispersion stabilizer present on the toner particle surface. The acid used in washing is not particularly limited, and an inorganic acid such as hydrochloric acid or sulfuric acid may be used. It is thus possible to adjust the charging performance of the toner particle to within the desired range.

An organic compound such as polyvinyl alcohol, gelatin, methyl cellulose, methyl hydroxypropyl cellulose, ethyl cellulose, carboxymethyl cellulose sodium salt or starch may also be included in addition to the hardly water-soluble inorganic fine particle used as a dispersion stabilizer. These dispersion stabilizers are preferably used in the amount of 0.01 mass parts to 2.0 mass parts with respect to 100 mass parts of the polymerizable monomers.

From 0.001 mass % to 0.1 mass % of a surfactant may also be included in order to refine these dispersion stabilizers.

Specific examples include commercial nonionic, anionic and cationic surfactants. Preferred examples include sodium dodecyl sulfate, sodium tetradecyl sulfate, sodium pentadecyl sulfate, sodium octylsulfate, sodium oleate, sodium laurate, sodium stearate and calcium oleate.

Cooling Step

The diameters and distribution of the wax domains in the toner can be controlled to a certain degree by controlling the cooling conditions in the step of cooling the toner particle distribution containing the toner particle, and also in the subsequent annealing step.

The cooling initiation temperature of the toner particle dispersion in the cooling step is preferably at or above the higher of the DSC endothermic peak temperature (° C.) of the wax and the glass transition temperature Tg (° C.) of the binder resin (toner particle). The cooling completion temperature is at or below the glass transition temperature Tg (° C.). The cooling speed is preferably at least 0.3° C./sec, or more preferably at least 1.5° C./sec.

An operation of mixing cold water or ice, an operation of bubbling the aqueous medium with cold air or an operation of removing the heat from the aqueous medium with a heat exchanger or the like may be used as the means of rapidly lowering the temperature of the aqueous medium.

After completion of the reaction, the resulting toner particle dispersion can be rapidly cooled to precipitated as fine crystals those of the crystalline substances such as wax contained in the toner particle that have blended with the binder resin. Because a polymer with a high molecular weight is distributed near the toner particle surface, the precipitated crystalline substances are unlikely to blend there, thereby reducing the abundance of crystalline substances near the outermost surface of the toner particle, and resulting in excellent developing performance and resistance to in-machine adhesion in the concentrating apparatus.

Furthermore, most of the crystalline substances are precipitated in a fine crystalline state inward from the outermost surface of the toner particle. Although the abundance of these crystalline substances near the outermost surface of the toner particle is low, the ratio of uniformly dispersed fine crystals is increased, and fixing performance is excellent because the crystalline substances melt rapidly during fixing. From the standpoint of achieving both fixing performance and durability, it is particularly effective if the organosilicon polymer particle used in the present invention is located on the toner particle surface.

The cooling initiation temperature of the toner particle dispersion in the cooling step is preferably at or above the higher of the DSC endothermic peak (° C.) of the wax or other crystalline substance and the glass transition temperature Tg (° C.) of the binder resin (toner particle), and is preferably at least 5° C. above, or more preferably at least 10° C. above the higher of the DSC endothermic peak (° C.) and the glass transition temperature Tg (° C.), while the cooling completion temperature is preferably not more than the glass transition temperature Tg (° C.) (more preferably, not more than Tg−3° C.).

If the toner particle is at a temperature higher than both the DSC endothermic peak (° C.) of the crystalline substance and the glass transition temperature Tg of the toner particle, the crystalline substance melts more uniformly in the toner particle. When cooling is rapid, this state is maintained as the crystalline substance is precipitated as fine crystals in the toner particle. There is also little irregularity in the size of the crystals of the crystalline substance, which is excellent from the standpoint of toner developing performance and fixing performance, and for suppressing in-machine adhesion in the concentrating apparatus.

Moreover, the state described above can be continuously maintained by keeping the cooling completion temperature at or below the glass transition temperature Tg (° C.), resulting in even greater developing performance and fixing performance and suppression of in-machine adhesion in the concentrating apparatus. The peak molecular weight Mp of the crystalline substance is preferably at least 600 to maximize the above effects.

The cooling step is explained below with reference to drawings. The cooling step preferably comprises the following steps (1) to (3).

Step (1) is a step of preparing a liquid dispersion of a toner particle containing a binder resin, dispersed in an aqueous medium.

The FIGURE illustrates the temperature transition of the aqueous medium with the toner particle dispersed therein in steps (1) to (3) of the present invention. In the FIGURE, 601 represents step (1) and 602 represents step (2). 609 represents the glass transition temperature Tg of the toner particle or binder resin, and 607 represents the DSC endothermic peak temperature of the crystalline substance.

In step (2), the temperature of the aqueous medium is raised to a temperature higher than the higher of the DSC endothermic peak temperature of the crystalline substance and the Tg. 604 represents the temperature of the aqueous medium immediately before cooling, which is called the initial temperature T1. 605 represents the temperature immediately after completion of cooling, which is called the stop temperature T2.

Next, in step (3), the temperature of the aqueous medium is maintained in order to promote nucleus formation and growth of the crystalline substance. 603 represents the step (3). 608 and 610 are lines representing Tg+10° C. and Tg−10° C., respectively. 606 represents the temperature T4 of the aqueous medium at a time 30 minutes past the time when step (3) was initiated. 611 and 612 represent the cooling speed 1 from T1 to T2 and the cooling speed 2 from T3 to T4, respectively. The cooling speed 1 and cooling speed 2 are calculated by the following formulae.

$$\text{Cooling speed 1}=(T1(^\circ\text{ C.})-T2(^\circ\text{ C.}))/\text{time required for cooling (minutes)}$$

$$\text{Cooling speed 2}=(T3(^\circ\text{ C.})-T4(^\circ\text{ C.}))/30\text{ (minutes)}$$

When performing the treatments of step (2) and step (3), the hydrophobic crystalline substance is enclosed within the toner particle because the treatment is performed in an aqueous medium. It is thus possible to suppress the presence of crystalline substance on the particle surface of the resulting toner particle.

The operation of raising the temperature of the aqueous medium in step (2) to a higher temperature is performed to melt both the crystalline substance and the binder resin contained in the toner particle. This operation serves to mix the crystalline substance and the binder resin at a molecular level.

To further melt the binder resin and crystalline substance thoroughly together, the cooling initiation temperature is preferably a temperature of the aqueous medium that is higher than the higher of the DSC endothermic peak temperature (° C.) of the crystalline substance and the glass transition temperature Tg (° C.) of the toner particle.

If after step (1) the temperature of the aqueous medium is already higher than the higher of the DSC endothermic peak temperature (° C.) of the crystalline substance and the glass transition temperature Tg (° C.) of the toner particle, further operations such as heating the aqueous medium are not necessary.

Other manufacturing equipment that can be used to manufacture the toner is explained below. Known equipment may be used in the present invention, and for example the stirring means in the granulation step may be a device having a stirring blade such as a paddle blade, inclined paddle blade, three-blade retreat impeller, anchor blade, full-zone blade (Kobelco Pantech), Maxblend (Sumitomo Heavy Industries), Super Mix (Satake Chemical Equipment), Hi-F mixer (Soken Chemical & Engineering) or the like for example. A stirrer that can apply high shear force is more desirable.

A device provided with a stirring chamber formed by a high-speed rotating stirring rotor and a screen surrounding the stirring rotor is preferred as a high shear force stirrer. Specific examples include the Ultra Turrax (IKA), Polytron (Kinematica AG), T.K. Homomixer (Primix), Clearmix (M Technique), W-Motion (M Technique), Cavitron (manufactured by Cavitron), Sharp Flow Mill (Taiheiyo Engineering) and the like.

The weight-average particle diameter (D4) of the toner is preferably from 4.0 μm to 12.0 pun, or more preferably from 4.0 μm to 9.0 pun. A weight-average particle diameter of at least 4.0 μm is good for durability and heat resistance during long-term use, while a weight-average particle diameter of not more than 12.0 μm is desirable from the standpoint of toner tinting strength and image resolution.

Method for Measuring Weight-Average Particle Diameter (D4) and Number-Average Particle Diameter (D1) of Toner Particle The weight-average particle diameter (D4) and the number-average particle diameter (D1) of the toner particle is calculated as shown below. A precision particle diameter distribution measurement apparatus "Coulter Counter Multisizer 3" (registered trademark, by Beckman Coulter, Inc.) relying on a pore electrical resistance method and equipped with a 100 μm aperture tube is used as a measurement apparatus. A dedicated software "Beckman Coulter Multisizer 3, Version 3.51" (by Beckman Coulter, Inc.) ancillary to the apparatus, is used for setting measurement conditions and analyzing measurement data. Measurements are performed in 25,000 effective measurement channels.

The aqueous electrolyte solution used in the measurements can be prepared through dissolution of special-grade sodium chloride at a concentration of 1 mass % in ion-exchanged water; for instance "ISOTON II" (by Beckman Coulter, Inc.) can be used herein.

The dedicated software was set up as follows prior to measurement and analysis. In the "Changing Standard Operating Mode (SOM)" screen of the dedicated software, a total count of the control mode is set to 50,000 particles, a number of runs is set to one, and a Kd value is set to a value obtained using "Standard particles 10.0 μm" (by Beckman Coulter, Inc.). The "threshold/noise level measuring button" is pressed to thereby automatically set a threshold value and a noise level.

Then the current is set to 1600 μA, the gain is set to 2, the electrolyte solution is set to ISOTON II, and "flushing of the aperture tube following measurement" is ticked. In the "setting conversion from pulses to particle size" screen of the dedicated software, the bin interval is set to a logarithmic particle diameter, the particle diameter bin is set to 256 particle diameter bins, and the particle diameter range is set to range from 2 μm to 60 μm.

Specific measurement methods are as described below.

(1) Herein 200 mL of the aqueous electrolyte solution is placed in a 250 mL round-bottomed glass beaker dedicated to Multisizer 3. The beaker is set on a sample stand and is stirred counterclockwise with a stirrer rod at 24 rotations per second. Debris and air bubbles are then removed from the aperture tube by the "aperture tube flush" function of the dedicated software.

(2) Then 30 mL of the aqueous electrolyte solution is placed in a 100 mL flat-bottomed glass beaker, and 0.3 mL of a dilution obtained by diluting "Contaminon N" (10 mass % aqueous solution of a pH 7 neutral detergent for cleaning of precision instruments, comprising a nonionic surfactant, an anionic surfactant and an organic builder, by Wako Pure Chemical Industries, Ltd.) thrice by mass in ion-exchanged water is added thereto as a dispersant.

(3) About 3.3 L of ion-exchanged water is placed in a water tank of an ultrasonic disperser (Ultrasonic Dispersion System Tetora 150; Nikkaki Bios Co., Ltd.) having an electrical output of 120 W and internally equipped with two oscillators that oscillate at a frequency of 50 kHz and are disposed at a phase offset of 180 degrees, and 2 mL of the above Contaminon N are added into the water tank.

(4) The beaker of (2) is set in a beaker-securing hole of the ultrasonic disperser, which is then operated. The height position of the beaker is adjusted so as to maximize a resonance state at the liquid level of the aqueous electrolyte solution in the beaker.

(5) With the aqueous electrolyte solution in the beaker of (4) being ultrasonically irradiated, 10 mg of the toner are added little by little to the aqueous electrolyte solution, to be dispersed therein. The ultrasonic dispersion treatment is further continued for 60 seconds. The water temperature of the water tank at the time of ultrasonic dispersion is adjusted as appropriate to lie in the range of from 10° C. to 40° C.

(6) The aqueous electrolyte solution of (5) containing the dispersed toner is added dropwise, using a pipette, to the round-bottomed beaker of (1) set on the sample stand, to adjust the measurement concentration to 5%. A measurement is then performed until the number of measured particles reaches 50,000.

(7) Measurement data is analyzed using the dedicated software ancillary to the apparatus, to calculate the weight-average particle diameter (D4), the number-average particle diameter (D1), the volume-based median diameter and the number-based median diameter. When graph/% by volume is selected in the dedicated software, the "average diameter" and "median diameter" in the "analysis/volume statistics (arithmetic average)" screen yield the weight-average particle diameter (D4) and the volume-based median diameter (Dv50), respectively. Moreover, when graph/% by number is selected in the dedicated software, the "average diameter" and "median diameter" in the "analysis/number statistics (arithmetic average)" screen yield the number-average particle diameter (D1) and the number-based median diameter (Dn50), respectively.

The glass transition temperature of the toner particle is preferably from 53° C. to 75° C. from the standpoint of storability and fixing performance.

The average circularity of the toner particle is preferably at least 0.960. This is desirable because it increases the probability that the toner particle will receive a uniform triboelectric charge through contact between the toner particles or between the toner particles and the toner carrying member or toner layer thickness control member, and also because it makes the stress applied to the toner particles more uniform, which is desirable from the standpoint of charging performance and melt adhesion to the toner layer thickness control member.

Measurement of Average Circularity of Toner Particle

The average circularity of the toner particle is measured using an "FPIA-3000" (Sysmex Corporation), a flow particle image analyzer, and using the measurement and analysis conditions from the calibration process.

The specific measurement procedure is as follows. First, approximately 20 mL of deionized water from which solid impurities and the like have been removed in advance is introduced into a glass vessel. To this is added as dispersing agent about 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.). About 0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be from 10° C. to 40° C. Using a benchtop ultrasound cleaner/disperser that has an oscillation frequency of 50 kHz and an electrical output of 150 W (for example, the "VS-150" (Velvo-Clear Co., Ltd.)) as the ultrasound disperser, a prescribed amount of deionized water is introduced into the water tank and about 2 mL of Contaminon N is added to the water tank.

The flow particle image analyzer fitted with a "LUCPLFLN" objective lens (20×, numerical aperture: 0.40) is used for the measurement, and "PSE-900A" (Sysmex Corporation) particle sheath is used for the sheath solution. The dispersion prepared according to the procedure described above is introduced into the flow particle image analyzer and 2,000 particles of the toner are measured according to total count mode in HPF measurement mode. The average circularity of the toner particle is determined with the binarization threshold value during particle analysis set at 85% and the analyzed particle diameter limited to a circle-equivalent diameter from 1.977 μm to less than 39.54 μm.

For this measurement, automatic focal point adjustment is performed prior to the start of the measurement using reference latex particles (for example, a dilution with deionized water of "RESEARCH AND TEST PARTICLES Latex Microsphere Suspensions 5100A", Duke Scientific Corporation). After this, focal point adjustment is preferably performed every two hours after the start of measurement.

In the examples of this application, calibration operations were performed using a flow-type particle image analyzer that had been calibrated by Sysmex Corporation and had received a calibration certificate issued by Sysmex Corporation The analyzed particle diameters were limited to circle-equivalent diameters of at least 1.977 μm and less than 39.54 μm, and measurement was performed under the measurement and analysis conditions set at the time the certificate was issued.

EXAMPLES

The present invention is explained in detail below using examples, but these examples do not limit the present invention. Parts in the compounded examples below are based on mass unless otherwise specified.

Crystalline Polyester Resin Manufacturing Example 1

The following polyester monomers were loaded into an autoclave equipped with a pressure reduction unit, a water separation unit, a nitrogen gas introduction unit, a temperature measurement unit and a stirrer:

Sebacic acid: 175 parts
1,6-Hexanediol: 170 parts
Ethylene glycol: 50 parts
Potassium oxalate titanate: 0.40 parts These were reacted for 6 hours at 200° C. under normal pressure in a nitrogen atmosphere, and then further reacted for 1.5 hours at 220° C. under reduced pressure of 10 mmHg to 20 mmHg to obtain a crystalline polyester resin 1. The resulting crystalline polyester resin 1 had an acid value of 1.3 mgKOH/g, a weight-average molecular weight (Mw) of 21,000, and a DSC endothermic peak of 79.8° C. The SP value was 10.00.

Crystalline Polyester Resin Manufacturing Example 2

The following polyester monomers were loaded into an autoclave equipped with a pressure reduction unit, a water separation unit, a nitrogen gas introduction unit, a temperature measurement unit and a stirrer:

Sebacic acid: 175 parts
1,6-Hexanediol: 20 parts
Ethylene glycol: 190 parts
Potassium oxalate titanate: 0.40 parts These were reacted for 6 hours at 200° C. under normal pressure in a nitrogen atmosphere, and then further reacted for 1.5 hours at 220° C. under reduced pressure of 10 mmHg to 20 mmHg to obtain a crystalline polyester resin 2. The resulting crystalline polyester resin 2 had an acid value of 1.3 mgKOH/g, a hydroxyl value of 30.3 mgKOH/g, a weight-average molecular weight (Mw) of 21,000, and a DSC endothermic peak of 77.8° C. The SP value was 10.51.

Crystalline Polyester Resin Manufacturing Example 3

The following polyester monomers were loaded into an autoclave equipped with a pressure reduction unit, a water separation unit, a nitrogen gas introduction unit, a temperature measurement unit and a stirrer:

Sebacic acid: 175 parts 1,6-hexanediol: 190 parts 1,12-dodecanediol: 20 parts

Potassium oxalate titanate: 0.40 parts

These were reacted for 6 hours at 200° C. under normal pressure in a nitrogen atmosphere, and then further reacted for 1.5 hours at 220° C. under reduced pressure of 10 mmHg to 20 mmHg to obtain a crystalline polyester resin 3. The resulting crystalline polyester resin 3 had an acid value of 1.3 mgKOH/g, a hydroxyl value of 27.3 mgKOH/g, a weight-average molecular weight (Mw) of 25,000, and a DSC endothermic peak of 75.8° C. The SP value was 9.80.

Manufacture of Amorphous Polyester Resin 1

The following polyester monomers were loaded into an autoclave equipped with a pressure reduction unit, a water separation unit, a nitrogen gas introduction unit, a temperature measurement unit and a stirrer:

Terephthalic acid: 75 parts

Bisphenol A propylene oxide 2-mol adduct: 100 parts

Tetrabutoxy titanate: 0.125 parts

These were reacted for 5 hours at 200° C. under normal pressure in a nitrogen atmosphere, after which 2.1 parts of trimellitic acid and 0.120 parts of tetrabutoxy titanate were added, and the mixture was reacted for 3 hours at 220° C. and then reacted for a further 2 hours under reduced pressure of 10 mmHg to 20 mmHg to obtain an amorphous polyester resin 1. The resulting amorphous polyester resin 1 had an acid value of 8.3 mgKOH/g, a hydroxyl value of 33.3 mgKOH/g, a weight-average molecular weight (Mw) of 10,000, and a DSC endothermic peak of 72.5° C. The SP value was 10.04.

Manufacture of Amorphous Polyester Resin 2

The following polyester monomers were loaded into an autoclave equipped with a pressure reduction unit, a water separation unit, a nitrogen gas introduction unit, a temperature measurement unit and a stirrer:

Terephthalic acid: 61 parts

Fumaric acid: 27 parts

Bisphenol A propylene oxide 2-mol adduct: 100 parts

Tetrabutoxy titanate: 0.125 parts

These were reacted for 5 hours at 200° C. under normal pressure in a nitrogen atmosphere, after which 2.1 parts of trimellitic acid and 0.120 parts of tetrabutoxy titanate were added, and the mixture was reacted for 3 hours at 220° C. and then reacted for a further 2 hours under reduced pressure of 10 mmHg to 20 mmHg to obtain an amorphous polyester resin 2. The resulting amorphous polyester resin 2 had an acid value of 10.0 mgKOH/g, a hydroxyl value of 30.3 mgKOH/g, a weight-average molecular weight (Mw) of 12,000, and a DSC endothermic peak of 70.8° C. The SP value was 10.51.

Manufacturing Example of Organosilicon Polymer Particle 1

First Step 360 parts of water were placed in a reactor equipped with a thermometer and a stirrer, and 15 parts of 5.0 mass % hydrochloric acid were added to obtain a uniform solution. This was stirred at 25° C. as 136 parts of methyl trimethoxysilane were added, stirred for 5 hours, and then filtered to obtain a clear reaction solution containing a silanol compound or partial condensate thereof.

Second Step 540 parts of water were placed in a reactor equipped with a thermometer, a stirrer and a dripping mechanism, and 17 parts of 10.0 mass % ammonia water were added to obtain a uniform solution. This was stirred at 35° C. as 100 parts of the reaction solution obtained in Step 1 were dripped in over the course of 0.5 hours, and then stirred for 6 hours to obtain an organosilicon polymer particle dispersion.

Step 3

5 parts of hexamethyl disilazane were added as a hydrophobic agent to the resulting organosilicon polymer particle dispersion, and then stirred for 48 hours at 25° C. to obtain a powder suspension comprising a powder of a hydrophobized spherical polymethyl silsesquioxane fine particle suspended in the upper layer of the liquid. This was left standing for 5 minutes, and the floating powder was collected by suction filtration and vacuum dried for 24 hours at 100° C. to obtain a dried powder of a white hydrophobized spherical polymethyl silsesquioxane fine particle (organosilicon polymer particle 1). The physical properties are shown in Table 1.

Manufacturing Example of Organosilicon Polymer Particle 16

First Step 360 parts of water were placed in a reactor equipped with a thermometer and a stirrer, and 17 parts of 5.0 mass % hydrochloric acid were added to obtain a uniform solution. This was stirred at 25° C. as 136 parts of methyl trimethoxysilane were added, stirred for 5 hours, and then filtered to obtain a clear reaction solution containing a silanol compound or partial condensate thereof.

Second Step 1540 parts of water and 1,500 parts of methanol were placed in a reactor equipped with a thermometer, a stirrer and a dripping mechanism, and 19 parts of 10.0 mass % ammonia water were added to obtain a uniform solution. This was stirred at 30° C. as 100 parts of the reaction solution obtained in Step 1 were dripped in over the course of 0.33 hours, and stirred for 6 hours to obtain an organosilicon polymer particle dispersion.

The resulting suspension was centrifuged to precipitate and remove the fine particles, which were then dried in a dryer at 200° C. for 24 hours to obtain an organosilicon polymer particle 16. The physical properties are shown in Table 1.

Manufacturing Examples of Organosilicon Polymer Particles 2 to 15 and 17 to 24

Organosilicon polymer particles 2 to 15 and 17 to 24 were obtained as in the manufacturing example of the organosilicon polymer particle 1 except that the silane compound, reaction initiation temperature, added amount of the catalyst, dripping time and the like were changed as shown in Table 1. The physical properties are shown in Table 1.

TABLE 1

| Organo silicon polymer particle | First step: Water parts | Hydrochloric acid parts | Reaction temp. ° C. | Silane compound A name | Silane compound A parts | Silane compound B name | Silane compound B parts | Silane compound C name | Silane compound C parts | Silane compound D name | Silane compound D parts |
|---|---|---|---|---|---|---|---|---|---|---|---|
| 1 | 360 | 15 | 25 | methyltrimethoxy-silane | 136 | — | — | — | — | — | — |
| 2 | 360 | 17 | 25 | methyltrimethoxy-silane | 136 | — | — | — | — | — | — |
| 3 | 360 | 13 | 25 | methyltrimethoxy-silane | 136 | — | — | — | — | — | — |
| 4 | 360 | 13.4 | 25 | methyltrimethoxy-silane | 136 | — | — | — | — | — | — |
| 5 | 360 | 14.2 | 25 | methyltrimethoxy-silane | 136 | — | — | — | — | — | — |
| 6 | 360 | 18.5 | 25 | methyltrimethoxy-silane | 136 | — | — | — | — | — | — |
| 7 | 360 | 20 | 25 | methyltrimethoxy-silane | 136 | — | — | — | — | — | — |
| 8 | 360 | 21.5 | 25 | methyltrimethoxy-silane | 136 | — | — | — | — | — | — |
| 9 | 360 | 23 | 25 | methyltrimethoxy-silane | 136 | — | — | — | — | — | — |
| 10 | 360 | 17 | 25 | methyltrimethoxy-silane | 136 | — | — | — | — | — | — |
| 11 | 360 | 17 | 25 | methyltrimethoxy-silane | 136 | — | — | — | — | — | — |
| 12 | 360 | 17 | 25 | methyltrimethoxy-silane | 136 | — | — | — | — | — | — |
| 13 | 360 | 17 | 25 | methyltrimethoxy-silane | 136 | — | — | — | — | — | — |
| 14 | 360 | 17 | 25 | methyltrimethoxy-silane | 136 | — | — | — | — | — | — |
| 15 | 360 | 17 | 25 | methyltrimethoxy-silane | 136 | — | — | — | — | — | — |
| 16 | 360 | 17 | 25 | methyltrimethoxy-silane | 136 | — | — | — | — | — | — |
| 17 | 360 | 17 | 25 | ethyltrimethoxy-silane | 136 | — | — | — | — | — | — |
| 18 | 360 | 17 | 25 | n-propyl-trimethoxy-silane | 136 | — | — | — | — | — | — |
| 19 | 360 | 17 | 25 | phenyl-trimethoxy-silane | 136 | — | — | — | — | — | — |
| 20 | 360 | 17 | 25 | methyltrimethoxy-silane | 136 | trimethyl-methoxy-silane | 2 | dimethyl-dimethoxy-silane | 1 | — | — |
| 21 | 360 | 17 | 25 | methyltrimethoxy-silane | 120 | trimethyl-methoxy-silane | 20.8 | dimethyl-dimethoxy-silane | 18 | — | — |
| 22 | 360 | 17 | 25 | methyltrimethoxy-silane | 136 | trimethyl-methoxy-silane | 5 | dimethyl-dimethoxy silane | 50 | — | — |
| 23 | 360 | 17 | 25 | methyltrimethoxy-silane | 136 | trimethyl-methoxy-silane | 5 | dimethyl-dimethoxy-silane | 20 | — | — |
| 24 | 360 | 17 | 25 | methyltrimethoxy-silane | 136 | trimethyl-methoxy-silane | 1 | dimethyl-dimethoxy-silane | 1 | tetra-methoxy-silane | 50 |

| Organo silicon polymer particle | Second step: Reaction solution obtained in First step parts | Water parts | Ammonia water parts | Reaction initiation temp. ° C. | Dropping time hours | Third step: Hydrophobic treatment agent type | Hydrophobic treatment agent parts | Reaction temp. ° C. | Reaction time hours | Number-average particle diameter (nm) | SF-1 | Hydrophobicity | Ratio of T3 unit structures | SP value |
|---|---|---|---|---|---|---|---|---|---|---|---|---|---|---|
| 1 | 100 | 540 | 17 | 35 | 0.5 | HMDS | 5 | 25 | 48 | 100 | 110 | 55 | 1.00 | 8.94 |
| 2 | 100 | 540 | 19 | 30 | 0.33 | HMDS | 5 | 25 | 48 | 150 | 110 | 55 | 1.00 | 8.94 |
| 3 | 100 | 540 | 15 | 40 | 1 | HMDS | 5 | 25 | 48 | 50 | 110 | 55 | 1.00 | 8.94 |
| 4 | 100 | 540 | 15.4 | 39 | 0.9 | HMDS | 5 | 25 | 48 | 60 | 110 | 55 | 1.00 | 8.94 |
| 5 | 100 | 540 | 16.2 | 37 | 0.7 | HMDS | 5 | 25 | 48 | 80 | 110 | 55 | 1.00 | 8.94 |
| 6 | 100 | 540 | 20 | 30 | 0.29 | HMDS | 5 | 25 | 48 | 200 | 110 | 55 | 1.00 | 8.94 |
| 7 | 100 | 540 | 21 | 30 | 0.25 | HMDS | 5 | 25 | 48 | 250 | 110 | 55 | 1.00 | 8.94 |

TABLE 1-continued

| | | | | | | | | | | | | | | |
|---|---|---|---|---|---|---|---|---|---|---|---|---|---|---|
| 8 | 100 | 540 | 22 | 30 | 0.21 | HMDS | 5 | 25 | 48 | 300 | 110 | 55 | 1.00 | 8.94 |
| 9 | 100 | 540 | 23 | 30 | 0.17 | HMDS | 5 | 25 | 48 | 350 | 110 | 55 | 1.00 | 8.94 |
| 10 | 100 | 500 | 19 | 30 | 0.33 | HMDS | 5 | 25 | 48 | 150 | 105 | 55 | 1.00 | 8.94 |
| 11 | 100 | 620 | 19 | 30 | 0.33 | HMDS | 6 | 25 | 48 | 150 | 118 | 55 | 1.00 | 8.94 |
| 12 | 100 | 700 | 19 | 30 | 0.33 | HMDS | 7 | 25 | 48 | 150 | 125 | 55 | 1.00 | 8.94 |
| 13 | 100 | 540 | 19 | 30 | 0.33 | HMDS | 10 | 25 | 48 | 150 | 110 | 65 | 1.00 | 8.94 |
| 14 | 100 | 540 | 19 | 30 | 0.33 | HMDS | 2 | 25 | 48 | 150 | 110 | 50 | 1.00 | 8.94 |
| 15 | 100 | 540 | 19 | 30 | 0.33 | HMDS | 1 | 25 | 48 | 150 | 110 | 46 | 1.00 | 8.94 |
| 16 | 100 | 1540 | 19 | 30 | 0.33 | — | — | — | — | 150 | 110 | 55 | 1.00 | 8.94 |
| 17 | 100 | 540 | 19 | 30 | 0.33 | HMDS | 5 | 25 | 48 | 150 | 110 | 55 | 1.00 | 8.83 |
| 18 | 100 | 540 | 19 | 30 | 0.33 | HMDS | 5 | 25 | 48 | 150 | 110 | 55 | 1.00 | 8.77 |
| 19 | 100 | 540 | 19 | 30 | 0.33 | HMDS | 5 | 25 | 48 | 150 | 110 | 55 | 1.00 | 10.31 |
| 20 | 100 | 540 | 19 | 30 | 0.33 | HMDS | 5 | 25 | 48 | 150 | 110 | 55 | 0.97 | 8.83 |
| 21 | 100 | 540 | 19 | 30 | 0.33 | HMDS | 5 | 25 | 48 | 150 | 110 | 55 | 0.72 | 8.06 |
| 22 | 100 | 540 | 19 | 30 | 0.33 | HMDS | 5 | 25 | 48 | 150 | 110 | 55 | 0.68 | 8.21 |
| 23 | 100 | 540 | 19 | 30 | 0.33 | HMDS | 5 | 25 | 48 | 150 | 110 | 55 | 0.82 | 8.46 |
| 24 | 100 | 540 | 19 | 30 | 0.33 | HMDS | 5 | 25 | 48 | 150 | 110 | 55 | 0.74 | 9.62 |

Manufacturing Hydrophobic Silica 1

100 parts of silica (Aerosil 200CF, Nippon Aerosil) were treated with 10 parts of hexamethyl disilazane, and then treated with 20 parts of dimethyl silicone oil to obtain a hydrophobic silica 1. The hydrophobic silica 1 had a number-average particle diameter of 12 nm of the primary particles, and a hydrophobicity of 97.

Example 1

Preparation of Resin Particle Dispersion 1

(SA-1) Resin Particle, SP Value 10.15

89.0 parts of styrene, 6.0 parts of methacrylic acid, 9.0 parts of 2-hydroxyethyl methacrylate and 3.2 parts of n-lauryl mercaptane were mixed and dissolved. An aqueous solution of 2.5 parts of Neogen RK (Daiichi Kogyo) in 150 parts of ion-exchange water was then added to this solution, and dispersed. This was then stirred slowly for 10 minutes as an aqueous solution of 0.3 parts of potassium persulfate in 10 parts of ion-exchange water was added. After nitrogen purging, emulsion polymerization was performed for 6 hours at 70° C. After completion of polymerization, the reaction solution was cooled to room temperature, and ion-exchange water was added to obtain a resin particle dispersion 1 with a solids concentration of 12.5 mass % and a volume-based median diameter of 0.15 μm.

Preparation of Resin Particle Dispersions 2 to 10

Resin particle dispersions 2 to 10 were manufactured in the same way as the resin particle dispersion 1 except that the monomer composition was changed as shown in Table 2. The volume-based median diameters are shown in Table 2.

TABLE 2

| Resin particle | Monomer composition | | | | | SP | Particle diameter |
|---|---|---|---|---|---|---|---|
| dispersion | Ac | MMA | St | 2-HEMA | Mac | value | (μm) |
| 1 | 0.0 | 0.0 | 89.0 | 9.0 | 6.0 | 10.15 | 0.15 |
| 2 | 0.0 | 2.0 | 95.0 | 1.0 | 3.3 | 9.90 | 0.16 |
| 3 | 0.0 | 2.5 | 91.7 | 2.5 | 3.3 | 9.94 | 0.15 |
| 4 | 30.0 | 20.0 | 80.0 | 1.5 | 0.0 | 10.50 | 0.13 |
| 5 | 30.0 | 0.0 | 75.0 | 0.0 | 24.0 | 10.80 | 0.13 |
| 6 | 30.0 | 0.0 | 70.0 | 0.0 | 30.0 | 10.90 | 0.13 |
| 7 | 30.0 | 0.0 | 55.0 | 0.0 | 30.0 | 11.09 | 0.11 |
| 8 | 0.0 | 0.0 | 89.0 | 4.7 | 14.0 | 10.15 | 0.05 |
| 9 | 0.0 | 0.0 | 89.0 | 5.7 | 12.0 | 10.15 | 0.10 |
| 10 | 0.0 | 0.0 | 89.0 | 10.5 | 3.0 | 10.15 | 0.20 |

The particle diameter is the volume-based median diameter. The abbreviations in the table are define as follows. Ac: acrylic acid, MMA: methyl methacrylate, St: styrene, 2-HEMA: 2-hydroxyethyl methacrylate, Mac: methacrylic acid.

Preparation of Resin Particle Dispersion 11

3,000 parts of the amorphous polyester resin 1, 10,000 parts of ion-exchange water and 150 parts of sodium dodecylbenzene sulfonate as a surfactant were placed in the emulsion tank of a high-temperature, high-pressure emulsifier (Cavitron CDI010, slit: 0.4 mm). This was heated and melted at 130° C., dispersed for 30 minutes at 110° C. at a rotation of 10,000 rotation and a flow rate of 3 Um, and passed through a cooling tank to collect an amorphous polyester resin dispersion (Cavitron CD1010, slit 0.4 mm, manufactured by Cavitron).

This was cooled to room temperature, and ion-exchange water was added to obtain a resin particle dispersion 11, which was an amorphous polyester resin dispersion with a solids concentration of 12.5 mass % and a volume-based median diameter of 0.15 μm.

Preparation of Resin Particle Dispersion 12

A resin particle dispersion 12 was manufactured in the same way as the resin particle dispersion 11 except that the amorphous polyester resin 2 was substituted for the amorphous polyester resin 1. The volume-based median diameter was 0.15 μm.

Preparation of Resin Particle Dispersion 13

3,000 parts of the crystalline polyester resin 1, 10,000 parts of ion-exchange water and 150 parts of sodium dodecylbenzene sulfonate as a surfactant were placed in the emulsion tank of a high-temperature, high-pressure emulsifier (Cavitron CDI010, slit: 0.4 mm). This was heated and melted at 130° C., dispersed for 30 minutes at 110° C. at a rotation of 10,000 rotation and a flow rate of 3 Um, and passed through a cooling tank to collect a crystalline polyester resin dispersion (Cavitron CD1010, slit 0.4 mm, manufactured by Cavitron).

This was cooled to room temperature, and ion-exchange water was added to obtain a resin particle dispersion 13, which was a crystalline polyester resin dispersion with a solids concentration of 12.5 mass % and a volume-based median diameter of 0.15 μm.

Preparation of Resin Particle Dispersions 14 and 15

Resin particle dispersions 14 and 15 were manufactured in the same way as the resin particle dispersion 13 except that crystalline polyester resins 2 and 3, respectively, were substituted for the crystalline polyester resin 1. The volume-based median diameters were 0.15 μm.

Volume-Based Median Diameter (D50) of Resin Particle

The volume-based median diameter (D50) of the resin particle is measured with a laser-diffraction/scattering particle size distribution analyzer. Specifically, it is measured in accordance with JIS Z 8825-1 (2001). An LA-920 laser diffraction/scattering particle size distribution analyzer (Horiba, Ltd.) is used as the measurement apparatus. The dedicated software (Horiba LA-920 (Registered Trademark) for Windows, WET (LA-920) Ver. 2.02) included with the LA-920 is used for setting the measurement conditions and analyzing the measurement data. Ion-exchange water from which solid impurities have been removed in advance is used as the measurement solvent. The measurement procedures are as follows.

(1) A batch cell holder is attached to the LA-920.

(2) A predetermined amount of ion-exchange water is plated in a batch cell, and the batch cell is set in the batch cell holder.

(3) The interior of the batch cell is stirred with a dedicated stirrer tip.

(4) The "Refractive index" button is pressed on the "Display conditions settings" screen, and the relative refractive index is set to a value corresponding to the resin particle.

(5) The particle size basis is set to volume basis on the "Display conditions settings" screen.

(6) Following a warm-up operation of at least 1 hour, optical axis adjustment, optical axis fine adjustment and blank measurement are performed.

(7) 3 mL of the resin particle dispersion is placed in a glass 100.0 mL flat-bottomed beaker. 57 mL of ion-exchange water is further added to dilute the resin particle dispersion. 0.3 mL of a dilute solution of Contaminon N (a 10 mass % aqueous solution of a pH 7 neutral detergent for washing precision instruments, comprising a nonionic surfactant, an anionic surfactant and an organic builder, manufactured by Wako Pure Chemical Industries, Ltd.) diluted 3× by mass with ion-exchange water is then added as a dispersant.

(8) An ultrasonic disperser (Ultrasonic Dispersion System Tetora 150, Nikkaki Bios) is prepared with an electrical output of 120 W equipped with two built-in oscillators having an oscillating frequency of 50 kHz with their phases shifted by 180° from each other. 3.3 L of ion-exchange water is added to the water tank of the ultrasonic disperser, and 2.0 mL of Contaminon N is added to the tank.

(9) The beaker of (7) above is set in the beaker-fixing hole of the ultrasonic disperser, and the ultrasonic disperser is operated. The height position of the beaker is adjusted so as to maximize the resonant condition of the liquid surface of the aqueous solution in the beaker.

(10) Ultrasound dispersion is continued for 60 seconds. During ultrasound dispersion, the water temperature in the tank is adjusted appropriately to from 10° C. to 40° C.

(11) Taking care to avoid bubbles, the resin particle dispersion prepared in (10) above is immediately added bit by bit to the batch cell, and adjusted so that the transmittance of a tungsten lamp is 90% to 95%. The particle size distribution of the resin particles is then measured. The D50 is calculated based on the resulting volume-based particle size distribution data.

Preparing Colorant Dispersion 1

100 parts of carbon black (Nipex 35, Orion Engineered Carbons) as a colorant and 15 parts of Neogen RK were mixed with 885 parts of ion-exchange water, and dispersed for about one hour with a JN100 wet jet mill to obtain a colorant dispersion.

Preparing Wax Dispersion 1

100 parts of wax (ethylene glycol distearate, melting point 76° C.) and 15 parts of Neogen RK were mixed with 385 parts of ion-exchange water, and dispersed for about one hour with a JN100 (Jokoh Co.) to obtain a wax dispersion. The concentration of the wax dispersion was 20 mass %. The volume-based median diameter of the wax fine particles was 0.20 μm as measured with a Nanotrac dynamic light scattering particle size distribution meter (Nikkiso).

Preparation of Wax Dispersions 2 to 22

Wax dispersions 2 to 22 were manufactured in the same way as the wax dispersion 1 except that the wax was changed as shown in Table 3. The volume-based median diameters are shown in Table 3.

TABLE 3

| Wax dispersion No. | Wax Type | Melting point (° C.) | Mp | SPw | Neogen RK (parts) | Wax dispersed diameter (μm) |
|---|---|---|---|---|---|---|
| 1 | ethylene glycol distearate | 76 | 595 | 8.85 | 15 | 0.20 |
| 2 | ethylene glycol distearate | 76 | 595 | 8.85 | 5 | 1.70 |
| 3 | ethylene glycol distearate | 76 | 595 | 8.85 | 10 | 1.00 |
| 4 | ethylene glycol distearate | 76 | 595 | 8.85 | 13 | 0.40 |
| 5 | ethylene glycol distearate | 76 | 595 | 8.85 | 16 | 0.15 |
| 6 | behenyl behenate | 73 | 649 | 8.59 | 15 | 0.20 |
| 7 | dibehenyl sebacate | 73 | 819 | 8.77 | 15 | 0.20 |
| 8 | ethylene glycol dibehenate | 83 | 707 | 8.81 | 15 | 0.20 |
| 9 | pentaerythritol tetabehenate | 76 | 1426 | 8.87 | 15 | 0.20 |
| 10 | pentaerythritol tetastearate | 66 | 1201 | 8.93 | 15 | 0.20 |
| 11 | dipentaerythritol hexabehenate | 86 | 2190 | 8.90 | 15 | 0.20 |
| 12 | dipentaerythritol hexastearate | 79 | 1853 | 8.97 | 15 | 0.20 |
| 13 | dipentaerythritol hexapalmitate | 73 | 1685 | 9.01 | 15 | 0.20 |
| 14 | diethylene glycol distearate | 63 | 639 | 8.88 | 15 | 0.20 |
| 15 | diethylene glycol dibehenate | 73 | 751 | 8.83 | 15 | 0.20 |
| 16 | distearyl sebacate | 65 | 706 | 8.81 | 15 | 0.20 |
| 17 | dibehenyl terephthalate | 89 | 783 | 8.98 | 15 | 0.20 |
| 18 | pentaerythritol telramyristate | 62 | 978 | 9.03 | 15 | 0.20 |
| 19 | stearyl behenate | 67 | 593 | 8.59 | 15 | 0.20 |
| 20 | Paraffin wax | 72 | 380.7 | 8.22 | 15 | 0.20 |
| 21 | Fischer-Tropsch wax | 78 | 469 | 8.28 | 15 | 0.20 |
| 22 | Fischer-Tropsch wax | 90 | 771 | 8.39 | 15 | 0.20 |

Toner 1 Preparation Example 265 parts of the resin particle dispersion 1 (resin particle dispersion A in Table 5-1), 10 parts of the wax dispersion 1 and 10 parts of the colorant dispersion 1 were dispersed with a homogenizer (IKA Ultra Turrax T50). This was stirred as the temperature inside the container was adjusted to 30° C., and 1 mol/L sodium hydroxide aqueous solution was added to adjust the pH to 8.0. An aqueous solution of 0.250 parts of magnesium sulfate dissolved in 10 parts of ion-exchange water was added at 30° C. under stirring over the course of 10 minutes as a flocculant. This was left for 3 minutes before initiating temperature rise, and the temperature was raised to 50° C. to produce aggregated particles.

This was held at 50° C. for 30 minute, and an additional 70 parts of the resin particle dispersion 1 (resin particle dispersion C in Table 5-1) were added.

The particle diameters of the aggregated particles were measured in this state with a Multisizer 3 Coulter Counter (Registered Trademark, Beckman Coulter). Once the weight-average particle diameter had reached 4.5 μm, 3.0 parts of sodium chloride and 8.0 parts of Neogen RK were added to arrest particle growth.

The temperature was then raised to 95° C. to fuse and spheroidize the aggregated particles. A cooling step was performed once the average circularity had reached 0.980. 5° C. water was mixed with the 95° C. toner particle precursor dispersion to cool the dispersion to 30° C. at a cooling speed of 4.000° C./sec.

The temperature was then raised to 55° C. at a ramp rate of 1.00° C./min, and then maintained at 55° C. for 180 minutes, and 5° C. water was mixed in to cool the dispersion to 30° C. at a cooling speed of 5° C./sec.

Hydrochloric acid was added to adjust the pH of the resulting toner particle dispersion 1 to 1.5 or less, and the dispersion was stirred for 1 hour, left standing, and subjected to solid-liquid separation with a pressure filtration unit to obtain a toner cake. This was re-slurried with ion-exchange water to once again obtain a dispersion, and then subjected to solid-liquid separation with the same filtration unit. Re-slurrying and solid-liquid separation were repeated until the electrical conductivity of the filtrate was not more than 5.0 μS/cm, after which a final solid-liquid separation was performed to obtain a toner cake.

The resulting toner cake was dried with a Flash Jet air dryer (Seishin Enterprise Co., Ltd.). The drying conditions were a blowing temperature of 90° C. and a dryer outlet temperature of 40° C., and the supply speed of the toner cake was adjusted according to the moisture content of the toner cake so that the outlet temperature did not deviate from 40° C. Fine and coarse powder was then cut with a multi-division classifier using the Coanda effect to obtain a toner particle 1.

6.67 parts of the organosilicon polymer particle 2 and 0.43 parts of the hydrophobic silica 1 were added to 100 parts of the resulting toner particle, and mixed with an FM mixer (Nippon Coke & Engineering FM10C) to obtain a toner 1 with external additives. The physical properties and the like of the resulting toner 1 are shown in Table 8-1.

External Addition Method

The components were placed in an FM mixer (Nippon Coke & Engineering FM10C) with 7° C. water in the jacket.

Once the water temperature in the jacket had stabilized at 7° C.±1° C., this was mixed for 5 minutes with a 38 m/sec peripheral speed of the rotating blade, to obtain a toner mixture.

The amount of water passing through the jacket was adjusted appropriately during this process so that the temperature in the FM mixer tank did not exceed 25° C.

The resulting toner mixture was sieved with a 75 micron mesh sieve to obtain a toner 1.

Preparation Examples of Toners 2 to 10, 15 to 58, 61 to 75, 77 to 82 and 84 to 90

Toners 2 to 10, 15 to 58, 61 to 75, 77 to 82 and 84 to 90 were obtained as in the manufacturing example of the toner 1 except that the formulations and cooling conditions were changed as shown in Tables 5-1, 5-2, 6-1 and 6-2. The physical properties and evaluation results are shown in Tables 7-1, 7-2, 8-1, 8-2, 9-1 and 9-2.

Preparation Example of Toner 59

225 parts of the resin particle dispersion 11 (resin particle dispersion A in Table 5-2), 40 parts of the resin particle dispersion 13 (resin particle dispersion B in Table 5-2), 10 parts of the wax dispersion 1 and 10 parts of the colorant dispersion 1 were dispersed with a homogenizer (IKA Ultra Turrax T50). This was stirred as the temperature inside the container was adjusted to 30° C., and 1 mol/L sodium hydroxide aqueous solution was added to adjust the pH to 8.0. An aqueous solution of 0.250 parts of magnesium sulfate dissolved in 10 parts of ion-exchange water was added at 30° C. under stirring over the course of 10 minutes as a flocculant. This was left for 3 minutes before initiating temperature rise, and the temperature was raised to 50° C. to produce aggregated particles.

This was held at 50° C. for 30 minutes, after which an additional 70 parts of the resin particle dispersion 11 (resin particle dispersion C in Table 5-2) were added.

The particle diameters of the aggregated particles were measured in this state with a Multisizer 3 Coulter Counter (Registered Trademark, Beckman Coulter). Once the weight-average particle diameter had reached 4.5 μm, 3.0 parts of sodium chloride and 8.0 parts of Neogen RK were added to arrest particle growth.

The temperature was then raised to 95° C. to fuse and spheroidized the aggregated particles. A cooling step was performed once the average circularity had reached 0.980. 5° C. water was mixed with the 95° C. toner particle precursor dispersion to cool the dispersion to 30° C. at a cooling speed of 4.00° C./sec.

The temperature was then raised to 55° C. at a rate of 1.00° C./min and maintained at 55° C. for 180 minutes, after which 5° C. water was mixed in to cool the dispersion to 30° C. at a cooling speed of 5° C./sec.

Hydrochloric acid was added to adjust the pH of the resulting toner particle dispersion to 1.5 or less, and the dispersion was stirred for 1 hour, left standing, and subjected to solid-liquid separation with a pressure filtration unit to obtain a toner cake. This was re-slurried with ion-exchange water to once again obtain a dispersion, and then subjected to solid-liquid separation with the same filtration unit. Re-slurrying and solid-liquid separation were repeated until the electrical conductivity of the filtrate was not more than 5.0 μS/cm, after which a final solid-liquid separation was performed to obtain a toner cake.

The resulting toner cake was dried with a Flash Jet air dryer (Seishin Enterprise Co., Ltd.). The drying conditions were a blowing temperature of 90° C. and a dryer outlet temperature of 40° C., and the supply speed of the toner cake was adjusted according to the moisture content of the toner cake so that the outlet temperature did not deviate from 40° C. Fine and coarse powder was then cut with a multi-division classifier using the Coanda effect to obtain a toner particle 59.

6.67 parts of the organosilicon polymer particle 2 and 0.43 parts of the hydrophobic silica 1 were added to 100 parts of the resulting toner particle, and mixed with an FM mixer (Nippon Coke & Engineering FM10C) to obtain a toner 59 with external additives. The physical properties and evaluation results are shown in Tables 7-1, 7-2, 8-1, 8-2, 9-1 and 9-2.

External Addition Method

The components were placed in an FM mixer (Nippon Coke & Engineering FM10C) with 7° C. water in the jacket.

Once the water temperature in the jacket had stabilized at 7° C.±1° C., this was mixed for 5 minutes with a 38 m/sec peripheral speed of the rotating blade, to obtain a toner mixture.

The amount of water passing through the jacket was adjusted appropriately during this process so that the temperature in the FM mixer tank did not exceed 25° C.

The resulting toner mixture was sieved with a 75 micron mesh sieve to obtain a toner 59.

Preparation Example of Toner 60

A toner 60 was manufactured in the same way as the toner 59 except that the resin particle dispersion 13 was replaced with the resin particle dispersion 14 as shown in Tables 5-2 and 6-2. The physical properties and evaluation results are shown in Tables 7-1, 7-2, 8-1, 8-2, 9-1 and 9-2.

Manufacturing Example of Toner 11

Dispersant (Aqueous Medium)

19.2 parts of sodium phosphate and 6.2 parts of 10% hydrochloric acid were added to 1,000 parts of ion-exchange water in a reactor, and maintained for 60 minutes at 65° C. as the system was purged with nitrogen. This was stirred at 12,000 rpm with a T.K. homogenizer (Tokushu Kika Kogyo Co., Ltd.) as a calcium chloride aqueous solution of 10.7 parts of calcium chloride dissolved in 13.8 of ion-exchange water was added all at once to prepare an aqueous medium containing a dispersion stabilizer.

Polymerizable Monomer Composition

Styrene: 60 parts

Carbon black (Orion Engineered Carbons, product name Printex35): 7 parts

Charge control agent (Orient Chemical, Bontron E-89): 0.25 parts

These materials were placed in an attritor disperser (Mitsui Miike Kakoki K.K.), and dispersed for 5 hours at 220 rpm with zirconia beads 1.7 mm in diameter to obtain a polymerizable monomer composition.

The following materials were added to the polymerizable monomer composition:

Styrene: 20 parts n-Butyl acrylate: 20 parts

Crystalline polyester resin 3: 5 parts

Amorphous polyester resin 1: 5 parts

Ethyl glycol distearate (melting point 76.0° C.): 9 parts

These materials were maintained at 65° C. in a separate container, and uniformly dissolved and dispersed at 500 rpm with a T.K. homogenizer (Tokushu Kika Kogyo Co., Ltd.). 10.0 parts of the polymerization initiator t-hexyl peroxypivalate (NOF Corporation, Perhexyl-PV (trade name), molecular weight 202, 10 hour half-life temperature 53.2° C.) were dissolved in to prepare a polymerizable monomer composition.

The polymerizable monomer composition was added to the above aqueous medium in a granulation tank, stirred for 5 minutes at 10,000 rpm with a T.K. homogenizer at 65° C. under nitrogen purging, and granulated at pH 5.2. This was then transferred to a polymerization tank, and stirred at 30 rpm with a paddle stirring blade while being heated to 70° C. for 6 hours (conversion rate 90%) and then heated to 95° C. and reacted for 2 hours.

After completion of the polymerization reaction, a cooling step was performed. 5° C. water was mixed with the 95° C. toner particle precursor dispersion to cool the dispersion to 30° C. at a cooling speed of 4.00° C./sec.

The temperature was then raised to 55° C. at a ramp rate of 1.00° C./min, and then maintained at 55° C. for 180 minutes, and 5° C. water was mixed in to cool the dispersion to 30° C. at a cooling speed of 5° C./sec.

Hydrochloric acid was added to adjust the pH of the resulting toner particle dispersion to 1.5 or less, and the dispersion was stirred for one hour, left standing, and subjected to solid-liquid separation with a pressure filtration unit to obtain a toner cake. This was re-slurried with ion-exchange water to once again obtain a dispersion, and then subjected to solid-liquid separation with the same filtration unit. Re-slurrying and solid-liquid separation were repeated until the electrical conductivity of the filtrate was not more than 5.0 μS/cm, after which a final solid-liquid separation was performed to obtain a toner cake.

The resulting toner cake was dried with a Flash Jet air dryer (Seishin Enterprise Co., Ltd.). The drying conditions were a blowing temperature of 90° C. and a dryer outlet temperature of 40° C., and the supply speed of the toner cake was adjusted according to the moisture content of the toner cake so that the outlet temperature did not deviate from 40° C. Fine and coarse powder was then cut with a multi-division classifier using the Coanda effect to obtain a toner particle 11.

5.88 parts of the organosilicon polymer particle 2 and 0.38 parts of the hydrophobic silica 1 were added to 100 mass parts of the toner particle 11, and mixed with an FM mixer (Nippon Coke & Engineering FM10C) to obtain a toner 11 with external additives. The physical properties and evaluation results are shown in Tables 7-1, 7-2, 8-1, 8-2, 9-1 and 9-2.

External Addition Method

The components were placed in an FM mixer (Nippon Coke & Engineering FM10C) with 7° C. water in the jacket.

Once the water temperature in the jacket had stabilized at 7° C.±1° C., this was mixed for 5 minutes with a 38 m/sec peripheral speed of the rotating blade, to obtain a toner mixture.

The amount of water passing through the jacket was adjusted appropriately during this process so that the temperature in the FM mixer tank did not exceed 25° C.

The resulting toner mixture was sieved with a 75 micron mesh sieve to obtain a toner 11.

Manufacturing Examples of Toners 12 to 14 and 83

Toners 12 to 14 and 83 were obtained as in the manufacturing example of the toner 11 except that the presence or absence of the crystalline polyester resin 3, the amount of the organosilicon polymer particle and the cooling conditions were changed as shown in Table 4. The physical properties and evaluation results are shown in Tables 7-1, 7-2, 8-1, 8-2, 9-1 and 9-2.

TABLE 4

| Toner No. | Pigment Type (—) | Binder St/BA (molar ratio) | Binder SP value | Crystalline polyester resin No. | Crystalline polyester resin Amount (parts) | Amorphous polyester resin No. | Amorphous polyester resin Amount (parts) | Wax Type (—) | Wax Melting point (° C.) | Wax Molecular weight | Wax SPw |
|---|---|---|---|---|---|---|---|---|---|---|---|
| 11 | CB | 80/20 | 9.81 | 3 | 5 | 1 | 5 | ethylene glycol distearate | 76 | 595 | 8.85 |
| 12 | CB | 80/20 | 9.81 | 3 | 5 | 1 | 5 | ethylene glycol distearate | 76 | 595 | 8.85 |
| 13 | CB | 80/20 | 9.81 | 3 | 5 | 1 | 5 | ethylene glycol distearate | 76 | 595 | 8.85 |
| 14 | CB | 80/20 | 9.81 | — | — | 1 | 5 | ethylene glycol distearate | 76 | 595 | 8.85 |
| 83 | CB | 80/20 | 9.81 | 3 | 5 | 1 | 5 | ethylene glycol distearate | 76 | 595 | 8.85 |

| Toner No. | Cooling step: Cooling initiation temp. (° C.) | Cooling step: Cooling completion temp. (° C.) | Cooling step: Cooling speed (° C./sec) | Annealing step: Temp. (° C.) | Annealing step: Time (min) | Organosilicon polymer particle No. | Organosilicon polymer particle Amount (parts) | Inorganic fine particle Type (—) | Inorganic fine particle Amount (parts) |
|---|---|---|---|---|---|---|---|---|---|
| 11 | 95 | 30 | 4.00 | 55 | 180 | 2 | 5.88 | Hydrophobic silica 1 | 0.38 |
| 12 | 95 | 30 | 5.00 | 55 | 180 | 2 | 5.88 | Hydrophobic silica 1 | 0.38 |
| 13 | 95 | 30 | 6.00 | 55 | 180 | 2 | 5.88 | Hydrophobic silica 1 | 0.38 |
| 14 | 95 | 30 | 10.00 | 55 | 180 | 2 | 5.88 | Hydrophobic silica 1 | 0.38 |
| 83 | 95 | 30 | 0.01 | 55 | 180 | 2 | 6.67 | Hydrophobic silica 1 | 0.43 |

The molecular weight of the wax is the peak molecular weight.

Manufacturing Example of Toner 76

Synthesis of Toner Binder Solution 1,000 parts of the amorphous polyester resin 1 were dissolved and mixed in 2,000 parts of an ethyl acetate solvent to obtain a toner binder (1) ethyl acetate solution.

Toner Preparation 240 parts of the above toner binder (1) ethyl acetate solution, 6.0 parts of carbon black (Orion Engineered Carbons, product name "Printex 35"), 1.0 part of a 3,5-di-tert-butylsalicylic acid aluminum compound (Orient Chemical, Bontron E-88) and 13 parts of ethylene glycol distearate (melting point 76.0° C.) were placed in a beaker, and stirred, uniformly dissolved and dispersed at 55° C. with a TK Homomixer at 12,000 rpm to obtain a toner material solution. 1036.3 parts of the aqueous medium 1 and 0.27 parts of sodium dodecylbenzene sulfonate were added to the beaker, and uniformly dissolved.

This was then stirred at 12,000 rpm at 60° C. in the TK Homomixer as the toner material solution was added and stirred for 3 hours. The mixture was then transferred to a flask with an attached stirring rod and thermometer, and heated to 98° C. to remove the solvent.

After all of the solvent had been removed, a cooling step was performed. 5° C. water was mixed into the 95° C. toner particle precursor dispersion to cool the dispersion to 30° C. at a cooling speed of 4.00° C./sec.

The temperature was then raised to 55° C. at a rate of 1.00° C./min and maintained at 55° C. for 180 minutes, and 5° C. water was mixed in to cool the mixture to 30° C. at a cooling speed of 5° C./sec.

Hydrochloric acid was added to adjust the pH of the resulting toner particle dispersion to 1.5 or less, and the dispersion was stirred for 1 hour, left standing, and subjected to solid-liquid separation with a pressure filtration unit to obtain a toner cake. This was re-slurried with ion-exchange water to once again obtain a dispersion, and then subjected to solid-liquid separation with the same filtration unit. Re-slurrying and solid-liquid separation were repeated until the electrical conductivity of the filtrate was not more than 5.0 S/cm, after which a final solid-liquid separation was performed to obtain a toner cake.

The resulting toner cake was dried with a Flash Jet air dryer (Seishin Enterprise Co., Ltd.). The drying conditions were a blowing temperature of 90° C. and a dryer outlet temperature of 40° C., and the supply speed of the toner cake was adjusted according to the moisture content of the toner cake so that the outlet temperature did not deviate from 40° C. Fine and coarse powder was then cut with a multi-division classifier using the Coanda effect to obtain a toner particle 76.

6.67 parts of the organosilicon polymer particle 2 and 0.43 parts of the hydrophobic silica 1 were added to 100 parts of the resulting toner particle 76, and mixed with an FM mixer (Nippon Coke & Engineering FM10C) to obtain a toner 76 with external additives. The physical properties and the like of the resulting toner 1 are shown in Tables 7-1, 7-2, 8-1, 8-2, 9-1 and 9-2.

External Addition Method

The components were placed in an FM mixer (Nippon Coke & Engineering FM10C) with 7° C. water in the jacket.

Once the water temperature in the jacket had stabilized at 7° C.±1° C., this was mixed for 5 minutes with a 38 m/sec peripheral speed of the rotating blade, to obtain a toner mixture.

The amount of water passing through the jacket was adjusted appropriately during this process so that the temperature in the FM mixer tank did not exceed 25° C.

The resulting toner mixture was sieved with a 75 micron mesh sieve to obtain a toner 76.

Manufacturing Example of Toner 91

Amorphous polyester resin 1: 100.0 parts

Carbon black (Nipex 35, Orion Engineered Carbons): 7.00 parts

Wax (ethylene glycol distearate, melting point 76° C.): 4.00 parts

These materials were mixed with a Henschel mixer and melt kneaded with a twin-screw kneading extruder at 125° C., and the kneaded product was cooled gradually to room temperature, coarsely pulverized with a cutter mill, pulverized with a fine grinding machine using a jet air flow, and air classified to prepare a black-colored particle.

6.67 parts of the organosilicon polymer particle 2 and 0.43 parts of the hydrophobic silica 1 were added to 100 parts of the resulting black-colored particle, and mixed with an FM mixer (Nippon Coke & Engineering FM10C) to obtain a toner 91 with external additives. The physical properties and evaluation results are shown in Tables 7-1, 7-2, 8-1, 8-2, 9-1 and 9-2.

External Addition Method

The components were placed in an FM mixer (Nippon Coke & Engineering FM10C) with 7° C. water in the jacket. Once the water temperature in the jacket had stabilized at 7° C.±1° C., this was mixed for 5 minutes with a 38 m/sec peripheral speed of the rotating blade, to obtain a toner mixture.

The amount of water passing through the jacket was adjusted appropriately during this process so that the temperature in the FM mixer tank did not exceed 25° C.

The resulting toner mixture was sieved with a 75 micron mesh sieve to obtain a toner 91.

TABLE 5-1

| | Pigment | Resin particle dispersion A | | Resin particle dispersion B | | Wax dispersion | | Resin particle dispersion C | | Flocculant |
|---|---|---|---|---|---|---|---|---|---|---|
| Toner No. | Type (—) | Type (—) | Amount (parts) | Type (—) | Amount (parts) | Type (—) | Amount (parts) | Type (—) | Amount (parts) | Amount (parts) |
| 1 | CB | 1 | 265 | — | 0 | 1 | 10 | 1 | 70 | 0.250 |
| 2 | CB | 1 | 265 | — | 0 | 1 | 10 | 1 | 70 | 0.250 |
| 3 | CB | 1 | 265 | — | 0 | 1 | 10 | 1 | 70 | 0.250 |
| 4 | CB | 1 | 265 | — | 0 | 1 | 10 | 1 | 70 | 0.250 |
| 5 | CB | 1 | 265 | — | 0 | 1 | 10 | 1 | 70 | 0.250 |
| 6 | CB | 1 | 265 | — | 0 | 1 | 10 | 1 | 70 | 0.250 |
| 7 | CB | 1 | 265 | — | 0 | 1 | 10 | 1 | 70 | 0.250 |
| 8 | CB | 1 | 265 | — | 0 | 1 | 10 | 1 | 70 | 0.250 |
| 9 | CB | 1 | 265 | — | 0 | 1 | 10 | 1 | 70 | 0.250 |
| 10 | CB | 1 | 265 | — | 0 | 1 | 10 | 1 | 70 | 0.250 |
| 11 | CB | — | — | — | — | — | — | — | — | — |
| 12 | CB | — | — | — | — | — | — | — | — | — |
| 13 | CB | — | — | — | — | — | — | — | — | — |
| 14 | CB | — | — | — | — | — | — | — | — | — |
| 15 | CB | 1 | 265 | — | 0 | 2 | 10 | 1 | 70 | 0.250 |
| 16 | CB | 1 | 265 | — | 0 | 3 | 10 | 1 | 70 | 0.250 |
| 17 | CB | 1 | 265 | — | 0 | 4 | 10 | 1 | 70 | 0.250 |
| 18 | CB | 1 | 265 | — | 0 | 4 | 10 | 1 | 70 | 0.250 |
| 19 | CB | 1 | 265 | — | 0 | 5 | 10 | 1 | 70 | 0.250 |
| 20 | CB | 1 | 265 | — | 0 | 12 | 10 | 1 | 70 | 0.250 |
| 21 | CB | 1 | 265 | — | 0 | 13 | 10 | 1 | 70 | 0.250 |
| 22 | CB | 1 | 265 | — | 0 | 11 | 10 | 1 | 70 | 0.250 |
| 23 | CB | 1 | 265 | — | 0 | 10 | 10 | 1 | 70 | 0.250 |
| 24 | CB | 1 | 265 | — | 0 | 9 | 10 | 1 | 70 | 0.250 |
| 25 | CB | 1 | 265 | — | 0 | 15 | 10 | 1 | 70 | 0.250 |
| 26 | CB | 1 | 265 | — | 0 | 14 | 10 | 1 | 70 | 0.250 |
| 27 | CB | 1 | 265 | — | 0 | 8 | 10 | 1 | 70 | 0.250 |
| 28 | CB | 1 | 265 | — | 0 | 16 | 10 | 1 | 70 | 0.250 |
| 29 | CB | 1 | 265 | — | 0 | 7 | 10 | 1 | 70 | 0.250 |
| 30 | CB | 1 | 265 | — | 0 | 17 | 10 | 1 | 70 | 0.250 |
| 31 | CB | 1 | 265 | — | 0 | 6 | 10 | 1 | 70 | 0.250 |
| 32 | CB | 2 | 265 | — | 0 | 1 | 10 | 2 | 70 | 0.250 |
| 33 | CB | 3 | 265 | — | 0 | 10 | 10 | 3 | 70 | 0.250 |
| 34 | CB | 12 | 265 | — | 0 | 1 | 10 | 12 | 70 | 0.250 |
| 35 | CB | 12 | 265 | — | 0 | 6 | 10 | 12 | 70 | 0.250 |
| 36 | CB | 4 | 265 | — | 0 | 19 | 10 | 4 | 70 | 0.250 |
| 37 | CB | 5 | 265 | — | 0 | 19 | 10 | 5 | 70 | 0.250 |
| 38 | CB | 6 | 265 | — | 0 | 19 | 10 | 6 | 70 | 0.250 |
| 39 | CB | 7 | 265 | — | 0 | 1 | 10 | 7 | 70 | 0.250 |
| 40 | CB | 1 | 265 | — | 0 | 1 | 10 | 10 | 70 | 0.250 |
| 41 | CB | 1 | 265 | — | 0 | 1 | 10 | 9 | 70 | 0.250 |
| 42 | CB | 1 | 265 | — | 0 | 1 | 10 | 8 | 70 | 0.250 |
| 43 | CB | 1 | 265 | — | 0 | 1 | 10 | — | 0 | 0.250 |
| 44 | CB | 1 | 265 | — | 0 | 1 | 10 | 1 | 70 | 0.250 |
| 45 | CB | 1 | 265 | — | 0 | 1 | 10 | 1 | 70 | 0.250 |

TABLE 5-2

| | Pigment | Resin particle dispersion A | | Resin particle dispersion B | | Wax dispersion | | Resin particle dispersion C | | Flocculant |
|---|---|---|---|---|---|---|---|---|---|---|
| Toner No. | Type (—) | Type (—) | Amount (parts) | Type (—) | Amount (parts) | Type (—) | Amount (parts) | Type (—) | Amount (parts) | Amount (parts) |
| 46 | CB | 1 | 265 | — | 0 | 1 | 10 | 1 | 70 | 0.250 |
| 47 | CB | 1 | 265 | — | 0 | 1 | 10 | 1 | 70 | 0.250 |
| 48 | CB | 1 | 265 | — | 0 | 1 | 10 | 1 | 70 | 0.250 |

TABLE 5-2-continued

| Toner No. | Pigment Type (—) | Resin particle dispersion A Type (—) | Resin particle dispersion A Amount (parts) | Resin particle dispersion B Type (—) | Resin particle dispersion B Amount (parts) | Wax dispersion Type (—) | Wax dispersion Amount (parts) | Resin particle dispersion C Type (—) | Resin particle dispersion C Amount (parts) | Flocculant Amount (parts) |
|---|---|---|---|---|---|---|---|---|---|---|
| 49 | CB | 1 | 265 | — | 0 | 1 | 10 | 1 | 70 | 0.250 |
| 50 | CB | 1 | 265 | — | 0 | 1 | 10 | 1 | 70 | 0.250 |
| 51 | CB | 1 | 265 | — | 0 | 1 | 10 | 1 | 70 | 0.250 |
| 52 | CB | 1 | 265 | — | 0 | 1 | 10 | 1 | 70 | 0.250 |
| 53 | CB | 1 | 265 | — | 0 | 1 | 10 | 1 | 70 | 0.225 |
| 54 | CB | 1 | 265 | — | 0 | 1 | 10 | 1 | 70 | 0.275 |
| 55 | CB | 1 | 265 | — | 0 | 1 | 10 | 1 | 70 | 0.325 |
| 56 | CB | 1 | 265 | — | 0 | 1 | 10 | 1 | 70 | 0.225 |
| 57 | CB | 1 | 265 | — | 0 | 1 | 10 | 1 | 70 | 0.250 |
| 58 | CB | 1 | 265 | — | 0 | 1 | 10 | 1 | 70 | 0.225 |
| 59 | CB | 11 | 225 | 13 | 40 | 1 | 10 | 11 | 70 | 0.250 |
| 60 | CB | 12 | 225 | 14 | 40 | 1 | 10 | 12 | 70 | 0.250 |
| 61 | CB | 1 | 265 | — | 0 | 1 | 10 | 1 | 70 | 0.250 |
| 62 | CB | 1 | 265 | — | 0 | 1 | 10 | 1 | 70 | 0.250 |
| 63 | CB | 1 | 265 | — | 0 | 1 | 10 | 1 | 70 | 0.250 |
| 64 | CB | 1 | 265 | — | 0 | 1 | 10 | 1 | 70 | 0.250 |
| 65 | CB | 1 | 265 | — | 0 | 1 | 10 | 1 | 70 | 0.250 |
| 66 | CB | 1 | 265 | — | 0 | 1 | 10 | 1 | 70 | 0.250 |
| 67 | CB | 1 | 265 | — | 0 | 1 | 10 | 1 | 70 | 0.250 |
| 68 | CB | 1 | 265 | — | 0 | 1 | 10 | 1 | 70 | 0.250 |
| 69 | CB | 1 | 265 | — | 0 | 1 | 10 | 1 | 70 | 0.225 |
| 70 | CB | 1 | 265 | — | 0 | 1 | 10 | 1 | 70 | 0.275 |
| 71 | CB | 1 | 265 | — | 0 | 1 | 10 | 1 | 70 | 0.225 |
| 72 | CB | 1 | 265 | — | 0 | 1 | 10 | 1 | 70 | 0.350 |
| 73 | CB | 1 | 265 | — | 0 | 1 | 10 | 1 | 70 | 0.250 |
| 74 | CB | 1 | 265 | — | 0 | 1 | 10 | 1 | 70 | 0.250 |
| 75 | CB | 1 | 265 | — | 0 | 1 | 10 | 1 | 70 | 0.250 |
| 76 | CB | — | — | — | — | — | — | — | — | — |
| 77 | CB | 1 | 265 | — | 0 | 1 | 10 | 1 | 70 | 0.250 |
| 78 | CB | 1 | 265 | — | 0 | 1 | 10 | 1 | 70 | 0.250 |
| 79 | CB | 1 | 265 | — | 0 | 1 | 10 | 1 | 70 | 0.250 |
| 80 | CB | 1 | 265 | — | 0 | 1 | 10 | 1 | 70 | 0.250 |
| 81 | CB | 1 | 265 | — | 0 | 1 | 10 | 1 | 70 | 0.250 |
| 82 | CB | 1 | 265 | — | 0 | 1 | 10 | 1 | 70 | 0.250 |
| 83 | CB | — | — | — | — | — | — | — | — | — |
| 84 | CB | 1 | 265 | — | 0 | 1 | 5 | 1 | 70 | 0.250 |
| 85 | CB | 1 | 265 | — | 0 | 1 | 30 | 1 | 70 | 0.250 |
| 86 | CB | 1 | 265 | — | 0 | 20 | 10 | 1 | 70 | 0.250 |
| 87 | CB | 1 | 265 | — | 0 | 21 | 10 | 1 | 70 | 0.250 |
| 88 | CB | 1 | 265 | — | 0 | 22 | 10 | 1 | 70 | 0.250 |
| 89 | CB | 1 | 265 | — | 0 | 18 | 10 | 1 | 70 | 0.250 |
| 90 | CB | 1 | 265 | — | 0 | 1 | 10 | 1 | 70 | 0.250 |

TABLE 6-1

| Toner No. | Cooling step: Cooling initiation temp. (° C.) | Cooling step: Cooling completion temp. (° C.) | Cooling step: Cooling speed (° C./sec) | Annealing step: Temp. (° C.) | Annealing step: Time (min) | Organosilicon polymer particle: Type (—) | Organosilicon polymer particle: Amount (patrs) | Inorganic fine particle: Type (—) | Inorganic fine particle: Amount (patrs) |
|---|---|---|---|---|---|---|---|---|---|
| 1 | 95 | 30 | 4.00 | 55 | 180 | 2 | 6.67 | Hydrophobic silica 1 | 0.43 |
| 2 | 95 | 30 | 4.00 | 55 | 180 | 17 | 6.67 | Hydrophobic silica 1 | 0.43 |
| 3 | 95 | 30 | 4.00 | 55 | 180 | 18 | 6.67 | Hydrophobic silica 1 | 0.43 |
| 4 | 95 | 30 | 4.00 | 55 | 180 | 19 | 6.67 | Hydrophobic silica 1 | 0.43 |
| 5 | 95 | 30 | 4.00 | 55 | 180 | 23 | 6.67 | Hydrophobic silica 1 | 0.43 |
| 6 | 95 | 30 | 4.00 | 55 | 180 | 24 | 6.67 | Hydrophobic silica 1 | 0.43 |
| 7 | 95 | 30 | 1.00 | 55 | 120 | 2 | 6.67 | Hydrophobic silica 1 | 0.43 |
| 8 | 95 | 30 | 5.00 | 55 | 180 | 2 | 6.67 | Hydrophobic silica 1 | 0.43 |
| 9 | 95 | 30 | 6.00 | 55 | 180 | 2 | 6.67 | Hydrophobic silica 1 | 0.43 |
| 10 | 95 | 30 | 10.00 | 55 | 180 | 2 | 6.67 | Hydrophobic silica 1 | 0.43 |
| 11 | 95 | 30 | 4.00 | 55 | 180 | 2 | 5.88 | Hydrophobic silica 1 | 0.38 |
| 12 | 95 | 30 | 5.00 | 55 | 180 | 2 | 5.88 | Hydrophobic silica 1 | 0.38 |
| 13 | 95 | 30 | 6.00 | 55 | 180 | 2 | 5.88 | Hydrophobic silica 1 | 0.38 |
| 14 | 95 | 30 | 10.00 | 55 | 180 | 2 | 5.88 | Hydrophobic silica 1 | 0.38 |
| 15 | 95 | 30 | 4.00 | 55 | 300 | 2 | 6.67 | Hydrophobic silica 1 | 0.43 |
| 16 | 95 | 30 | 4.00 | 55 | 120 | 2 | 6.67 | Hydrophobic silica 1 | 0.43 |
| 17 | 95 | 30 | 4.00 | 55 | 100 | 2 | 6.67 | Hydrophobic silica 1 | 0.43 |

TABLE 6-1-continued

| | Cooling step | | | | | | | | |
|---|---|---|---|---|---|---|---|---|---|
| | Cooling initiation | Cooling completion | Cooling | Annealing step | | Organosilicon polymer particle | | Inorganic fine particle | |
| Toner No. | temp. (° C.) | temp. (° C.) | speed (° C./sec) | Temp. (° C.) | Time (min) | Type (—) | Amount (patrs) | Type (—) | Amount (patrs) |
| 18 | 95 | 30 | 4.00 | 55 | 80 | 2 | 6.67 | Hydrophobic silica 1 | 0.43 |
| 19 | 95 | 30 | 6.00 | 55 | 60 | 2 | 6.67 | Hydrophobic silica 1 | 0.43 |
| 20 | 95 | 30 | 4.00 | 55 | 180 | 2 | 6.67 | Hydrophobic silica 1 | 0.43 |
| 21 | 95 | 30 | 4.00 | 55 | 180 | 2 | 6.67 | Hydrophobic silica 1 | 0.43 |
| 22 | 95 | 30 | 4.00 | 55 | 180 | 2 | 6.67 | Hydrophobic silica 1 | 0.43 |
| 23 | 95 | 30 | 4.00 | 55 | 180 | 2 | 6.67 | Hydrophobic silica 1 | 0.43 |
| 24 | 95 | 30 | 4.00 | 55 | 180 | 2 | 6.67 | Hydrophobic silica 1 | 0.43 |
| 25 | 95 | 30 | 4.00 | 55 | 180 | 2 | 6.67 | Hydrophobic silica 1 | 0.43 |
| 26 | 95 | 30 | 4.00 | 55 | 180 | 2 | 6.67 | Hydrophobic silica 1 | 0.43 |
| 27 | 95 | 30 | 4.00 | 55 | 180 | 2 | 6.67 | Hydrophobic silica 1 | 0.43 |
| 28 | 95 | 30 | 4.00 | 55 | 180 | 2 | 6.67 | Hydrophobic silica 1 | 0.43 |
| 29 | 95 | 30 | 4.00 | 55 | 180 | 2 | 6.67 | Hydrophobic silica 1 | 0.43 |
| 30 | 95 | 30 | 4.00 | 55 | 180 | 2 | 6.67 | Hydrophobic silica 1 | 0.43 |
| 31 | 95 | 30 | 4.00 | 55 | 180 | 2 | 6.67 | Hydrophobic silica 1 | 0.43 |
| 32 | 95 | 30 | 4.00 | 55 | 180 | 2 | 6.67 | Hydrophobic silica 1 | 0.43 |
| 33 | 95 | 30 | 4.00 | 55 | 180 | 2 | 6.67 | Hydrophobic silica 1 | 0.43 |
| 34 | 95 | 30 | 4.00 | 55 | 180 | 2 | 6.67 | Hydrophobic silica 1 | 0.43 |
| 35 | 95 | 30 | 4.00 | 55 | 180 | 2 | 6.67 | Hydrophobic silica 1 | 0.43 |
| 36 | 95 | 30 | 4.00 | 55 | 180 | 2 | 6.67 | Hydrophobic silica 1 | 0.43 |
| 37 | 95 | 30 | 4.00 | 55 | 180 | 2 | 6.67 | Hydrophobic silica 1 | 0.43 |
| 38 | 95 | 30 | 4.00 | 55 | 180 | 2 | 6.67 | Hydrophobic silica 1 | 0.43 |
| 39 | 95 | 30 | 4.00 | 55 | 180 | 2 | 6.67 | Hydrophobic silica 1 | 0.43 |
| 40 | 95 | 30 | 4.00 | 55 | 180 | 2 | 6.67 | Hydrophobic silica 1 | 0.43 |
| 41 | 95 | 30 | 4.00 | 55 | 180 | 2 | 6.67 | Hydrophobic silica 1 | 0.43 |
| 42 | 95 | 30 | 4.00 | 55 | 180 | 2 | 6.67 | Hydrophobic silica 1 | 0.43 |
| 43 | 95 | 30 | 4.00 | 55 | 180 | 2 | 6.67 | Hydrophobic silica 1 | 0.43 |
| 44 | 95 | 30 | 4.00 | 55 | 180 | 2 | 4.00 | Hydrophobic silica 1 | 0.43 |
| 45 | 95 | 30 | 4.00 | 55 | 180 | 2 | 8.67 | Hydrophobic silica 1 | 0.37 |

TABLE 6-2

| | Cooling step | | | | | | | | |
|---|---|---|---|---|---|---|---|---|---|
| | Cooling initiation | Cooling completion | Cooling | Annealing step | | Organosilicon polymer particle | | Inorganic fine particle | |
| Toner No. | temp. (° C.) | temp. (° C.) | speed (° C./sec) | Temp. (° C.) | Time (min) | Type (—) | Amount (patrs) | Type (—) | Amount (patrs) |
| 46 | 95 | 30 | 4.00 | 55 | 180 | 2 | 3.33 | Hydrophobic silica 1 | 0.43 |
| 47 | 95 | 30 | 4.00 | 55 | 180 | 2 | 10.00 | Hydrophobic silica 1 | 0.27 |
| 48 | 95 | 30 | 4.00 | 55 | 180 | 2 | 6.67 | Hydrophobic silica 1 | 0.37 |
| 49 | 95 | 30 | 4.00 | 55 | 180 | 2 | 6.67 | Hydrophobic silica 1 | 0.48 |
| 50 | 95 | 30 | 4.00 | 55 | 180 | 2 | 4.67 | Hydrophobic silica 1 | 0.59 |
| 51 | 95 | 30 | 4.00 | 55 | 180 | 2 | 4.00 | Hydrophobic silica 1 | 0.69 |
| 52 | 95 | 30 | 4.00 | 55 | 180 | 2 | 6.67 | Hydrophobic silica 1 | 0.27 |
| 53 | 95 | 30 | 4.00 | 55 | 180 | 2 | 8.57 | Hydrophobic silica 1 | 0.55 |
| 54 | 95 | 30 | 4.00 | 55 | 180 | 2 | 5.45 | Hydrophobic silica 1 | 0.35 |
| 55 | 95 | 30 | 4.00 | 55 | 180 | 2 | 4.00 | Hydrophobic silica 1 | 0.26 |
| 56 | 95 | 30 | 4.00 | 55 | 60 | 2 | 8.57 | Hydrophobic silica 1 | 0.55 |
| 57 | 95 | 30 | 4.00 | 55 | 360 | 2 | 6.67 | Hydrophobic silica 1 | 0.43 |
| 58 | 95 | 30 | 4.00 | 55 | 300 | 2 | 8.57 | Hydrophobic silica 1 | 0.55 |
| 59 | 95 | 30 | 4.00 | 55 | 180 | 2 | 6.67 | Hydrophobic silica 1 | 0.43 |
| 60 | 95 | 30 | 4.00 | 55 | 180 | 2 | 6.67 | Hydrophobic silica 1 | 0.43 |
| 61 | 95 | 30 | 4.00 | 55 | 180 | 1 | 4.44 | Hydrophobic silica 1 | 0.43 |
| 62 | 95 | 30 | 4.00 | 55 | 180 | 6 | 8.89 | Hydrophobic silica 1 | 0.43 |
| 63 | 95 | 30 | 4.00 | 55 | 180 | 7 | 11.11 | Hydrophobic silica 1 | 0.43 |
| 64 | 95 | 30 | 4.00 | 55 | 180 | 8 | 13.24 | Hydrophobic silica 1 | 0.43 |
| 65 | 95 | 30 | 4.00 | 55 | 180 | 3 | 2.22 | Hydrophobic silica 1 | 0.43 |
| 66 | 95 | 30 | 4.00 | 55 | 180 | 4 | 2.67 | Hydrophobic silica 1 | 0.43 |
| 67 | 95 | 30 | 4.00 | 55 | 180 | 5 | 3.56 | Hydrophobic silica 1 | 0.43 |
| 68 | 95 | 30 | 4.00 | 55 | 180 | 9 | 15.56 | Hydrophobic silica 1 | 0.43 |
| 69 | 95 | 30 | 4.00 | 55 | 180 | 3 | 2.86 | Hydrophobic silica 1 | 0.55 |
| 70 | 95 | 30 | 4.00 | 55 | 180 | 9 | 12.73 | Hydrophobic silica 1 | 0.35 |
| 71 | 95 | 30 | 4.00 | 55 | 180 | 8 | 16.00 | Hydrophobic silica 1 | 0.55 |
| 72 | 95 | 30 | 4.00 | 55 | 180 | 1 | 2.35 | Hydrophobic silica 1 | 0.23 |
| 73 | 95 | 30 | 4.00 | 55 | 180 | 10 | 6.67 | Hydrophobic silica 1 | 0.43 |
| 74 | 95 | 30 | 4.00 | 55 | 180 | 11 | 6.67 | Hydrophobic silica 1 | 0.43 |

TABLE 6-2-continued

| | Cooling step | | | | | | | | |
|---|---|---|---|---|---|---|---|---|---|
| | Cooling initiation | Cooling completion | Cooling | Annealing step | | Organosilicon polymer particle | | Inorganic fine particle | |
| Toner No. | temp. (° C.) | temp. (° C.) | speed (° C./sec) | Temp. (° C.) | Time (min) | Type (—) | Amount (patrs) | Type (—) | Amount (patrs) |
| 75 | 95 | 30 | 4.00 | 55 | 180 | 12 | 6.67 | Hydrophobic silica 1 | 0.43 |
| 76 | 95 | 30 | 4.00 | 55 | 180 | 2 | 6.67 | Hydrophobic silica 1 | 0.43 |
| 77 | 95 | 30 | 4.00 | 55 | 180 | 13 | 6.67 | Hydrophobic silica 1 | 0.43 |
| 78 | 95 | 30 | 4.00 | 55 | 180 | 14 | 6.67 | Hydrophobic silica 1 | 0.43 |
| 79 | 95 | 30 | 4.00 | 55 | 180 | 15 | 6.67 | Hydrophobic silica 1 | 0.43 |
| 80 | 95 | 30 | 4.00 | 55 | 180 | 16 | 6.67 | Hydrophobic silica 1 | 0.43 |
| 81 | 95 | 30 | 4.00 | 55 | 180 | 20 | 6.67 | Hydrophobic silica 1 | 0.43 |
| 82 | 95 | 30 | 4.00 | 55 | 180 | 21 | 6.67 | Hydrophobic silica 1 | 0.43 |
| 83 | 95 | 30 | 0.01 | 55 | 180 | 2 | 6.67 | Hydrophobic silica 1 | 0.43 |
| 84 | 95 | 30 | 10.00 | 55 | 180 | 2 | 6.67 | Hydrophobic silica 1 | 0.43 |
| 85 | 95 | 30 | 0.01 | 55 | 360 | 2 | 6.67 | Hydrophobic silica 1 | 0.43 |
| 86 | 95 | 30 | 4.00 | 55 | 180 | 2 | 6.67 | Hydrophobic silica 1 | 0.43 |
| 87 | 95 | 30 | 4.00 | 55 | 180 | 2 | 6.67 | Hydrophobic silica 1 | 0.43 |
| 88 | 95 | 30 | 4.00 | 55 | 180 | 2 | 6.67 | Hydrophobic silica 1 | 0.43 |
| 89 | 95 | 30 | 4.00 | 55 | 180 | 2 | 6.67 | Hydrophobic silica 1 | 0.43 |
| 90 | 95 | 30 | 4.00 | 55 | 180 | 22 | 6.67 | Hydrophobic silica 1 | 0.43 |

TABLE 7-1

| | Wax domains | | | Wax domain abundance ratio | | | | | | | | | | |
|---|---|---|---|---|---|---|---|---|---|---|---|---|---|---|
| Toner No. | Number of domains | Average long diameter (Dw) (μm) | SPw | 0.05 μm or less (%) | 0.10 μm or less (%) | 1.00 μm or less (%) | SPs | SPb | SPs-SPw | SPb-SPw | WAX (Mp) | (SPb-SPw)$^2$ × Mp | Spsi | \|Spsi-SPw\| |
| 1 | 5 | 1.10 | 8.85 | 10 | 30 | 70 | 10.15 | 10.15 | 1.30 | 1.3 | 595 | 1006 | 8.94 | 0.09 |
| 2 | 5 | 1.10 | 8.85 | 10 | 30 | 70 | 10.15 | 10.15 | 1.30 | 1.3 | 595 | 1006 | 8.83 | 0.02 |
| 3 | 5 | 1.10 | 8.85 | 10 | 30 | 70 | 10.15 | 10.15 | 1.30 | 1.3 | 595 | 1006 | 8.77 | 0.08 |
| 4 | 5 | 1.10 | 8.85 | 10 | 30 | 70 | 10.15 | 10.15 | 1.30 | 1.3 | 595 | 1006 | 10.31 | 1.46 |
| 5 | 5 | 1.10 | 8.85 | 10 | 30 | 70 | 10.15 | 10.15 | 1.30 | 1.3 | 595 | 1006 | 8.46 | 0.39 |
| 6 | 5 | 1.10 | 8.85 | 10 | 30 | 70 | 10.15 | 10.15 | 1.30 | 1.3 | 595 | 1006 | 9.62 | 0.77 |
| 7 | 2 | 1.10 | 8.85 | 10 | 30 | 70 | 10.15 | 10.15 | 1.30 | 1.3 | 595 | 1006 | 8.94 | 0.09 |
| 8 | 7 | 0.65 | 8.85 | 10 | 30 | 70 | 10.15 | 10.15 | 1.30 | 1.3 | 595 | 1006 | 8.94 | 0.09 |
| 9 | 10 | 0.55 | 8.85 | 10 | 30 | 70 | 10.15 | 10.15 | 1.30 | 1.3 | 595 | 1006 | 8.94 | 0.09 |
| 10 | 20 | 0.35 | 8.85 | 10 | 30 | 70 | 10.15 | 10.15 | 1.30 | 1.3 | 595 | 1006 | 8.94 | 0.09 |
| 11 | 300 | 0.08 | 8.85 | 10 | 30 | 70 | 10.04 | 9.81 | 1.19 | 0.96 | 595 | 548 | 8.94 | 0.09 |
| 12 | 1000 | 0.05 | 8.85 | 10 | 30 | 70 | 10.04 | 9.81 | 1.19 | 0.96 | 595 | 548 | 8.94 | 0.09 |
| 13 | 2000 | 0.04 | 8.85 | 10 | 40 | 80 | 10.04 | 9.81 | 1.19 | 0.96 | 595 | 548 | 8.94 | 0.09 |
| 14 | 2500 | 0.03 | 8.85 | 10 | 40 | 80 | 10.04 | 9.81 | 1.19 | 0.96 | 595 | 548 | 8.94 | 0.09 |
| 15 | 5 | 1.80 | 8.85 | 10 | 30 | 70 | 10.15 | 10.15 | 1.30 | 1.3 | 595 | 1006 | 8.94 | 0.09 |
| 16 | 5 | 0.80 | 8.85 | 10 | 30 | 70 | 10.15 | 10.15 | 1.30 | 1.3 | 595 | 1006 | 8.94 | 0.09 |
| 17 | 5 | 0.50 | 8.85 | 10 | 30 | 70 | 10.15 | 10.15 | 1.30 | 1.3 | 595 | 1006 | 8.94 | 0.09 |
| 18 | 5 | 0.30 | 8.85 | 10 | 30 | 70 | 10.15 | 10.15 | 1.30 | 1.3 | 595 | 1006 | 8.94 | 0.09 |
| 19 | 10 | 0.10 | 8.85 | 10 | 30 | 70 | 10.15 | 10.15 | 1.30 | 1.3 | 595 | 1006 | 8.94 | 0.09 |
| 20 | 5 | 1.10 | 8.97 | 10 | 30 | 70 | 10.15 | 10.15 | 1.18 | 1.18 | 1853 | 2580 | 8.94 | 0.03 |
| 21 | 5 | 1.10 | 9.01 | 10 | 30 | 70 | 10.15 | 10.15 | 1.14 | 1.14 | 1685 | 2190 | 8.94 | 0.07 |
| 22 | 5 | 1.10 | 8.90 | 10 | 30 | 70 | 10.15 | 10.15 | 1.25 | 1.25 | 2190 | 3422 | 8.94 | 0.04 |
| 23 | 5 | 1.10 | 8.93 | 10 | 30 | 70 | 10.15 | 10.15 | 1.22 | 1.22 | 1202 | 1789 | 8.94 | 0.01 |
| 24 | 5 | 1.10 | 8.87 | 10 | 30 | 70 | 10.15 | 10.15 | 1.28 | 1.28 | 1426 | 2336 | 8.94 | 0.07 |
| 25 | 5 | 1.10 | 8.83 | 10 | 30 | 70 | 10.15 | 10.15 | 1.32 | 1.32 | 751 | 1309 | 8.94 | 0.11 |
| 26 | 5 | 1.10 | 8.88 | 10 | 30 | 70 | 10.15 | 10.15 | 1.27 | 1.27 | 639 | 1031 | 8.94 | 0.06 |
| 27 | 5 | 1.10 | 8.81 | 10 | 30 | 70 | 10.15 | 10.15 | 1.34 | 1.34 | 707 | 1269 | 8.94 | 0.13 |
| 28 | 5 | 1.10 | 8.81 | 10 | 30 | 70 | 10.15 | 10.15 | 1.34 | 1.34 | 706 | 1268 | 8.94 | 0.13 |
| 29 | 5 | 1.10 | 8.77 | 10 | 30 | 70 | 10.15 | 10.15 | 1.38 | 1.38 | 819 | 1560 | 8.94 | 0.17 |
| 30 | 5 | 1.10 | 8.98 | 10 | 30 | 70 | 10.15 | 10.15 | 1.17 | 1.17 | 783 | 1072 | 8.94 | 0.04 |
| 31 | 5 | 1.10 | 8.59 | 10 | 30 | 70 | 10.15 | 10.15 | 1.56 | 1.56 | 649 | 1579 | 8.94 | 0.35 |
| 32 | 5 | 1.10 | 8.85 | 10 | 30 | 70 | 9.90 | 9.94 | 1.05 | 1.09 | 595 | 707 | 8.94 | 0.09 |
| 33 | 5 | 1.10 | 8.81 | 10 | 30 | 70 | 9.94 | 9.94 | 1.13 | 1.13 | 707 | 903 | 8.94 | 0.13 |
| 34 | 5 | 1.10 | 8.85 | 10 | 30 | 70 | 10.51 | 10.50 | 1.66 | 1.65 | 595 | 1620 | 8.94 | 0.09 |
| 35 | 5 | 1.10 | 8.59 | 10 | 30 | 70 | 10.51 | 10.50 | 1.92 | 1.91 | 649 | 2368 | 8.94 | 0.35 |
| 36 | 5 | 1.10 | 8.59 | 10 | 30 | 70 | 10.50 | 10.50 | 1.91 | 1.91 | 593 | 2163 | 8.94 | 0.35 |
| 37 | 5 | 1.10 | 8.59 | 10 | 30 | 70 | 10.80 | 10.80 | 2.21 | 2.21 | 593 | 2893 | 8.94 | 0.35 |
| 38 | 5 | 1.10 | 8.59 | 10 | 30 | 70 | 10.90 | 10.90 | 2.31 | 2.31 | 593 | 3164 | 8.94 | 0.35 |
| 39 | 5 | 1.10 | 8.85 | 10 | 30 | 70 | 11.09 | 11.10 | 2.24 | 2.25 | 595 | 3012 | 8.94 | 0.09 |
| 40 | 5 | 1.10 | 8.85 | 5 | 15 | 55 | 10.15 | 10.15 | 1.30 | 1.3 | 595 | 1006 | 8.94 | 0.09 |
| 41 | 5 | 1.10 | 8.85 | 18 | 40 | 65 | 10.15 | 10.15 | 1.30 | 1.3 | 595 | 1006 | 8.94 | 0.09 |
| 42 | 5 | 1.10 | 8.85 | 25 | 50 | 60 | 10.15 | 10.15 | 1.30 | 1.3 | 595 | 1006 | 8.94 | 0.09 |

TABLE 7-1-continued

| Toner No. | Wax domains: Number of domains | Wax domains: Average long diameter (Dw) (μm) | SPw | Wax domain abundance ratio: 0.05 μm or less (%) | Wax domain abundance ratio: 0.10 μm or less (%) | Wax domain abundance ratio: 1.00 μm or less (%) | SPs | SPb | SPs-SPw | SPb-SPw | WAX (Mp) | (SPb-SPw)$^2$ × Mp | Spsi | \|Spsi-SPw\| |
|---|---|---|---|---|---|---|---|---|---|---|---|---|---|---|
| 43 | 5 | 1.10 | 8.85 | 50 | 85 | 90 | 10.15 | 10.15 | 1.30 | 1.3 | 595 | 1006 | 8.94 | 0.09 |
| 44 | 5 | 1.10 | 8.85 | 10 | 30 | 70 | 10.15 | 10.15 | 1.30 | 1.3 | 595 | 1006 | 8.94 | 0.09 |
| 45 | 5 | 1.10 | 8.85 | 10 | 30 | 70 | 10.15 | 10.15 | 1.30 | 1.3 | 595 | 1006 | 8.94 | 0.09 |

TABLE 7-2

| Toner No. | Wax domains: Number of domains | Wax domains: Average long diameter (Dw) (μm) | SPw | Wax domain abundance ratio: 0.05 μm or less (%) | Wax domain abundance ratio: 0.10 μm or less (%) | Wax domain abundance ratio: 1.00 μm or less (%) | SPs | SPb | SPs-SPw | SPb-SPw | WAX (Mp) | (SPb-SPw)$^2$ × Mp | Spsi | \|Spsi-SPw\| |
|---|---|---|---|---|---|---|---|---|---|---|---|---|---|---|
| 46 | 5 | 1.10 | 8.85 | 10 | 30 | 70 | 10.15 | 10.15 | 1.30 | 1.3 | 595 | 1006 | 8.94 | 0.09 |
| 47 | 5 | 1.10 | 8.85 | 10 | 30 | 70 | 10.15 | 10.15 | 1.30 | 1.3 | 595 | 1006 | 8.94 | 0.09 |
| 48 | 5 | 1.10 | 8.85 | 10 | 30 | 70 | 10.15 | 10.15 | 1.30 | 1.3 | 595 | 1006 | 8.94 | 0.09 |
| 49 | 5 | 1.10 | 8.85 | 10 | 30 | 70 | 10.15 | 10.15 | 1.30 | 1.3 | 595 | 1006 | 8.94 | 0.09 |
| 50 | 5 | 1.10 | 8.85 | 10 | 30 | 70 | 10.15 | 10.15 | 1.30 | 1.3 | 595 | 1006 | 8.94 | 0.09 |
| 51 | 5 | 1.10 | 8.85 | 10 | 30 | 70 | 10.15 | 10.15 | 1.30 | 1.3 | 595 | 1006 | 8.94 | 0.09 |
| 52 | 5 | 1.10 | 8.85 | 10 | 30 | 70 | 10.15 | 10.15 | 1.30 | 1.3 | 595 | 1006 | 8.94 | 0.09 |
| 53 | 5 | 1.10 | 8.85 | 10 | 30 | 70 | 10.15 | 10.15 | 1.30 | 1.3 | 595 | 1006 | 8.94 | 0.09 |
| 54 | 5 | 1.10 | 8.85 | 10 | 30 | 70 | 10.15 | 10.15 | 1.30 | 1.3 | 595 | 1006 | 8.94 | 0.09 |
| 55 | 5 | 1.10 | 8.85 | 10 | 30 | 70 | 10.15 | 10.15 | 1.30 | 1.3 | 595 | 1006 | 8.94 | 0.09 |
| 56 | 5 | 0.18 | 8.85 | 10 | 30 | 70 | 10.15 | 10.15 | 1.30 | 1.3 | 595 | 1006 | 8.94 | 0.09 |
| 57 | 5 | 1.95 | 8.85 | 10 | 30 | 70 | 10.15 | 10.15 | 1.30 | 1.3 | 595 | 1006 | 8.94 | 0.09 |
| 58 | 5 | 1.80 | 8.85 | 10 | 30 | 70 | 10.15 | 10.15 | 1.30 | 1.3 | 595 | 1006 | 8.94 | 0.09 |
| 59 | 5 | 1.10 | 8.85 | 10 | 30 | 70 | 10.15 | 10.15 | 1.30 | 1.3 | 595 | 1006 | 8.94 | 0.09 |
| 60 | 5 | 1.10 | 8.85 | 10 | 30 | 70 | 10.15 | 10.15 | 1.30 | 1.3 | 595 | 1006 | 8.94 | 0.09 |
| 61 | 5 | 1.10 | 8.85 | 10 | 30 | 70 | 10.15 | 10.15 | 1.30 | 1.3 | 595 | 1006 | 8.94 | 0.09 |
| 62 | 5 | 1.10 | 8.85 | 10 | 30 | 70 | 10.15 | 10.15 | 1.30 | 1.3 | 595 | 1006 | 8.94 | 0.09 |
| 63 | 5 | 1.10 | 8.85 | 10 | 30 | 70 | 10.15 | 10.15 | 1.30 | 1.3 | 595 | 1006 | 8.94 | 0.09 |
| 64 | 5 | 1.10 | 8.85 | 10 | 30 | 70 | 10.15 | 10.15 | 1.30 | 1.3 | 595 | 1006 | 8.94 | 0.09 |
| 65 | 5 | 1.10 | 8.85 | 10 | 30 | 70 | 10.15 | 10.15 | 1.30 | 1.3 | 595 | 1006 | 8.94 | 0.09 |
| 66 | 5 | 1.10 | 8.85 | 10 | 30 | 70 | 10.15 | 10.15 | 1.30 | 1.3 | 595 | 1006 | 8.94 | 0.09 |
| 67 | 5 | 1.10 | 8.85 | 10 | 30 | 70 | 10.15 | 10.15 | 1.30 | 1.3 | 595 | 1006 | 8.94 | 0.09 |
| 68 | 5 | 1.10 | 8.85 | 10 | 30 | 70 | 10.15 | 10.15 | 1.30 | 1.3 | 595 | 1006 | 8.94 | 0.09 |
| 69 | 5 | 1.10 | 8.85 | 10 | 30 | 70 | 10.15 | 10.15 | 1.30 | 1.3 | 595 | 1006 | 8.94 | 0.09 |
| 70 | 5 | 1.10 | 8.85 | 10 | 30 | 70 | 10.15 | 10.15 | 1.30 | 1.3 | 595 | 1006 | 8.94 | 0.09 |
| 71 | 5 | 1.10 | 8.85 | 10 | 30 | 70 | 10.15 | 10.15 | 1.30 | 1.3 | 595 | 1006 | 8.94 | 0.09 |
| 72 | 5 | 1.10 | 8.85 | 10 | 30 | 70 | 10.15 | 10.15 | 1.30 | 1.3 | 595 | 1006 | 8.94 | 0.09 |
| 73 | 5 | 1.10 | 8.85 | 10 | 30 | 70 | 10.15 | 10.15 | 1.30 | 1.3 | 595 | 1006 | 8.94 | 0.09 |
| 74 | 5 | 1.10 | 8.85 | 10 | 30 | 70 | 10.15 | 10.15 | 1.30 | 1.3 | 595 | 1006 | 8.94 | 0.09 |
| 75 | 5 | 1.10 | 8.85 | 10 | 30 | 70 | 10.15 | 10.15 | 1.30 | 1.3 | 595 | 1006 | 8.94 | 0.09 |
| 76 | 5 | 1.10 | 8.85 | 10 | 30 | 70 | 10.04 | 10.04 | 1.19 | 1.19 | 595 | 843 | 8.94 | 0.09 |
| 77 | 5 | 1.10 | 8.85 | 10 | 30 | 70 | 10.15 | 10.15 | 1.30 | 1.3 | 595 | 1006 | 8.94 | 0.09 |
| 78 | 5 | 1.10 | 8.85 | 10 | 30 | 70 | 10.15 | 10.15 | 1.30 | 1.3 | 595 | 1006 | 8.94 | 0.09 |
| 79 | 5 | 1.10 | 8.85 | 10 | 30 | 70 | 10.15 | 10.15 | 1.30 | 1.3 | 595 | 1006 | 8.94 | 0.09 |
| 80 | 5 | 1.10 | 8.85 | 10 | 30 | 70 | 10.15 | 10.15 | 1.30 | 1.3 | 595 | 1006 | 8.94 | 0.09 |
| 81 | 5 | 1.10 | 8.85 | 10 | 30 | 70 | 10.15 | 10.15 | 1.30 | 1.3 | 595 | 1006 | 8.83 | 0.02 |
| 82 | 5 | 1.10 | 8.85 | 10 | 30 | 70 | 10.15 | 10.15 | 1.30 | 1.3 | 595 | 1006 | 8.06 | 0.79 |
| 83 | 1 | 2.00 | 8.85 | 1 | 3 | 40 | 10.15 | 10.15 | 1.30 | 1.3 | 595 | 1006 | 8.94 | 0.09 |
| 84 | 2000 | 1.10 | 8.85 | 10 | 30 | 70 | 10.15 | 10.15 | 1.30 | 1.3 | 595 | 1006 | 8.94 | 0.09 |
| 85 | 2 | 2.50 | 8.85 | 10 | 30 | 70 | 10.15 | 10.15 | 1.30 | 1.3 | 595 | 1006 | 8.94 | 0.09 |
| 86 | 5 | 1.10 | 8.22 | 10 | 30 | 70 | 10.15 | 10.15 | 1.93 | 1.93 | 381 | 1419 | 8.94 | 0.72 |
| 87 | 5 | 1.10 | 8.28 | 10 | 30 | 70 | 10.15 | 10.15 | 1.87 | 1.87 | 469 | 1640 | 8.94 | 0.66 |
| 88 | 5 | 1.10 | 8.39 | 10 | 30 | 70 | 10.15 | 10.15 | 1.76 | 1.76 | 771 | 2388 | 8.94 | 0.55 |
| 89 | 5 | 1.10 | 9.03 | 10 | 30 | 70 | 10.15 | 10.15 | 1.12 | 1.12 | 978 | 1227 | 8.94 | 0.09 |
| 90 | 5 | 1.10 | 8.85 | 10 | 30 | 70 | 10.15 | 10.15 | 1.30 | 1.3 | 595 | 1006 | 8.21 | 0.64 |
| 91 | 3500 | 0.01 | 8.85 | 95 | 100 | 100 | 10.15 | 10.15 | 1.30 | 1.3 | 595 | 1006 | 8.94 | 0.09 |

TABLE 8-1

| | Particle diameter | | | | Organosilicon polymer particle | | | | | Inorganic fine particle | | Toner | Average |
|---|---|---|---|---|---|---|---|---|---|---|---|---|---|
| Toner No. | Dt (μm) | Dw/Dt (—) | Dsi (nm) | Dsi/Dt (—) | SF-1 | Type (—) | Hydrophobicity (%) | Amount (parts) | Coverage ratio (%) | Amount (parts) | Coverage ratio (%) | Tg (° C.) | circularity (—) |
| 1 | 4.5 | 0.24 | 150 | 0.0333 | 110 | 2 | 55 | 6.67 | 50 | 0.43 | 40 | 53 | 0.965 |
| 2 | 4.5 | 0.24 | 150 | 0.0333 | 110 | 17 | 55 | 6.67 | 50 | 0.43 | 40 | 53 | 0.965 |
| 3 | 4.5 | 0.24 | 150 | 0.0333 | 110 | 18 | 55 | 6.67 | 50 | 0.43 | 40 | 53 | 0.965 |
| 4 | 4.5 | 0.24 | 150 | 0.0333 | 110 | 19 | 55 | 6.67 | 50 | 0.43 | 40 | 53 | 0.965 |
| 5 | 4.5 | 0.24 | 150 | 0.0333 | 110 | 23 | 55 | 6.67 | 50 | 0.43 | 40 | 53 | 0.965 |
| 6 | 4.5 | 0.24 | 150 | 0.0333 | 110 | 24 | 55 | 6.67 | 50 | 0.43 | 40 | 53 | 0.965 |
| 7 | 4.5 | 0.24 | 150 | 0.0333 | 110 | 2 | 55 | 6.67 | 50 | 0.43 | 40 | 53 | 0.965 |
| 8 | 4.5 | 0.14 | 150 | 0.0333 | 110 | 2 | 55 | 6.67 | 50 | 0.43 | 40 | 53 | 0.965 |
| 9 | 4.5 | 0.12 | 150 | 0.0333 | 110 | 2 | 55 | 6.67 | 50 | 0.43 | 40 | 53 | 0.965 |
| 10 | 4.5 | 0.08 | 150 | 0.0333 | 110 | 2 | 55 | 6.67 | 50 | 0.43 | 40 | 53 | 0.965 |
| 11 | 5.1 | 0.02 | 150 | 0.0294 | 110 | 2 | 55 | 5.88 | 50 | 0.38 | 40 | 53 | 0.980 |
| 12 | 5.1 | 0.01 | 150 | 0.0294 | 110 | 2 | 55 | 5.88 | 50 | 0.38 | 40 | 53 | 0.980 |
| 13 | 5.1 | 0.01 | 150 | 0.0294 | 110 | 2 | 55 | 5.88 | 50 | 0.38 | 40 | 53 | 0.980 |
| 14 | 5.1 | 0.01 | 150 | 0.0294 | 110 | 2 | 55 | 5.88 | 50 | 0.38 | 40 | 53 | 0.980 |
| 15 | 4.5 | 0.40 | 150 | 0.0333 | 110 | 2 | 55 | 6.67 | 50 | 0.43 | 40 | 53 | 0.965 |
| 16 | 4.5 | 0.18 | 150 | 0.0333 | 110 | 2 | 55 | 6.67 | 50 | 0.43 | 40 | 53 | 0.965 |
| 17 | 4.5 | 0.11 | 150 | 0.0333 | 110 | 2 | 55 | 6.67 | 50 | 0.43 | 40 | 53 | 0.965 |
| 18 | 4.5 | 0.07 | 150 | 0.0333 | 110 | 2 | 55 | 6.67 | 50 | 0.43 | 40 | 53 | 0.965 |
| 19 | 4.5 | 0.02 | 150 | 0.0333 | 110 | 2 | 55 | 6.67 | 50 | 0.43 | 40 | 53 | 0.965 |
| 20 | 4.5 | 0.24 | 150 | 0.0333 | 110 | 2 | 55 | 6.67 | 50 | 0.43 | 40 | 53 | 0.965 |
| 21 | 4.5 | 0.24 | 150 | 0.0333 | 110 | 2 | 55 | 6.67 | 50 | 0.43 | 40 | 53 | 0.965 |
| 22 | 4.5 | 0.24 | 150 | 0.0333 | 110 | 2 | 55 | 6.67 | 50 | 0.43 | 40 | 53 | 0.965 |
| 23 | 4.5 | 0.24 | 150 | 0.0333 | 110 | 2 | 55 | 6.67 | 50 | 0.43 | 40 | 53 | 0.965 |
| 24 | 4.5 | 0.24 | 150 | 0.0333 | 110 | 2 | 55 | 6.67 | 50 | 0.43 | 40 | 53 | 0.965 |
| 25 | 4.5 | 0.24 | 150 | 0.0333 | 110 | 2 | 55 | 6.67 | 50 | 0.43 | 40 | 53 | 0.965 |
| 26 | 4.5 | 0.24 | 150 | 0.0333 | 110 | 2 | 55 | 6.67 | 50 | 0.43 | 40 | 53 | 0.965 |
| 27 | 4.5 | 0.24 | 150 | 0.0333 | 110 | 2 | 55 | 6.67 | 50 | 0.43 | 40 | 53 | 0.965 |
| 28 | 4.5 | 0.24 | 150 | 0.0333 | 110 | 2 | 55 | 6.67 | 50 | 0.43 | 40 | 53 | 0.965 |
| 29 | 4.5 | 0.24 | 150 | 0.0333 | 110 | 2 | 55 | 6.67 | 50 | 0.43 | 40 | 53 | 0.965 |
| 30 | 4.5 | 0.24 | 150 | 0.0333 | 110 | 2 | 55 | 6.67 | 50 | 0.43 | 40 | 53 | 0.965 |
| 31 | 4.5 | 0.24 | 150 | 0.0333 | 110 | 2 | 55 | 6.67 | 50 | 0.43 | 40 | 53 | 0.965 |
| 32 | 4.5 | 0.24 | 150 | 0.0333 | 110 | 2 | 55 | 6.67 | 50 | 0.43 | 40 | 53 | 0.965 |
| 33 | 4.5 | 0.24 | 150 | 0.0333 | 110 | 2 | 55 | 6.67 | 50 | 0.43 | 40 | 53 | 0.965 |
| 34 | 4.5 | 0.24 | 150 | 0.0333 | 110 | 2 | 55 | 6.67 | 50 | 0.43 | 40 | 53 | 0.965 |
| 35 | 4.5 | 0.24 | 150 | 0.0333 | 110 | 2 | 55 | 6.67 | 50 | 0.43 | 40 | 53 | 0.965 |
| 36 | 4.5 | 0.24 | 150 | 0.0333 | 110 | 2 | 55 | 6.67 | 50 | 0.43 | 40 | 53 | 0.965 |
| 37 | 4.5 | 0.24 | 150 | 0.0333 | 110 | 2 | 55 | 6.67 | 50 | 0.43 | 40 | 53 | 0.965 |
| 38 | 4.5 | 0.24 | 150 | 0.0333 | 110 | 2 | 55 | 6.67 | 50 | 0.43 | 40 | 53 | 0.965 |
| 39 | 4.5 | 0.24 | 150 | 0.0333 | 110 | 2 | 55 | 6.67 | 50 | 0.43 | 40 | 53 | 0.965 |
| 40 | 4.5 | 0.24 | 150 | 0.0333 | 110 | 2 | 55 | 6.67 | 50 | 0.43 | 40 | 53 | 0.965 |
| 41 | 4.5 | 0.24 | 150 | 0.0333 | 110 | 2 | 55 | 6.67 | 50 | 0.43 | 40 | 53 | 0.965 |
| 42 | 4.5 | 0.24 | 150 | 0.0333 | 110 | 2 | 55 | 6.67 | 50 | 0.43 | 40 | 53 | 0.965 |
| 43 | 4.5 | 0.24 | 150 | 0.0333 | 110 | 2 | 55 | 6.67 | 50 | 0.43 | 40 | 53 | 0.965 |
| 44 | 4.5 | 0.24 | 150 | 0.0333 | 110 | 2 | 55 | 4.00 | 30 | 0.43 | 40 | 53 | 0.965 |
| 45 | 4.5 | 0.24 | 150 | 0.0333 | 110 | 2 | 55 | 8.67 | 65 | 0.37 | 35 | 53 | 0.965 |

TABLE 8-2

| | Particle diameter | | | | Organosilicon polymer particle | | | | | Inorganic fine particle | | Toner | Average |
|---|---|---|---|---|---|---|---|---|---|---|---|---|---|
| Toner No. | Dt (μm) | Dw/Dt (—) | Dsi (nm) | Dsi/Dt (—) | SF1 | Type (—) | Hydrophobicity (%) | Amount (parts) | Coverage ratio (%) | Amount (parts) | Coverage ratio (%) | Tg (° C.) | circularity (—) |
| 46 | 4.5 | 0.24 | 150 | 0.0333 | 110 | 2 | 55 | 3.33 | 25 | 0.43 | 40 | 53 | 0.965 |
| 47 | 4.5 | 0.24 | 150 | 0.0333 | 110 | 2 | 55 | 10.00 | 75 | 0.27 | 25 | 53 | 0.965 |
| 48 | 4.5 | 0.24 | 150 | 0.0333 | 110 | 2 | 55 | 6.67 | 50 | 0.37 | 35 | 53 | 0.965 |
| 49 | 4.5 | 0.24 | 150 | 0.0333 | 110 | 2 | 55 | 6.67 | 50 | 0.48 | 45 | 53 | 0.965 |
| 50 | 4.5 | 0.24 | 150 | 0.0333 | 110 | 2 | 55 | 4.67 | 35 | 0.59 | 55 | 53 | 0.965 |
| 51 | 4.5 | 0.24 | 150 | 0.0333 | 110 | 2 | 55 | 4.00 | 30 | 0.69 | 65 | 53 | 0.965 |
| 52 | 4.5 | 0.24 | 150 | 0.0333 | 110 | 2 | 55 | 6.67 | 50 | 0.27 | 25 | 53 | 0.965 |
| 53 | 3.5 | 0.31 | 150 | 0.0429 | 110 | 2 | 55 | 8.57 | 50 | 0.55 | 40 | 53 | 0.965 |
| 54 | 5.5 | 0.20 | 150 | 0.0273 | 110 | 2 | 55 | 5.45 | 50 | 0.35 | 40 | 53 | 0.965 |
| 55 | 7.5 | 0.15 | 150 | 0.0200 | 110 | 2 | 55 | 4.00 | 50 | 0.26 | 40 | 53 | 0.965 |
| 56 | 3.5 | 0.05 | 150 | 0.0429 | 110 | 2 | 55 | 8.57 | 50 | 0.55 | 40 | 53 | 0.965 |
| 57 | 4.5 | 0.43 | 150 | 0.0333 | 110 | 2 | 55 | 6.67 | 50 | 0.43 | 40 | 53 | 0.965 |
| 58 | 3.5 | 0.51 | 150 | 0.0429 | 110 | 2 | 55 | 8.57 | 50 | 0.55 | 40 | 53 | 0.965 |
| 59 | 4.5 | 0.24 | 150 | 0.0333 | 110 | 2 | 55 | 6.67 | 50 | 0.43 | 40 | 53 | 0.965 |
| 60 | 4.5 | 0.24 | 150 | 0.0333 | 110 | 2 | 55 | 6.67 | 50 | 0.43 | 40 | 53 | 0.965 |
| 61 | 4.5 | 0.24 | 100 | 0.0222 | 110 | 1 | 55 | 4.44 | 50 | 0.43 | 40 | 53 | 0.965 |
| 62 | 4.5 | 0.24 | 200 | 0.0444 | 110 | 6 | 55 | 8.89 | 50 | 0.43 | 40 | 53 | 0.965 |
| 63 | 4.5 | 0.24 | 250 | 0.0556 | 110 | 7 | 55 | 11.11 | 50 | 0.43 | 40 | 53 | 0.965 |

TABLE 8-2-continued

| | Particle diameter | | | | Organosilicon polymer particle | | | | | Inorganic fine particle | | Toner | Average |
|---|---|---|---|---|---|---|---|---|---|---|---|---|---|
| Toner No. | Dt (μm) | Dw/Dt (—) | Dsi (nm) | Dsi/Dt (—) | SF1 | Type (—) | Hydrophobicity (%) | Amount (parts) | Coverage ratio (%) | Amount (parts) | Coverage ratio (%) | Tg (° C.) | circularity (—) |
| 64 | 4.5 | 0.24 | 300 | 0.0667 | 110 | 8 | 55 | 13.34 | 50 | 0.43 | 40 | 53 | 0.965 |
| 65 | 4.5 | 0.24 | 50 | 0.0111 | 110 | 3 | 55 | 2.22 | 50 | 0.43 | 40 | 53 | 0.965 |
| 66 | 4.5 | 0.24 | 60 | 0.0133 | 110 | 4 | 55 | 2.67 | 50 | 0.43 | 40 | 53 | 0.965 |
| 67 | 4.5 | 0.24 | 80 | 0.0178 | 110 | 5 | 55 | 3.56 | 50 | 0.43 | 40 | 53 | 0.965 |
| 68 | 4.5 | 0.24 | 350 | 0.0778 | 110 | 9 | 55 | 15.56 | 50 | 0.43 | 40 | 53 | 0.965 |
| 69 | 3.5 | 0.31 | 50 | 0.0143 | 110 | 3 | 55 | 2.86 | 50 | 0.55 | 40 | 53 | 0.965 |
| 70 | 5.5 | 0.20 | 350 | 0.0636 | 110 | 9 | 55 | 12.73 | 50 | 0.35 | 40 | 53 | 0.965 |
| 71 | 3.5 | 0.31 | 300 | 0.0857 | 110 | 8 | 55 | 17.14 | 50 | 0.55 | 40 | 53 | 0.965 |
| 72 | 8.5 | 0.13 | 100 | 0.0118 | 110 | 1 | 55 | 2.35 | 50 | 0.23 | 40 | 53 | 0.965 |
| 73 | 4.5 | 0.24 | 150 | 0.0333 | 105 | 2 | 55 | 6.67 | 50 | 0.43 | 40 | 53 | 0.965 |
| 74 | 4.5 | 0.24 | 150 | 0.0333 | 118 | 2 | 55 | 6.67 | 50 | 0.43 | 40 | 53 | 0.965 |
| 75 | 4.5 | 0.24 | 150 | 0.0333 | 125 | 2 | 55 | 6.67 | 50 | 0.43 | 40 | 53 | 0.965 |
| 76 | 4.5 | 0.24 | 150 | 0.0333 | 110 | 2 | 55 | 6.67 | 50 | 0.43 | 40 | 53 | 0.961 |
| 77 | 4.5 | 0.24 | 150 | 0.0333 | 110 | 2 | 65 | 6.67 | 50 | 0.43 | 40 | 53 | 0.965 |
| 78 | 4.5 | 0.24 | 150 | 0.0333 | 110 | 2 | 50 | 6.67 | 50 | 0.43 | 40 | 53 | 0.965 |
| 79 | 4.5 | 0.24 | 150 | 0.0333 | 110 | 2 | 46 | 6.67 | 50 | 0.43 | 40 | 53 | 0.965 |
| 80 | 4.5 | 0.24 | 150 | 0.0333 | 110 | 2 | 55 | 6.67 | 50 | 0.43 | 40 | 53 | 0.965 |
| 81 | 4.5 | 0.24 | 150 | 0.0333 | 110 | 20 | 55 | 6.67 | 50 | 0.43 | 40 | 53 | 0.965 |
| 82 | 4.5 | 0.24 | 150 | 0.0333 | 110 | 21 | 55 | 6.67 | 50 | 0.43 | 40 | 53 | 0.965 |
| 83 | 4.5 | 0.44 | 150 | 0.0333 | 110 | 2 | 55 | 6.67 | 50 | 0.43 | 40 | 53 | 0.965 |
| 84 | 4.5 | 0.002 | 150 | 0.0333 | 110 | 2 | 55 | 6.67 | 50 | 0.43 | 40 | 53 | 0.965 |
| 85 | 4.5 | 0.56 | 150 | 0.0333 | 110 | 2 | 55 | 6.67 | 50 | 0.43 | 40 | 53 | 0.965 |
| 86 | 4.5 | 0.24 | 150 | 0.0333 | 110 | 2 | 55 | 6.67 | 50 | 0.43 | 40 | 53 | 0.965 |
| 87 | 4.5 | 0.24 | 150 | 0.0333 | 110 | 2 | 55 | 6.67 | 50 | 0.43 | 40 | 53 | 0.965 |
| 88 | 4.5 | 0.24 | 150 | 0.0333 | 110 | 2 | 55 | 6.67 | 50 | 0.43 | 40 | 53 | 0.965 |
| 89 | 4.5 | 0.24 | 150 | 0.0333 | 110 | 2 | 55 | 6.67 | 50 | 0.43 | 40 | 53 | 0.965 |
| 90 | 4.5 | 0.24 | 150 | 0.0333 | 110 | 22 | 55 | 6.67 | 50 | 0.43 | 40 | 53 | 0.965 |
| 91 | 4.5 | 0.002 | 150 | 0.0333 | 110 | 2 | 55 | 6.67 | 50 | 0.43 | 40 | 53 | 0.965 |

Dt: Number-average particle diameter (D1) of toner
Dw: Average long diameter of wax domains
Dsi: Number-average particle diameter of organosilicon polymer particle

Examples 1 to 82

Image evaluations were performed on the Toners 1 to 82 using the corresponding evaluation units. The evaluation results are shown in Tables 9-1 and 9-2.

Comparative Examples 1 to 9

Image evaluations were performed on the Toners 83 to 91 using the corresponding evaluation units. The evaluation results are shown in Tables 9-1 and 9-2.

Toner Evaluation

A Canon LBP652C laser beam printer was modified to allow the fixing temperature and process speed to be adjusted, and the following evaluations were performed.

Fogging

Fogging was measured using the evaluation unit described below as the image-forming apparatus, which was left for 6 days in each of the following environments after being used in an endurance test in which 13,000 sheets were printed in each environment at a print percentage of 1% with a one-minute pause between each two sheets.

Normal temperature, normal humidity (N/N): 25.0° C., 60% RH

High temperature, high humidity (H/H): 32.5° C., 85% RH

Low temperature, low humidity (L/L): 10.0° C., 10% RH

The amount of image fogging on the first image sample after the printout was then measured with a Tokyo Denshoku Reflect Meter Model TC-6DS, and calculated according to the following formula. A4 size normal paper (Canon Marketing Japan, GF-C081A4) was used as the recording material in the endurance test.

Fogging (%)=(whiteness of recording material before printout)−(whiteness of non-image part (white part) of recording material after printout)

Fixing Performance

Using the evaluation unit described below in a low-temperature, low-humidity environment (SL/L: 5° C., 10% RH), the machine was turned on after it and a cartridge filled with the toner had been left to acclimatize to the environment (left for 24 hours in the environment). Immediately after the waiting period a 200 micron wide horizontal line pattern (horizontal width 200 μm, spacing 200 μm) was printed out, and the 50th printed image was used to evaluate fixing performance. The fixing performance evaluation was performed by rubbing the image 5 times back and forth with Silbon paper under 100 g of load, and evaluating abrasion of the image in terms of the average decrease (%) in reflection density.

Bond paper with a surface smoothness of not more than 10 (sec) was used for the evaluation. The evaluation standard is shown below. Reflection density was measured using a Tokyo Denshoku Reflect Meter Model TC-6DS. A density decrease of less than 15% (B or A) is considered good.

A: Density decrease less than 5%

B: Density decrease at least 5%/0 and less than 15%

C: Density decrease at least 15%

Toner Melt Adhesion and Fixing Adhesion

Melt adhesion and fixing of the toner to the toner carrying member and toner layer thickness control member were evaluated using the evaluation unit described below in a high-temperature, high humidity environment (H/H: 32.5° C., 80% RH), and a severe high temperature, high-humidity environment (SH/H: 35.0° C., 85% RH). An endurance test was performed at a print percentage of 1% with a one-minute pause between each two sheets, and the 8,000th sheet was used as an image sample to visually evaluate the occurrence of streaks due to melt adhesion and fixing. A4 sized normal paper (Canon Marketing Japan, GF-C081A4) was used as the recording material. The evaluation standard is shown below. A rank of B or more is considered good.

A: No streaks due to melt adhesion or fixing on image

B: 1 to 3 slight streaks due to melt adhesion or fixing on edge of image

C: 4 or more streaks due to melt adhesion or fixing on edge of image

Offset Resistance

Offset resistance was evaluated using the following evaluation unit in a low-temperature, low-humidity (L/L: 10° C., 10% RH) environment and a severe low-temperature, low-humidity environment (SL/L: 0° C., 10% RH). The machine was turned on after it and a cartridge filled with the toner had been left to acclimatize to the environment (left for 24 hours in the environment), and immediately after the waiting period 100 sheets of a full-page solid image were printed, and the number of pages with offset was evaluated.

OHP film (CG3700, Sumitomo 3M) was used for the evaluation. The evaluation standard is shown below. A rank of C or better is considered good.

A: No offset

B: Offset on 1 or 2 sheets

C: Offset on 3 or 4 sheets

D: Offset on at least 5 sheets

Filming on Latent Image Carrying Member

Filming on the latent image carrying member was evaluated in a low-temperature, low-humidity environment (L/L: 10° C., 10 RH) and a severe low-temperature, low-humidity environment (SL/L: 0° C., 10%6 RH) by performing an endurance test of continuous printing with a print percentage of 1% with the evaluation unit described below. Filming was evaluated visually on the 2,000th sheet as the image sample. A4 size normal paper (Canon Marketing Japan GF-C081A4) was used as the recording material. The evaluation standard is shown below. A rank of B or more is considered good.

A: No filming

B: Slight occurrence of roughly 2 mm vertical lines

C: Occurrence of many roughly 5 mm vertical lines

Image Density

Initial image density was evaluated in a severe high-temperature, high-humidity environment (SH/H: 35.0° C., 85% RH) using the evaluation unit described below by printing 1 sheet of a full-page solid chart with a toner laid-on level of 0.38 (mg/cm$^2$) on paper, and measuring the image density of each image. The density of the image samples was measured with a Tokyo Denshoku Reflect Meter Model TC-6DS. A4 size normal paper (Canon Marketing Japan GF-C081A4) was used as the recording material.

Storage Stability

The storage stability of the toner was evaluated by weighing 10 g of toner into a 100 mL resin cup, leaving it for 3 days in a thermostatic tank at 50° C. or 55° C., and passing it through a #200 mesh. A powder tester (Hosokawa Micron) equipped with a digital vibration meter (Digital Vibration Meter Model 1332, Showa Sokki Corporation) was used as the measurement apparatus.

As the measurement method, the toner to be evaluated was placed on a set #200 mesh sieve, the displacement of the digital vibration meter was adjusted to 0.50 mm (peak-to-peak), and vibration was applied for 30 seconds. Storage stability was then evaluated based on the condition of toner aggregations remaining on each sieve. The evaluation standard is shown below. A rank of B or more is considered good.

A: Less than 1.0 g of toner remaining on mesh

B: At least 1.0 g and less than 2.5 g of toner remaining on mesh

C: At least 2.5 g of toner remaining on mesh

Evaluation Unit

A Canon LBP652 laser beam printer was modified so that the fixing temperature and process speed could be adjusted, and used in the evaluations.

TABLE 9-1

| | Toner | Fogging | | | Image | Filming | | Fixing | Offset resistance | | Melt adhesion and fixing adhesion | | Storage stability | |
|---|---|---|---|---|---|---|---|---|---|---|---|---|---|---|
| | No. | N/N | H/H | L/L | density | L/L | SL/L | performance | L/L | SL/L | H/H | SH/H | 50° C. | 55° C. |
| Example 1 | 1 | 0.2 | 0.2 | 0.2 | 1.45 | A | A | 5 | A | A | A | A | A | A |
| Example 2 | 2 | 0.2 | 0.3 | 0.2 | 1.43 | A | A | 6 | A | A | A | A | A | A |
| Example 3 | 3 | 0.2 | 0.2 | 0.2 | 1.45 | A | A | 6 | A | A | A | A | A | A |
| Example 4 | 4 | 0.4 | 0.4 | 0.4 | 1.43 | A | A | 8 | A | A | A | A | A | A |
| Example 5 | 5 | 0.2 | 0.3 | 0.2 | 1.45 | A | A | 6 | A | A | A | A | A | A |
| Example 6 | 6 | 0.2 | 0.4 | 0.2 | 1.45 | A | A | 7 | A | A | A | A | A | A |
| Example 7 | 7 | 0.2 | 0.2 | 0.2 | 1.45 | A | A | 5 | A | A | A | A | A | A |
| Example 8 | 8 | 0.2 | 0.2 | 0.2 | 1.45 | A | A | 5 | A | A | A | A | A | A |
| Example 9 | 9 | 0.2 | 0.2 | 0.2 | 1.45 | A | A | 5 | A | A | A | A | A | A |
| Example 10 | 10 | 0.2 | 0.3 | 0.2 | 1.45 | A | A | 5 | A | A | A | A | A | A |
| Example 11 | 11 | 0.2 | 0.3 | 0.2 | 1.44 | A | A | 5 | A | A | A | A | A | A |
| Example 12 | 12 | 0.2 | 0.3 | 0.2 | 1.44 | A | A | 5 | A | A | A | A | A | A |
| Example 13 | 13 | 0.2 | 0.3 | 0.2 | 1.44 | A | A | 5 | A | A | A | A | A | A |
| Example 14 | 14 | 0.2 | 0.4 | 0.2 | 1.43 | A | A | 5 | A | B | A | A | A | A |
| Example 15 | 15 | 0.2 | 0.2 | 0.2 | 1.45 | A | A | 5 | A | A | A | A | A | A |
| Example 16 | 16 | 0.2 | 0.2 | 0.2 | 1.45 | A | A | 5 | A | A | A | A | A | A |
| Example 17 | 17 | 0.2 | 0.2 | 0.2 | 1.45 | A | A | 5 | A | A | A | A | A | A |
| Example 18 | 18 | 0.2 | 0.3 | 0.2 | 1.45 | A | A | 5 | A | A | A | A | A | A |
| Example 19 | 19 | 0.2 | 0.3 | 0.2 | 1.44 | A | A | 5 | A | A | A | A | A | A |
| Example 20 | 20 | 0.2 | 0.3 | 0.2 | 1.43 | A | A | 5 | A | A | A | A | A | A |
| Example 21 | 21 | 0.2 | 0.4 | 0.2 | 1.45 | A | A | 5 | A | A | A | A | A | A |
| Example 22 | 22 | 0.2 | 0.2 | 0.2 | 1.45 | A | A | 10 | A | A | A | A | A | A |
| Example 23 | 23 | 0.2 | 0.3 | 0.2 | 1.43 | A | A | 5 | A | A | A | A | A | A |
| Example 24 | 24 | 0.2 | 0.2 | 0.2 | 1.45 | A | A | 5 | A | A | A | A | A | A |
| Example 25 | 25 | 0.2 | 0.2 | 0.2 | 1.45 | A | A | 5 | A | A | A | A | A | A |
| Example 26 | 26 | 0.2 | 0.3 | 0.2 | 1.45 | A | A | 5 | A | A | A | A | A | A |
| Example 27 | 27 | 0.2 | 0.2 | 0.2 | 1.45 | A | A | 5 | A | A | A | A | A | A |

TABLE 9-1-continued

| | Toner | Fogging | | | Image | Filming | | Fixing | Offset resistance | | Melt adhesion and fixing adhesion | | Storage stability | |
|---|---|---|---|---|---|---|---|---|---|---|---|---|---|---|
| | No. | N/N | H/H | L/L | density | L/L | SL/L | performance | L/L | SL/L | H/H | SH/H | 50° C. | 55° C. |
| Example 28 | 28 | 0.2 | 0.2 | 0.2 | 1.45 | A | A | 5 | A | A | A | A | A | A |
| Example 29 | 29 | 0.2 | 0.2 | 0.2 | 1.45 | A | A | 5 | A | A | A | A | A | A |
| Example 30 | 30 | 0.2 | 0.3 | 0.2 | 1.45 | A | A | 5 | A | A | A | A | A | A |
| Example 31 | 31 | 0.2 | 0.2 | 0.2 | 1.45 | A | A | 5 | A | A | A | A | A | A |
| Example 32 | 32 | 0.2 | 0.4 | 0.2 | 1.45 | A | A | 5 | A | A | A | A | A | A |
| Example 33 | 33 | 0.2 | 0.3 | 0.2 | 1.45 | A | A | 5 | A | A | A | A | A | A |
| Example 34 | 34 | 0.2 | 0.2 | 0.2 | 1.45 | A | A | 5 | A | A | A | A | A | A |
| Example 35 | 35 | 0.2 | 0.2 | 0.2 | 1.45 | A | A | 5 | A | A | A | A | A | A |
| Example 36 | 36 | 0.2 | 0.2 | 0.2 | 1.45 | A | A | 5 | A | A | A | A | A | A |
| Example 37 | 37 | 0.2 | 0.2 | 0.2 | 1.45 | A | A | 5 | A | A | A | A | A | A |
| Example 38 | 38 | 0.2 | 0.4 | 0.2 | 1.45 | A | A | 10 | A | A | A | A | A | A |
| Example 39 | 39 | 0.2 | 0.2 | 0.2 | 1.45 | A | A | 10 | A | A | A | A | A | A |
| Example 40 | 40 | 0.2 | 0.2 | 0.2 | 1.43 | A | A | 7 | A | A | A | A | A | A |
| Example 41 | 41 | 0.2 | 0.2 | 0.2 | 1.45 | A | A | 5 | A | A | A | A | A | A |
| Example 42 | 42 | 0.2 | 0.3 | 0.2 | 1.45 | A | A | 5 | A | A | A | A | A | A |
| Example 43 | 43 | 0.5 | 0.5 | 0.5 | 1.41 | A | A | 5 | A | A | A | B | A | A |
| Example 44 | 44 | 0.2 | 0.3 | 0.2 | 1.45 | A | A | 5 | A | A | A | A | A | A |
| Example 45 | 45 | 0.2 | 0.2 | 0.2 | 1.45 | A | A | 6 | A | A | A | A | A | A |

TABLE 9.2

| | Toner | Fogging | | | Image | Filming | | Fixing | Offset resistance | | Melt adhesion and fixing adhesion | | Storage stability | |
|---|---|---|---|---|---|---|---|---|---|---|---|---|---|---|
| | No. | N/N | H/H | L/L | density | L/L | SL/L | performance | L/L | SL/L | H/H | SH/H | 50° C. | 55° C. |
| Example 46 | 46 | 0.2 | 0.3 | 0.2 | 1.45 | A | A | 7 | A | B | A | A | A | A |
| Example 47 | 47 | 0.2 | 0.4 | 0.3 | 1.42 | A | A | 10 | A | A | A | A | A | A |
| Example 48 | 48 | 0.2 | 0.2 | 0.2 | 1.45 | A | A | 5 | A | A | A | A | A | A |
| Example 49 | 49 | 0.2 | 0.2 | 0.2 | 1.45 | A | A | 5 | A | A | A | A | A | A |
| Example 50 | 50 | 0.2 | 0.2 | 0.2 | 1.45 | A | A | 5 | A | A | A | A | A | A |
| Example 51 | 51 | 0.2 | 0.3 | 0.2 | 1.45 | A | A | 5 | A | A | A | A | A | A |
| Example 52 | 52 | 0.2 | 0.4 | 0.3 | 1.42 | A | A | 5 | A | A | A | A | A | A |
| Example 53 | 53 | 0.2 | 0.2 | 0.2 | 1.45 | A | A | 5 | A | A | A | A | A | A |
| Example 54 | 54 | 0.2 | 0.2 | 0.2 | 1.45 | A | A | 5 | A | A | A | A | A | A |
| Example 55 | 55 | 0.2 | 0.2 | 0.2 | 1.45 | A | A | 5 | A | A | A | A | A | A |
| Example 56 | 56 | 0.2 | 0.3 | 0.2 | 1.45 | A | A | 5 | A | A | A | A | A | A |
| Example 57 | 57 | 0.2 | 0.2 | 0.2 | 1.45 | A | A | 5 | A | A | A | A | A | A |
| Example 58 | 58 | 0.2 | 0.3 | 0.2 | 1.45 | A | A | 7 | A | A | A | A | A | A |
| Example 59 | 59 | 0.1 | 0.1 | 0.1 | 1.45 | A | A | 5 | A | A | A | A | A | A |
| Example 60 | 60 | 0.1 | 0.1 | 0.1 | 1.45 | A | A | 5 | A | A | A | A | A | A |
| Example 61 | 61 | 0.2 | 0.2 | 0.2 | 1.45 | A | A | 5 | A | A | A | A | A | A |
| Example 62 | 62 | 0.2 | 0.2 | 0.2 | 1.45 | A | A | 5 | A | A | A | A | A | A |
| Example 63 | 63 | 0.2 | 0.2 | 0.2 | 1.45 | A | A | 5 | A | A | A | A | A | A |
| Example 64 | 64 | 0.2 | 0.2 | 0.2 | 1.45 | A | A | 5 | A | A | A | A | A | A |
| Example 65 | 65 | 0.2 | 0.9 | 0.5 | 1.41 | A | A | 5 | A | A | A | B | A | A |
| Example 66 | 66 | 0.2 | 0.7 | 0.4 | 1.45 | A | A | 5 | A | A | A | A | A | A |
| Example 67 | 67 | 0.2 | 0.6 | 0.2 | 1.45 | A | A | 5 | A | A | A | A | A | A |
| Example 68 | 68 | 0.2 | 0.2 | 0.2 | 1.43 | B | B | 8 | A | B | A | A | A | A |
| Example 69 | 69 | 0.2 | 0.8 | 0.2 | 1.45 | A | A | 5 | A | A | A | A | A | A |
| Example 70 | 70 | 0.2 | 0.2 | 0.2 | 1.45 | B | B | 5 | A | A | A | A | A | A |
| Example 71 | 71 | 0.2 | 0.2 | 0.2 | 1.45 | A | B | 8 | A | A | A | A | A | A |
| Example 72 | 72 | 0.2 | 0.3 | 0.3 | 1.45 | A | A | 5 | A | A | A | A | A | A |
| Example 73 | 73 | 0.2 | 0.2 | 0.2 | 1.45 | A | A | 5 | A | A | A | A | A | A |
| Example 74 | 74 | 0.2 | 0.2 | 0.2 | 1.45 | A | A | 5 | A | A | A | A | A | A |
| Example 75 | 75 | 0.2 | 0.3 | 0.2 | 1.45 | A | B | 5 | A | A | A | A | A | A |
| Example 76 | 76 | 0.3 | 0.3 | 0.3 | 1.45 | A | A | 7 | A | A | A | A | A | A |
| Example 77 | 77 | 0.2 | 0.2 | 0.2 | 1.45 | A | A | 5 | A | A | A | A | A | A |
| Example 78 | 78 | 0.2 | 0.2 | 0.2 | 1.45 | A | A | 5 | A | A | A | A | A | A |
| Example 79 | 79 | 0.2 | 0.4 | 0.2 | 1.45 | A | A | 5 | A | A | A | A | A | A |
| Example 80 | 80 | 0.2 | 0.2 | 0.2 | 1.45 | A | A | 5 | A | A | A | A | A | A |
| Example 81 | 81 | 0.2 | 0.2 | 0.2 | 1.43 | A | A | 5 | A | A | A | A | A | A |
| Example 82 | 82 | 0.2 | 0.4 | 0.2 | 1.45 | A | A | 6 | A | A | A | A | A | A |
| Comparative Example 1 | 83 | 0.2 | 0.2 | 0.2 | 1.38 | A | A | 15 | A | B | A | A | A | A |
| Comparative Example 2 | 84 | 0.8 | 1.5 | 1.5 | 1.45 | A | A | 5 | B | B | B | B | A | B |
| Comparative Example 3 | 85 | 0.5 | 0.8 | 0.8 | 1.40 | A | A | 21 | A | B | A | B | A | A |
| Comparative Example 4 | 86 | 0.2 | 0.2 | 0.2 | 1.38 | A | A | 18 | B | C | A | A | A | A |
| Comparative Example 5 | 87 | 0.2 | 0.2 | 0.2 | 1.36 | A | A | 20 | B | C | A | A | A | A |
| Comparative Example 6 | 88 | 0.2 | 0.2 | 0.2 | 1.36 | A | A | 22 | B | C | A | A | A | A |
| Comparative Example 7 | 89 | 1.0 | 1.5 | 1.5 | 1.45 | A | B | 5 | B | B | B | C | B | C |

TABLE 9.2-continued

| | Toner | Fogging | | | Image | Filming | | Fixing | Offset resistance | | Melt adhesion and fixing adhesion | | Storage stability | |
|---|---|---|---|---|---|---|---|---|---|---|---|---|---|---|
| | No. | N/N | H/H | L/L | density | L/L | SL/L | performance | L/L | SL/L | H/H | SH/H | 50° C. | 55° C. |
| Comparative Example 8 | 90 | 0.2 | 1.0 | 0.5 | 1.42 | A | B | 15 | B | B | A | B | A | A |
| Comparative Example 9 | 91 | 1.0 | 1.8 | 1.8 | 1.35 | B | C | 5 | C | D | C | C | B | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-247032, filed Dec. 28, 2018 which is hereby incorporated by reference herein in its entirety.

What is claimed is:

1. A toner, comprising:

a toner particle containing a binder resin and an ester wax having an SP value SPw of 8.59 to 9.01; and an organosilicon polymer particle containing an organosilicon polymer having a structure of silicon atoms and oxygen atoms alternately bound to one another, a part of silicon atoms in the organosilicon polymer having a T3 unit structure represented by $R^aSiO_{3/2}$, where $R^a$ denotes a $C_{1-6}$ alkyl group or phenyl group, wherein in $^{29}$Si-NMR measurement of the organosilicon polymer particle, a ratio of an area of peaks derived from silicon having the T3 unit structure relative to a total area of peaks derived from all silicon element contained in the organosilicon polymer particle is 0.70 to 1.00, and a plurality of domains of the wax are present in a cross-section of the toner particle observed under a scanning transmission electron microscope, an average long diameter of the domains being 0.03 to 2.00 μm.

2. The toner according to claim 1, wherein a difference between the SP value SPsi of the organosilicon polymer particle and SPw is not more than 0.40.

3. The toner according to claim 1, wherein the SP value SPs of the resin present on the toner particle surface is 9.94 to 10.90.

4. The toner according to claim 1, which satisfies $1.10 \leq SPs - SPw \leq 2.60$ when SPs is the SP value of the resin present on the toner particle surface.

5. The toner according to claim 1, wherein a ratio of toner particles having wax domains in a region within 0.05 μm depth from the toner particle surface is not more than 20% by number in said cross-section of the toner particle observed under a scanning transmission electron microscope.

6. The toner according to claim 1, wherein a coverage ratio of a surface of the toner particle by the organosilicon polymer particle is 30 to 70 area %.

7. The toner according to claim 1, wherein the toner further comprises an inorganic fine particle, and a coverage ratio of a surface of the toner particle by the inorganic fine particle is at least 30 area %.

8. The toner according to claim 1, wherein the ester wax is aliphatic, and has a melting point of 63 to 95° C. and a peak molecular weight of 400 to 2,500.

9. The toner according to claim 1, which satisfies $500 \leq (SPb - SPw)^2 \times Mp \leq 3.000$ when Mp is the peak molecular weight of the wax and SPb is the SP value of the binder resin.

10. The toner according to claim 1, which satisfies $0.10 \leq Dw/Dt \leq 0.45$ when Dw is an average long diameter of the wax domains and Dt is a number-average particle diameter of the toner.

11. The toner according to claim 1, wherein the toner particle contains a crystalline polyester.

12. The toner according to claim 1, wherein a number-average particle diameter Dsi of the organosilicon polymer particle is 80 to 300 nm.

13. The toner according to claim 1, which satisfies $0.0125 \leq Dsi/Dt \leq 0.0750$ when Dsi is the number-average particle diameter of the organosilicon polymer particle and Dt is the number-average particle diameter of the toner.

14. The toner according to claim 1, wherein the organosilicon polymer particle is a polyalkyl silsesquioxane particle.

15. The toner according to claim 1, wherein the organosilicon polymer particle has a shape factor of not more than 120.

* * * * *